United States Patent [19]

Shimazaki et al.

[11] Patent Number: 4,968,594

[45] Date of Patent: Nov. 6, 1990

[54] SILVER HALIDE COLOR PHOTOGRAPHIC MATERIAL

[75] Inventors: Hiroshi Shimazaki; Mitsuto Fujiwhara, both of Tokyo, Japan

[73] Assignee: Konishiroku Photo Industry Co., Ltd., Tokyo, Japan

[21] Appl. No.: 361,817

[22] Filed: Jun. 1, 1989

[30] Foreign Application Priority Data

Mar. 5, 1986 [JP] Japan ..... 61-50077

[51] Int. Cl.[5] ..... G03C 7/305; G03C 7/333; G03C 7/38

[52] U.S. Cl. ..... 430/549; 430/359; 430/504; 430/552; 430/553; 430/556; 430/557; 430/558

[58] Field of Search ..... 430/504, 558, 549, 359, 430/552, 553, 556, 557

[56] References Cited

U.S. PATENT DOCUMENTS

| | | | |
|---|---|---|---|
| 4,420,556 | 12/1983 | Booms et al. | 430/549 |
| 4,489,155 | 12/1984 | Sakanove et al. | 430/505 |
| 4,540,654 | 9/1985 | Sato et al. | 430/558 |
| 4,543,323 | 9/1985 | Iijima et al. | 430/503 |
| 4,639,413 | 1/1987 | Kawagishi et al. | 430/558 |
| 4,647,527 | 3/1987 | Ikenoue et al. | 430/505 |
| 4,665,015 | 5/1987 | Iijima et al. | 430/558 |
| 4,675,280 | 6/1987 | Kaneko et al. | 430/558 |
| 4,690,888 | 9/1987 | Fujiwhara et al. | 430/549 |
| 4,701,404 | 10/1987 | Iijima et al. | 430/559 |

FOREIGN PATENT DOCUMENTS

| | | |
|---|---|---|
| 117105 | 8/1984 | European Pat. Off. . |
| 170164 | 2/1986 | European Pat. Off. . |
| 174873 | 3/1986 | European Pat. Off. . |
| 2260124 | 8/1975 | France . |
| 6150135 | 3/1986 | Japan . |

*Primary Examiner*—Paul R. Michl
*Assistant Examiner*—Lee C. Wright
*Attorney, Agent, or Firm*—Jordan B. Bierman

[57] ABSTRACT

A negative-working silver halide color photographic material is disclosed which has at least one silver halide emulsion layer on a support, said material including a pyrazolotriazole-based magenta coupler and means for forming an unsharp positive image.

8 Claims, No Drawings

SILVER HALIDE COLOR PHOTOGRAPHIC MATERIAL

This application is a continuation of application Ser. No. 022,373 filed Mar. 5, 1987 now abandoned.

FIELD OF THE INVENTION

The present invention relates to a negative-working silver halide color photographic material. More particularly, the present invention relates to a negative-working silver halide color photographic material that does not have any unwanted absorption in a magenta color-forming layer and which exhibits superior stability during storage in a hot and humid atmosphere, with attendant improvement in sharpness.

BACKGROUND OF THE INVENTION

In silver halide color photography, exposed silver halide grains are reduced with an aromatic primary amino color developing agent and the resulting oxidation product of the color developing agent is coupled with yellow, magenta and cyan dye forming couplers to produce respective dye images.

For producing a magenta dye, pyrazolone type magenta couplers have been used commercially but the dye they form is not completely pure in color since it has a yellow component due to the unwanted absorption at a wavelength of about 430 nm.

A number of proposals have been put forth with a view to solving this problem of color contamination in magenta dyes. For example, U.S. Pat. No. 3,725,067 discloses a 1H-pyrazolo[ 3,2-C]-S-triazole type magenta coupler; Japanese Patent Application (OPI) No. 171956/1984 (the term OPI as used hereinafter means an unexamined published Japanese patent application), a 1H-pyrazolo[1,5-b]-1,2,4-triazole type magenta coupler; Japanese Patent Application (OPI) No. 33552/1985, a 1H-pyrazolo[1,5-d]-tetrazole type magenta coupler; and Japanese Patent Application (OPI) No. 162548/1984, a 1H-imidazo[1,2-b]pyrazole type magenta coupler; all of these couplers are claimed to be free from the problem of unwanted absorption. Among these pyrazoloazole type couplers, the 1-pyrazolo[3,2-C]-S-triazole type coupler and 1H-pyrazolo[1,5-b]-1,2,4-triazole type coupler are acceptable for commercial purposes because they offer superior sensitivity and color-forming properties.

However, one serious problem with commercial use of silver halide color photographic materials containing the above-listed magenta couplers is that they have not satisfactorily good stability during storage in a hot and humid atmosphere after preparation; for instance, they experience a significant drop in sensitivity after they have been exposed to an atmosphere of 40° C. and 80% R.H. for a period of one week.

SUMMARY OF THE INVENTION

An object, therefore, of the present invention is to provide a negative-working silver halide color photographic material that does not have any unwanted absorption in a magenta color-forming layer and which exhibits superior stability during storage in a hot and humid atmosphere, with attendant improvement in sharpness.

As a result of various studies conducted in order to attain this object, the present inventors have found that it can be attained by a negative-working silver halide color photographic material having at least one silver halide emulsion layer on a support if it contains a pyrazolotriazole-based magenta coupler and means for forming an unsharp positive image.

DETAILED DESCRIPTION OF THE INVENTION

The pyrazolotriazole-based magenta coupler used in the present invention (this coupler is hereinafter referred to simply as the magenta coupler of the present invention) has the following general formula (A) or (B):

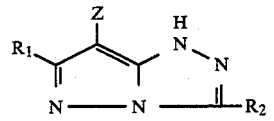

(A)

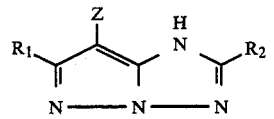

(B)

In formulas (A) and (B), $R_1$ and $R_2$ each represents an alkyl group, an aryl group, or a heterocyclic group, each of which may be bonded to the carbon atom of the nucleus through a bonding group selected from along an oxygen atom, a nitrogen atom and a sulfur atom Said alkyl, aryl and heterocyclic groups each may be bonded through any of the following bonding groups acylamino, carbamoyl, sulfonamido, sulfamoylcarbonyl, carbonyloxy, oxycarbonyl, ureido, thioureido, thioamido, sulfone and sulfonyloxy The groups represented by $R_1$ and $R_2$ are each a straightor branched-chain alkyl group having 1 to 20 carbon atoms (e.g., methyl, ethyl, propyl, i-propyl, sec-butyl, n-butyl, t-butyl, n-octyl, t-octyl, dodecyl or octadecyl). These groups may further have a substituent(s) (e.g., a halogen atom, nitro, cyano, alkoxy, aryloxy, amino, acylamino, carbamoyl, sulfonamido, sulfamoyl, amido, alkylthio, arylthio, aryl, alkoxycarbonyl or acyl). Examples of such substituent include chloromethyl, bromomethyl, trichloromethyl, β-nitroethyl, δ-cyanobutyl, methoxymethyl, ethoxyethyl, phenoxyethyl, N-''''ethylaminoethyl, dimethylaminobutyl, acetoaminoethyl, benzoylamino, propyl, ethylcarbamoylethyl, methanesulfonamidoethyl, ethylthioethyl, p-methoxyphenylthiomethyl, phenylmethyl, p-chlorophenylmethyl, naphthylethyl, ethoxycarbonylethyl and acetylethyl.

Preferable aryl groups are phenyl and naphthyl groups, which may have such a substituent(s) as shown with respect to the alkyl group.

The heterocyclic ring represented by $R_1$ or $R_2$ is preferably a 5- or 6-membered ring having at least one of the nitrogen, oxygen and sulfur atoms, and it may be one having or not having aromaticity. Examples of such ring include pyridyl, quinolyl, pyrrolyl, morpholyl, furanyl, tetrahydrofuranyl, pyrazolyl, triazolyl, tetrazolyl, thiazolyl, oxazolyl, imidazolyl and thiadiazolyl. These may also have such a substituent(s) as shown with respect to the alkyl group.

Examples of the alkyl, aryl or heterocyclic group represented by $R_1$ or $R_2$ which is bonded through one of the bonding groups mentioned above or through a nitrogen, oxygen or sulfur atom are shown below:

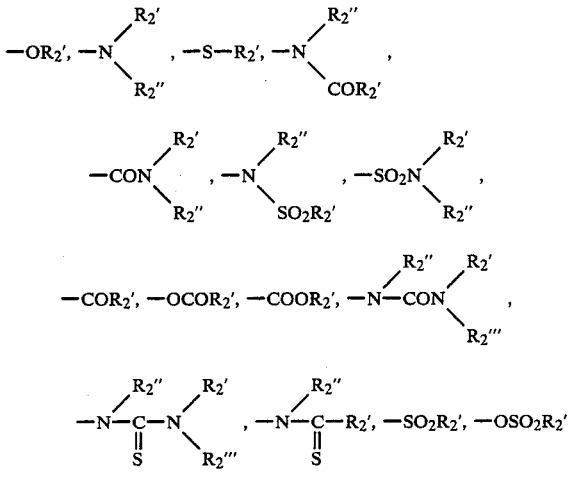

wherein $R_2'$ represents an alkyl, aryl or heterocyclic group; and $R_2''$ and $R_2'''$ each represents a hydrogen atom, an alkyl group, an aryl group or a heterocyclic ring.

If the heterocyclic group is a pyrazolotriazole based compound, a bis type pyrazolotriazole based compound is formed and this is of course a magenta coupler included within the scope of the present invention.

Shown below are specific examples of $R_1$ and $R_2$ in formulas (A) and (B):

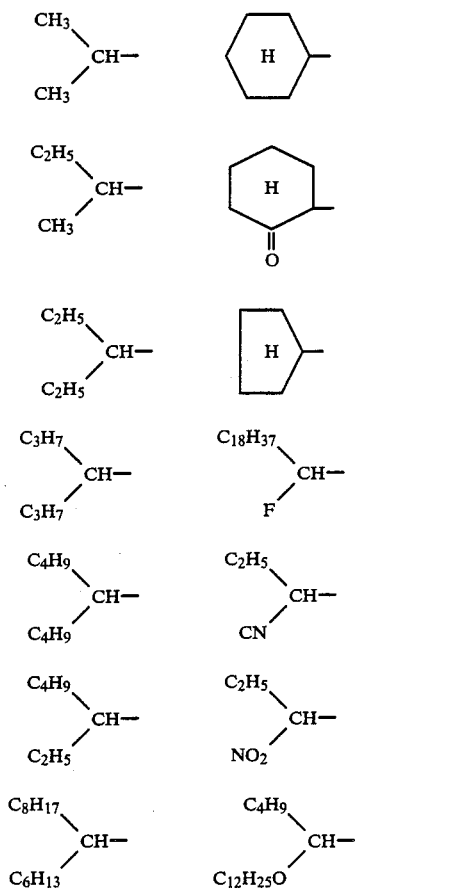

-continued

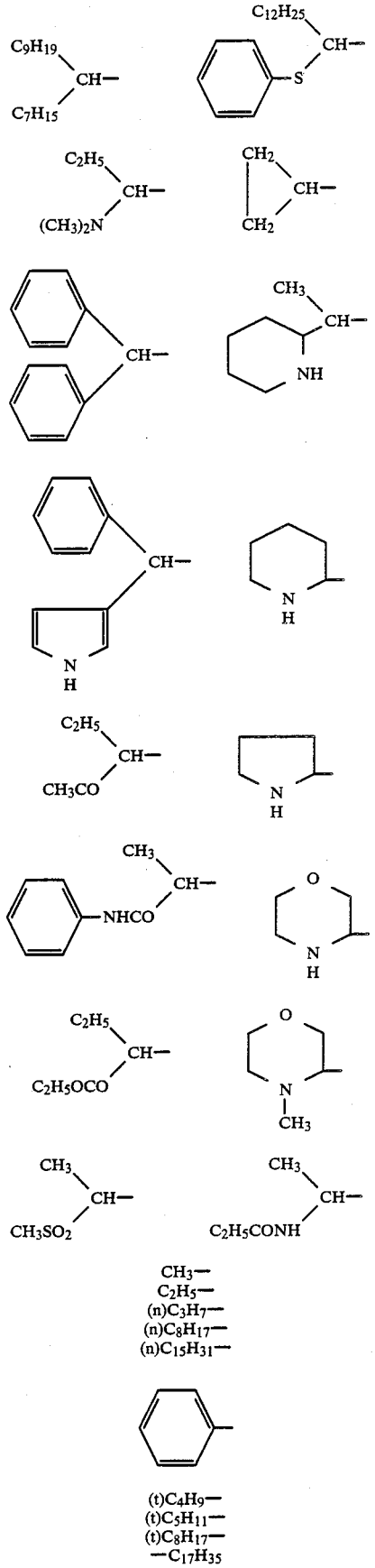

-continued $-CH_2CH_2CH_2OC_{12}H_{25}$
$-CH_2CH_2CONHC_{14}H_{29}$
$-OC_{12}H_{25}$

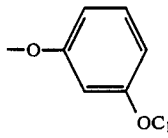

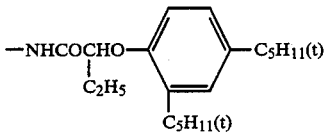

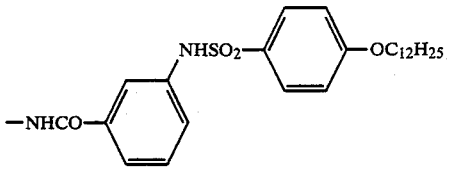

$-NHC_{14}H_{29}$ $-N(CH_2\overset{C_2H_5}{\overset{|}{C}}HC_4H_9)_2$

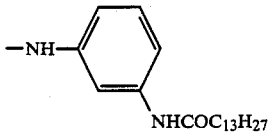

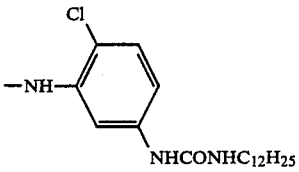

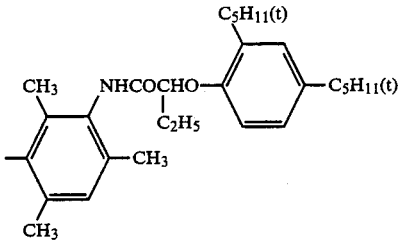

$-S-C_{16}H_{33}$
$-CONHC_{14}H_{29}$
$-NHSO_2C_{16}H_{33}$
$-SO_2NHC_{16}H_{33}$
$-COC_{11}H_{23}$
$-OCOC_{15}H_{31}$

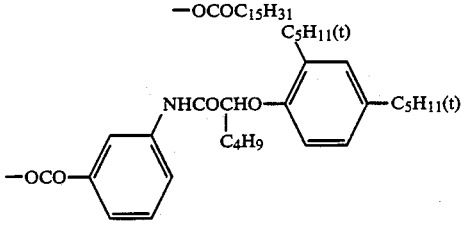

$-COOC_{12}H_{25}$

-continued

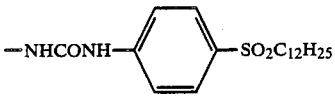

$-SO_2C_{16}H_{33}$

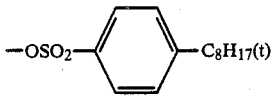

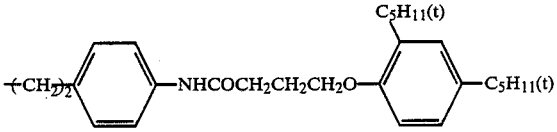

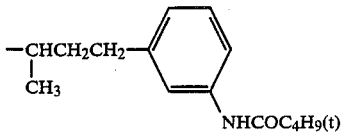

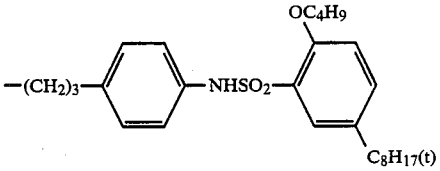

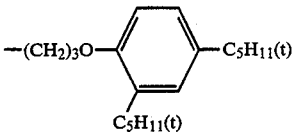

Z represents a hydrogen atom or a group which leaves upon formation of a dye through coupling with the oxidized product of an aromatic primary amine color developing agent.

Specific examples thereof include a halogen atom, an alkoxy group, an aryloxy group, an acyloxy group, an arylthio group, an alkylthio group and

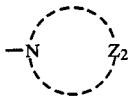

(where $Z_2$ represents the group of atoms necessary to form a 5- or 6-membered ring together with the nitrogen atom and an atom selected from a carbon atom, an oxygen atom, a nitrogen atom and a sulfur atom).

Illustrative leaving groups are listed below.

Halogen atom: chlorine, bromine or fluorine atom

Alkoxy group: ethoxy, benzyloxy, methoxyethylcarbamoylmethoxy or tetradecylcarbamoylmethoxy group Aryloxy group: phenoxy, 4-methoxyphenoxy or 4-nitrophenoxy group Acyloxy group: acetoxy, myristoyloxy or benzoyloxy group Arylthio group: phenylthio, 2-buthoxy-5-octylphenylthio or 2,5-dihexyloxyphenylthio group Alkylthio group: methylthio, octylthio, hexadecylthio, benzylthio, 2-(diethylamino)ethylthio, ethoxyethylthio or phenoxyethylthio group

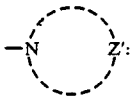

pyrazoloy, imidazolyl, triazolyl or tetrazolyl group

Examples of the groups represented by

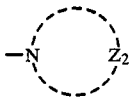

are listed below.

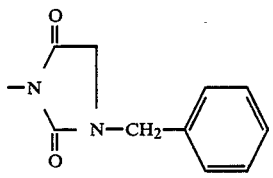

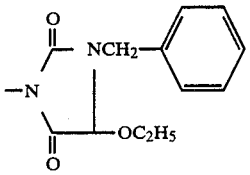

-continued

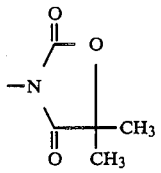

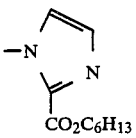

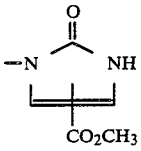

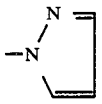

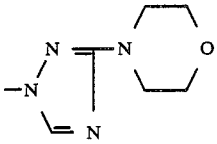

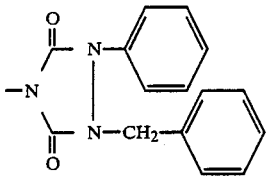

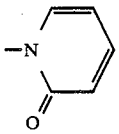

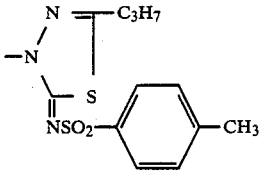

The following are non-limiting examples of the pyrazolotriazole type magenta couplers that are preferably used in the present invention.

P-1

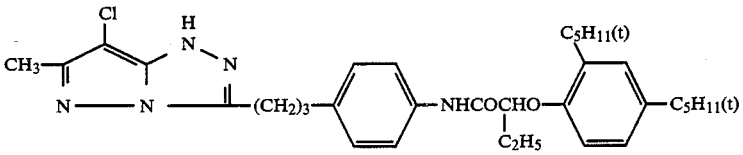

P-2

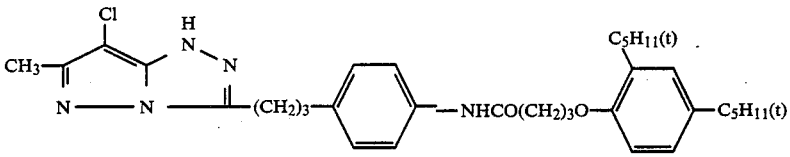

P-3

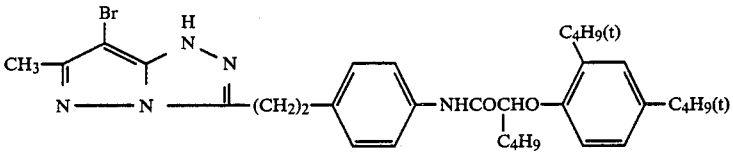

P-4

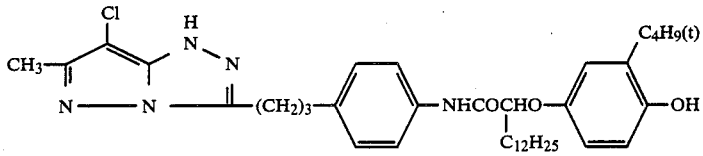

-continued
P-5
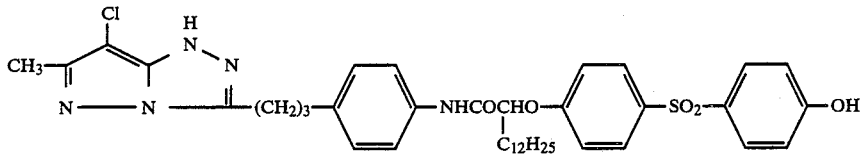
P-6
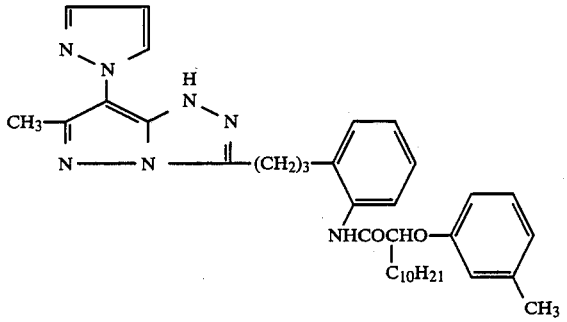
P-7
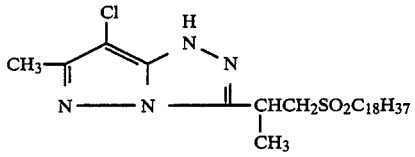
P-8
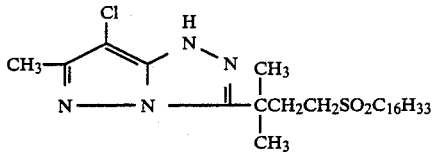
P-9
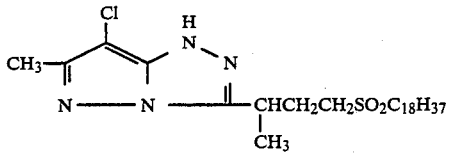
P-10
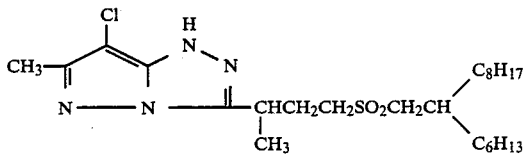
P-11
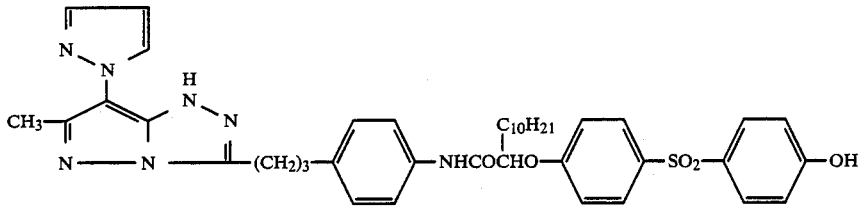
P-12
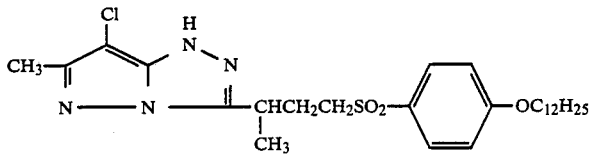

-continued
P-13
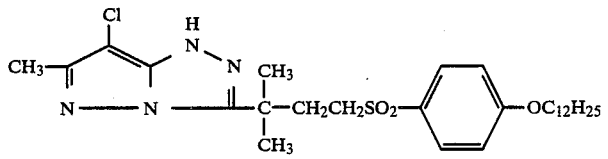
P-14
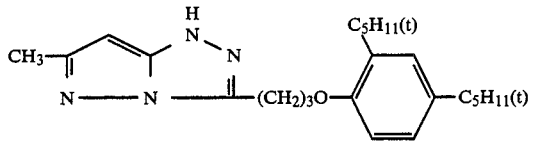
P-15
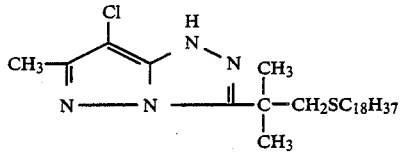
P-16
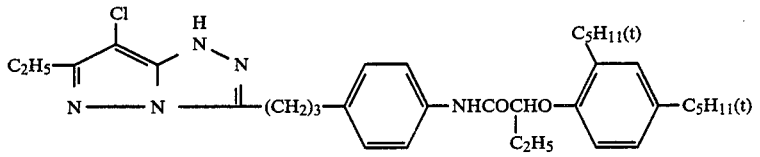
P-17
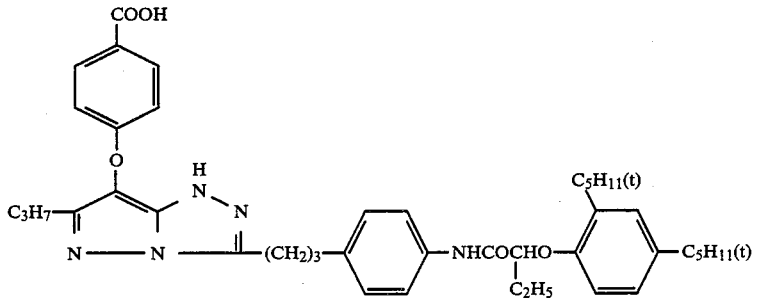
A-18
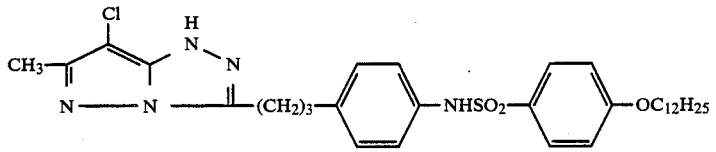
A-19
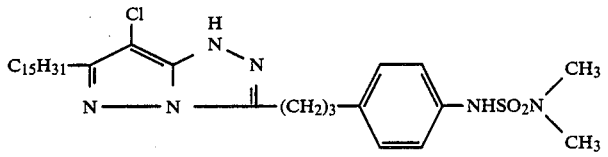
A-20
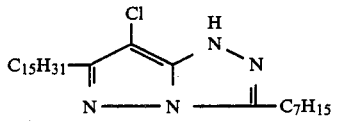

-continued
P-21
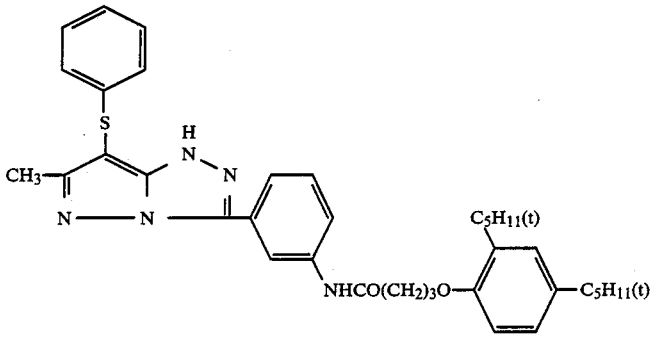
P-22
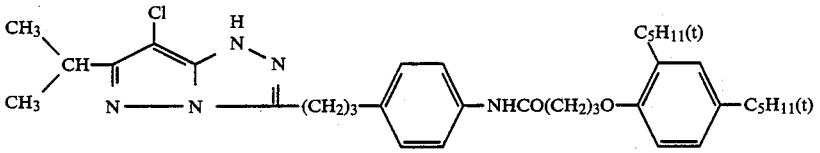
P-23
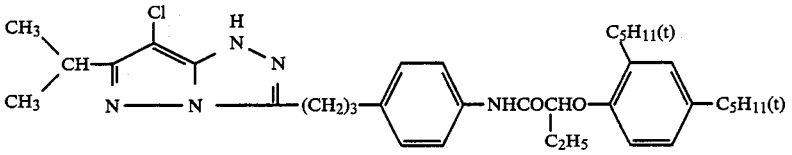
P-24
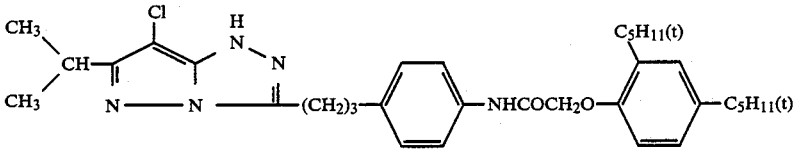
P-25
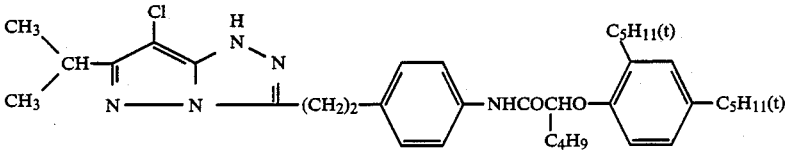
P-26
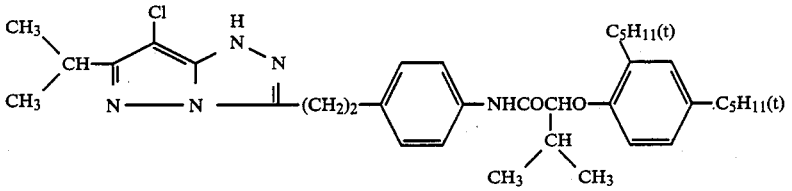
P-27
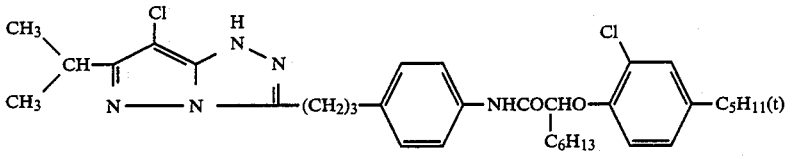
P-28
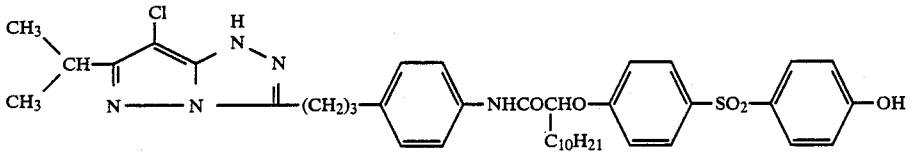

-continued
P-29
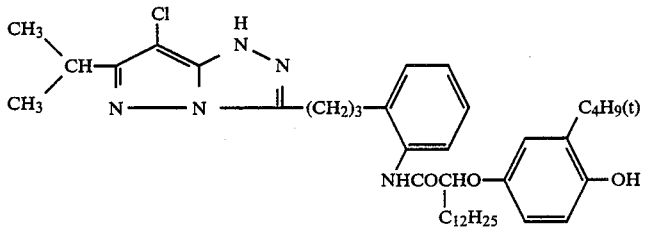
P-30
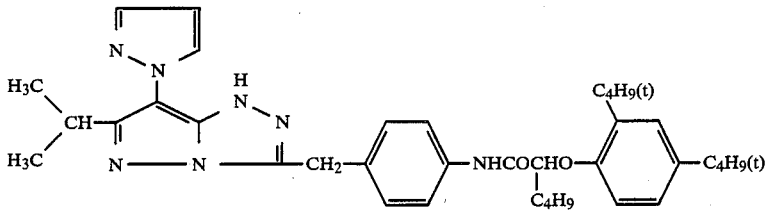
P-31
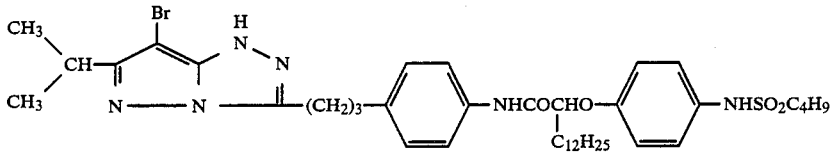
P-32
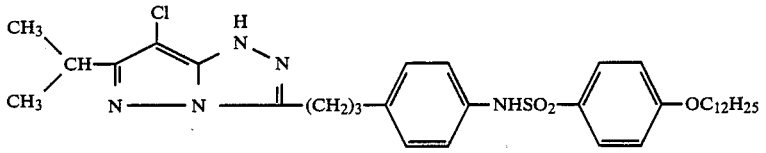
P-33
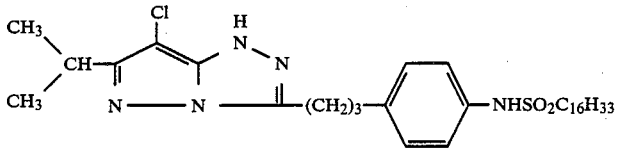
P-34
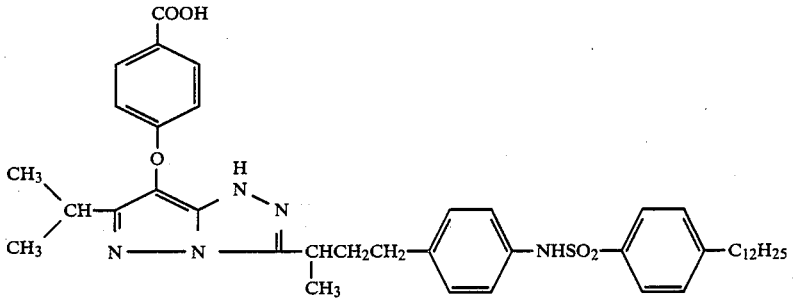
P-35
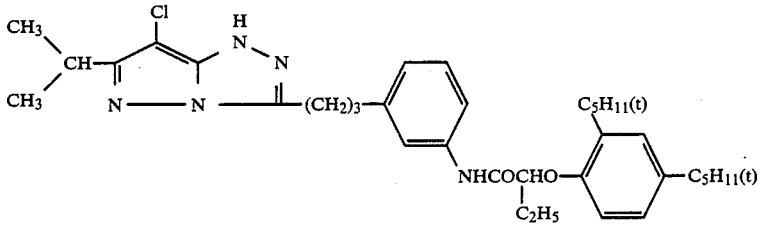

-continued
P-36
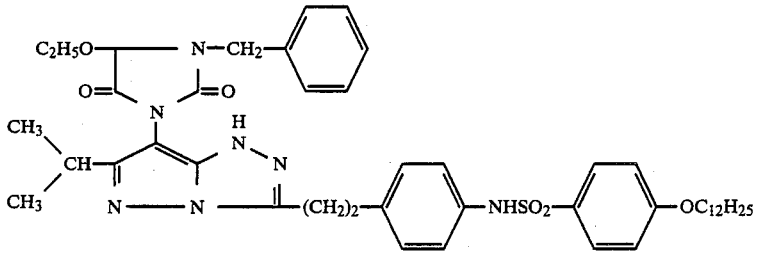
P-37
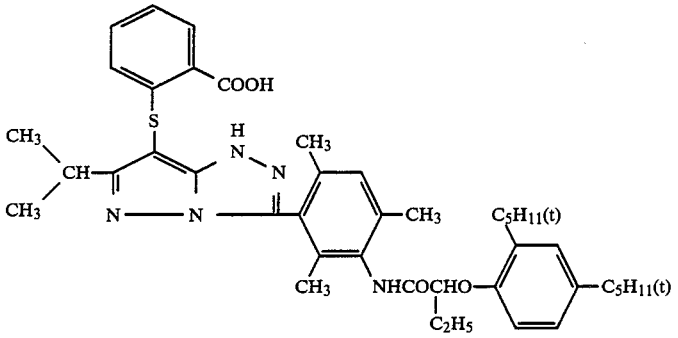
P-38
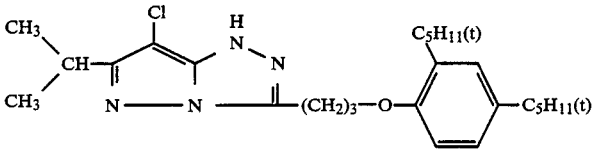
P-39
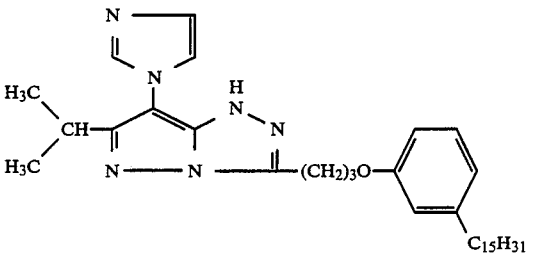
P-40
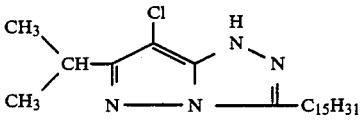
P-41
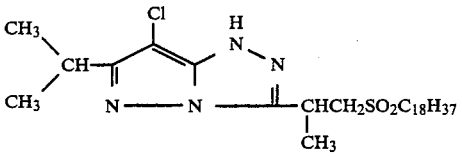
P-42
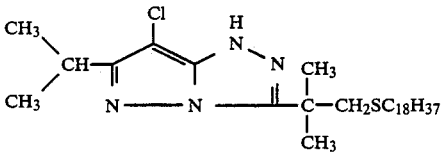
P-43
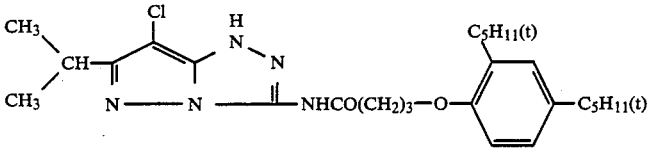

-continued
P-44
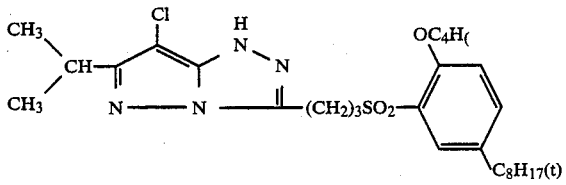
P-45
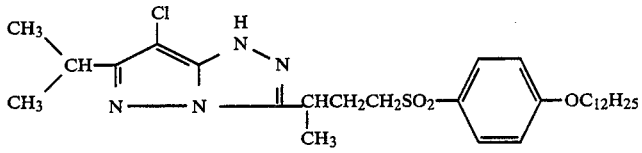
P-46
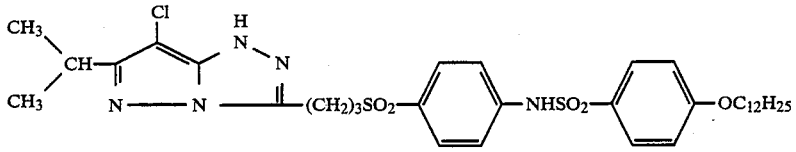
P-47
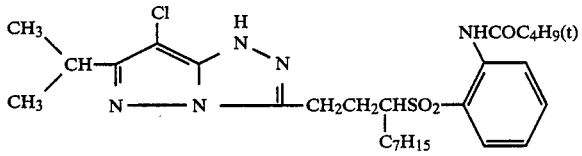
P-48
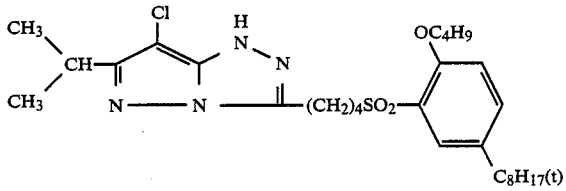
P-49
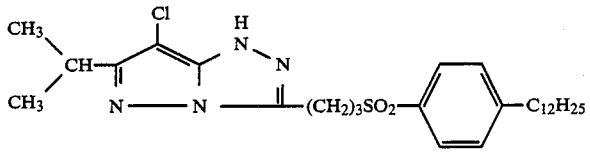
P-50
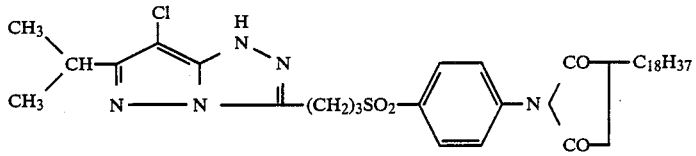
P-51
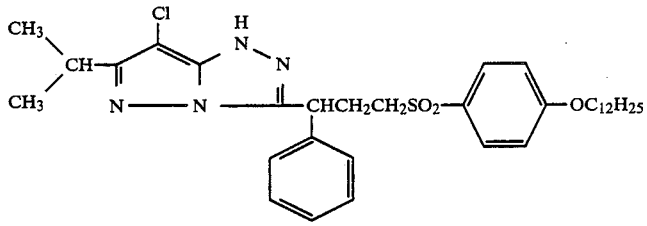
P-52
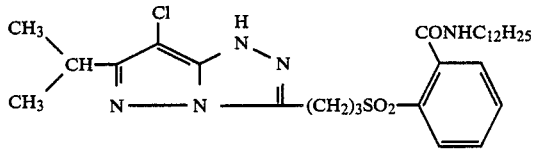

-continued
P-53
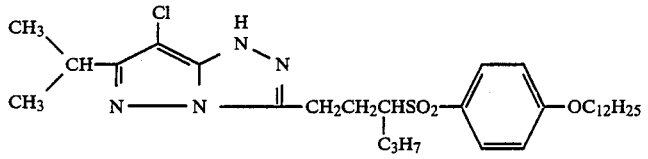
P-54
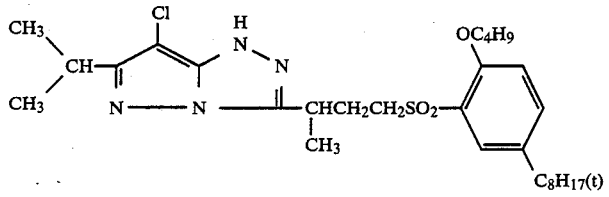
P-55
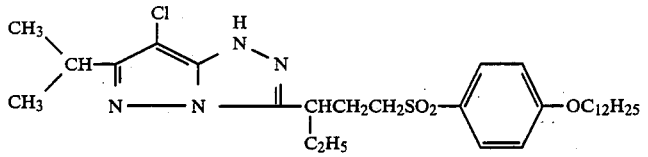
P-56
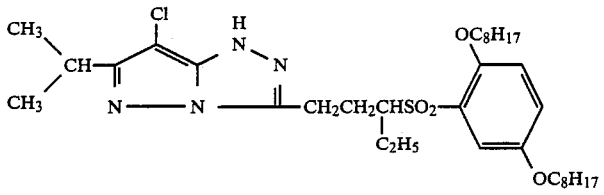
P-57
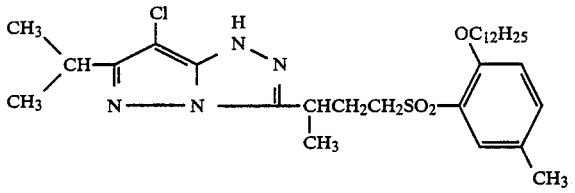
P-58
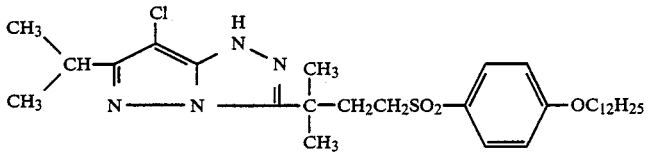
P-59
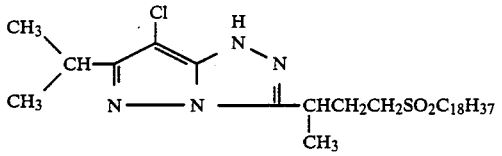
P-60
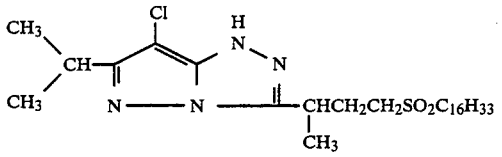
P-61
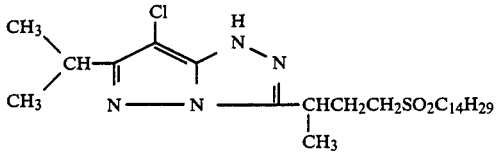

-continued
P-62
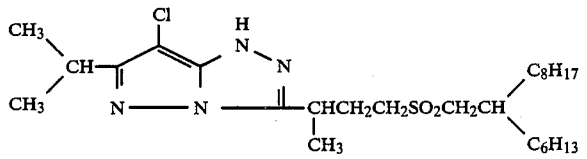
P-63
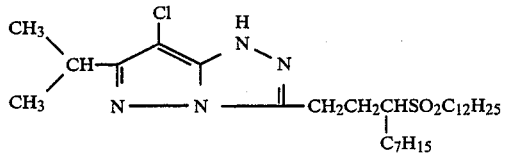
P-64
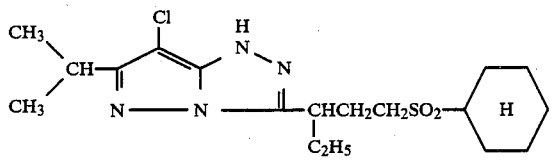
P-65
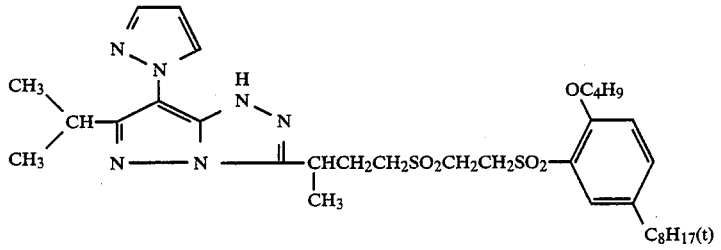
P-66
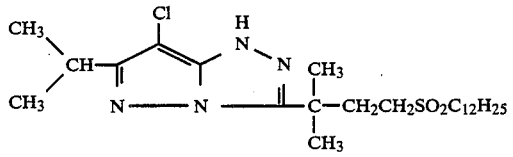
P-67
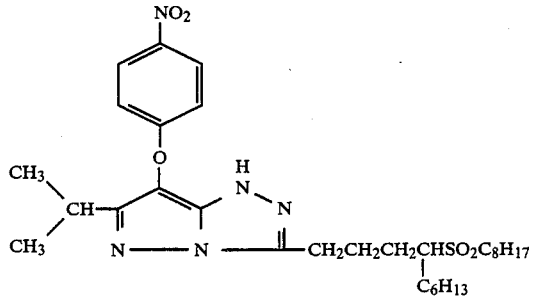
P-68
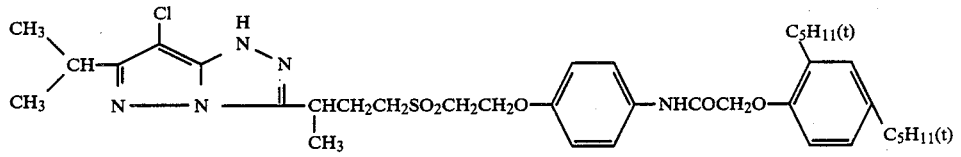
P-69
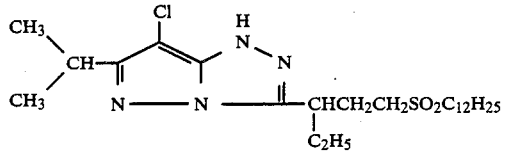

-continued
P-70
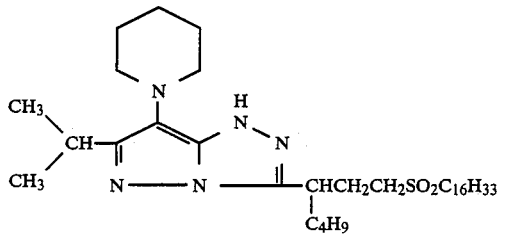
P-71
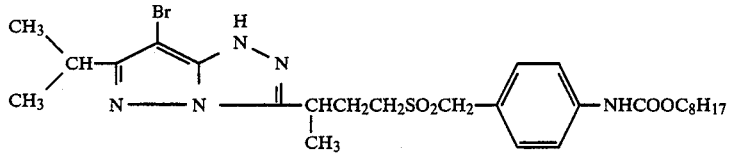
P-72
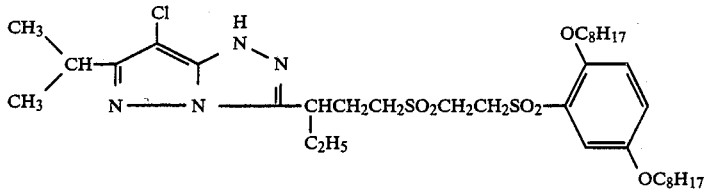
P-73
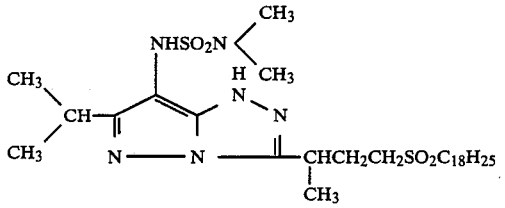
P-74
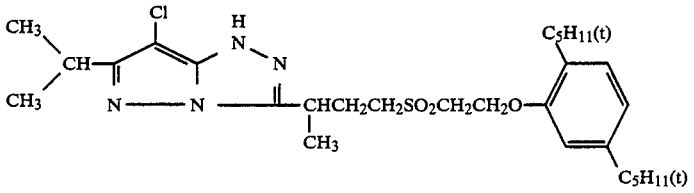
P-75
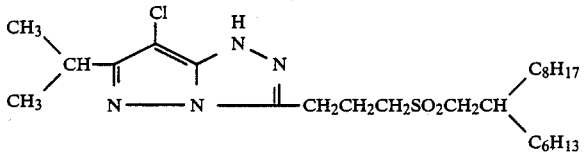
P-76
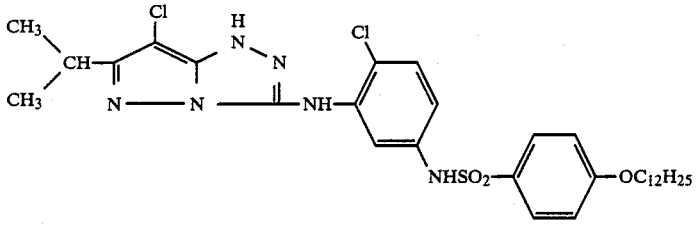
P-77
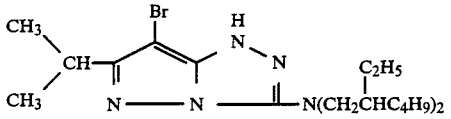

-continued
P-78
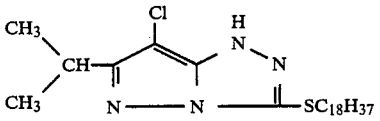
P-79
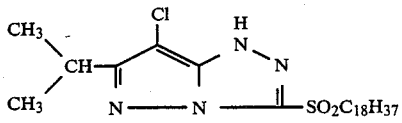
P-80
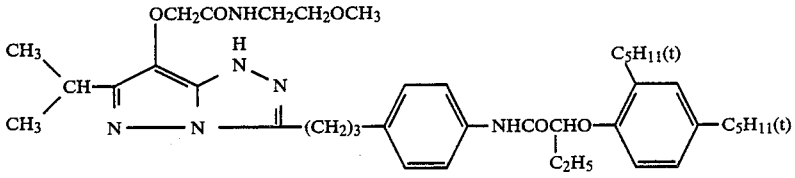
P-81
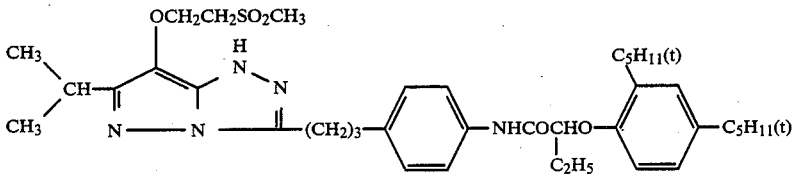
P-82
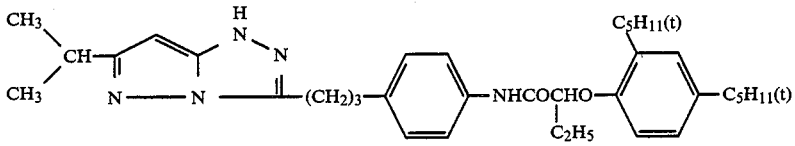
P-83
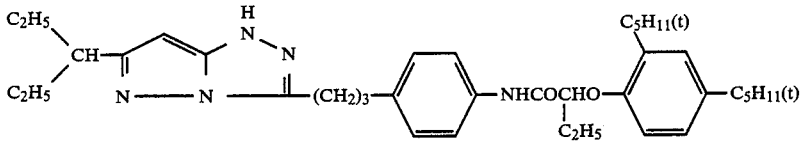
P-84
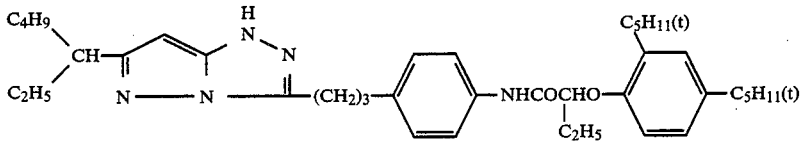
P-85
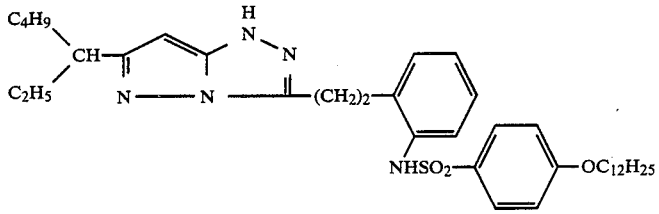
P-86
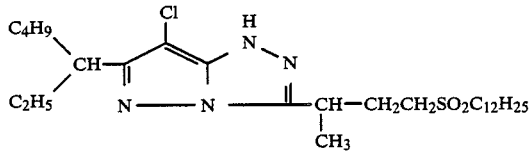
P-87
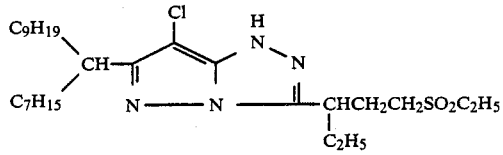

-continued
P-88
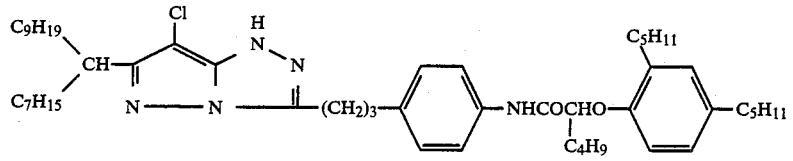
P-89
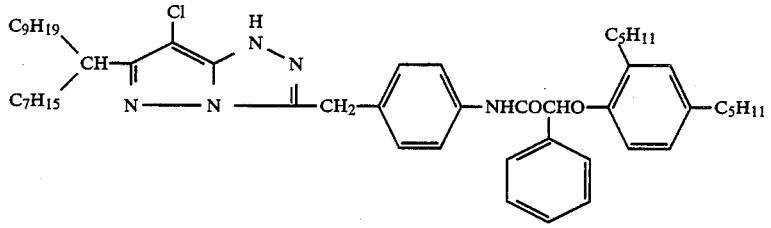
P-90
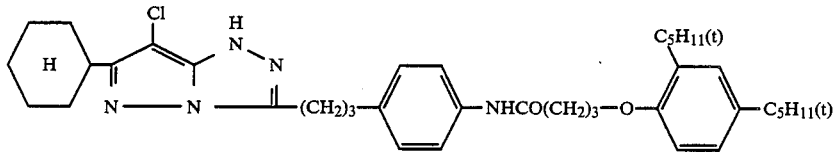
P-91
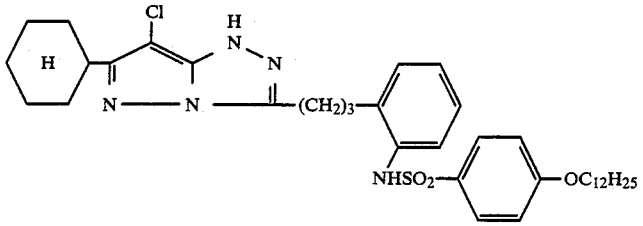
P-92
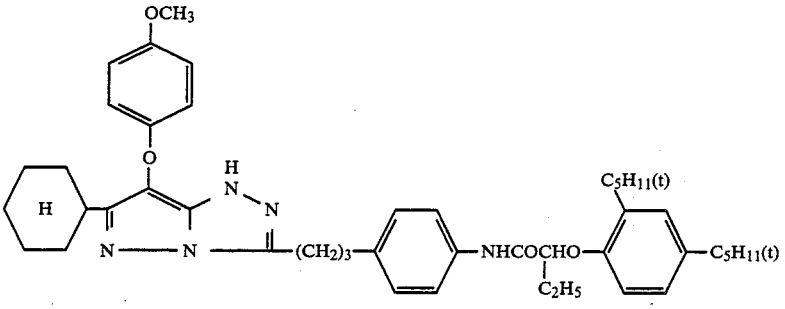
P-93
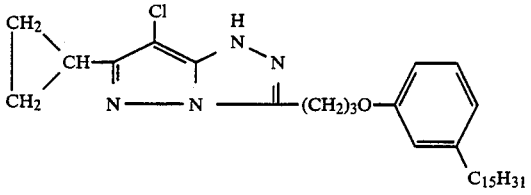
P-94
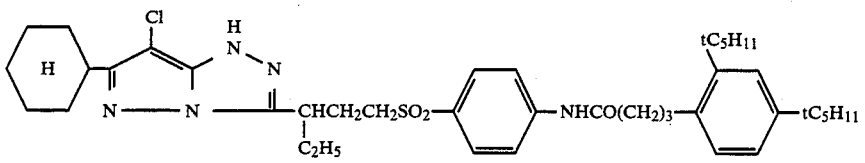

-continued
P-95
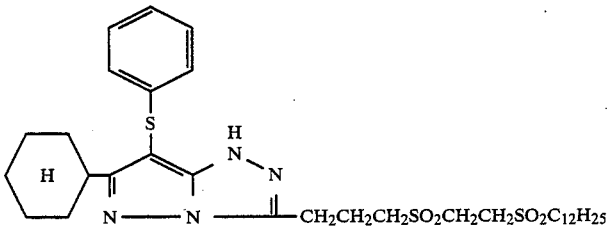
P-96
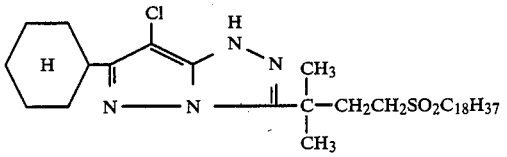
P-97
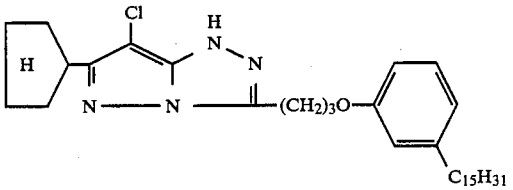
P-98
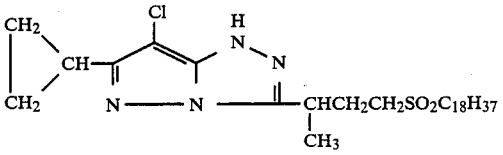
P-99
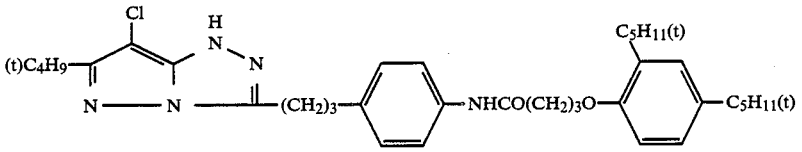
P-100
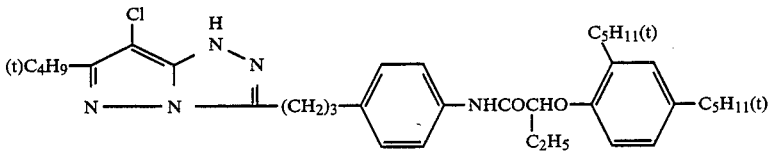
P-101
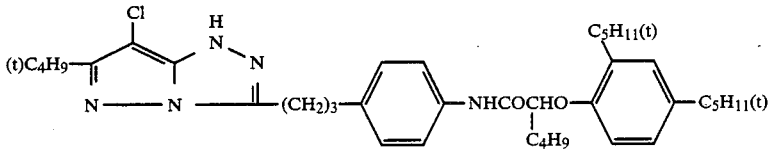
P-102
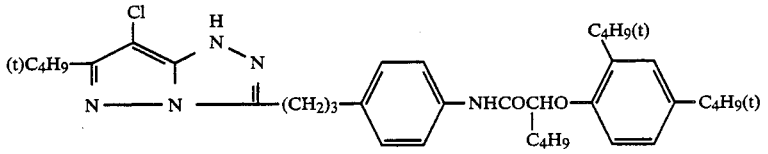

-continued
P-103
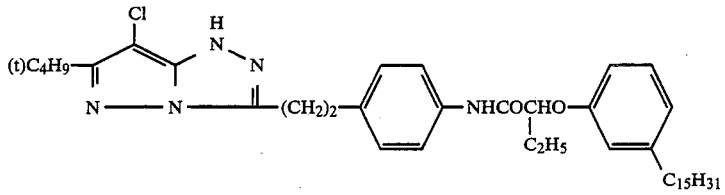
P-104
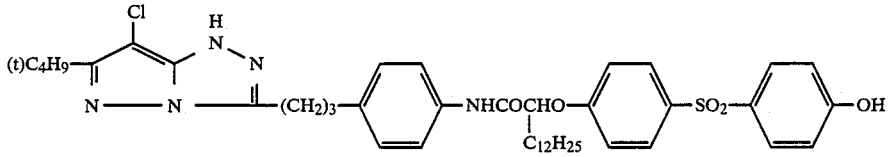
P-105
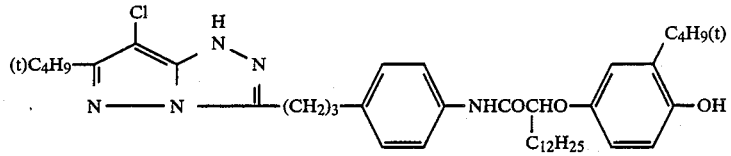
P-106
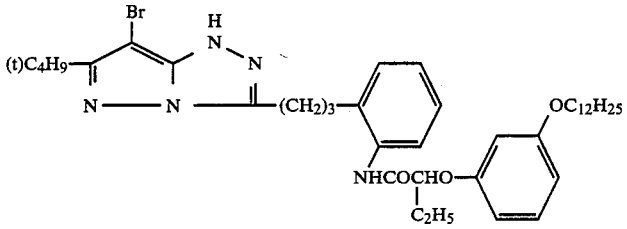
P-107
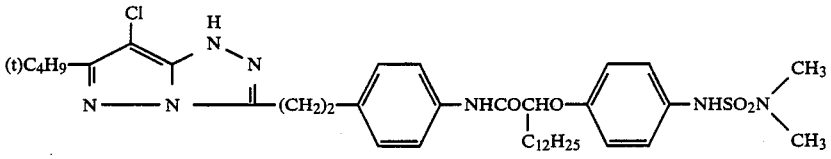
P-108
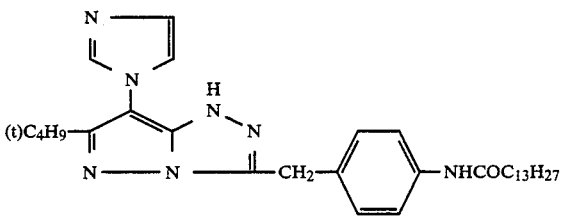
P-109
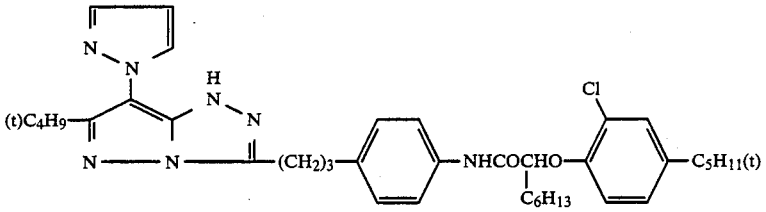
P-110
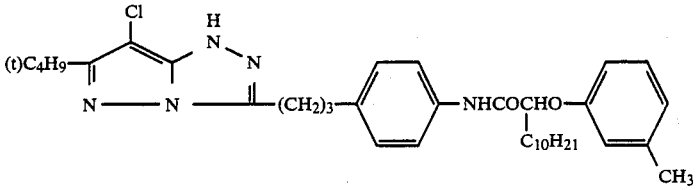

-continued
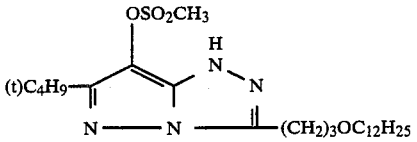
P-111
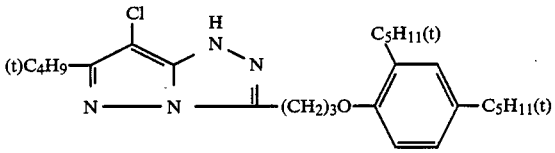
P-112
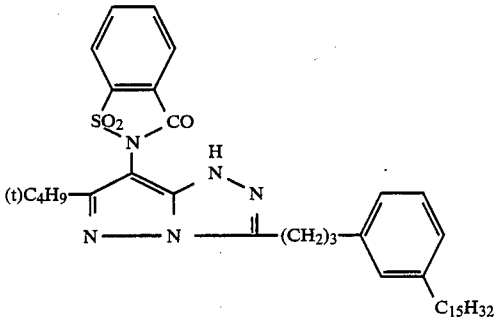
P-113
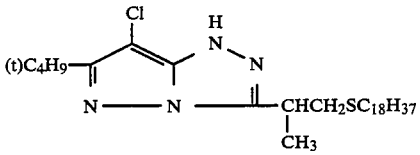
P-114
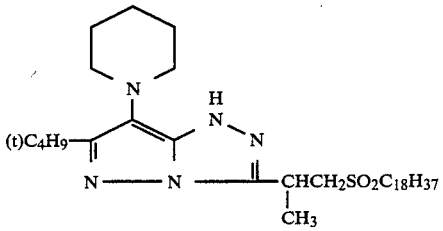
P-115
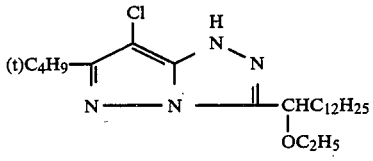
P-116
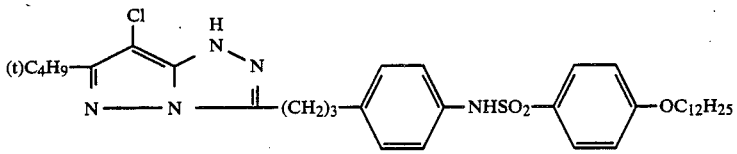
P-117

-continued
P-118
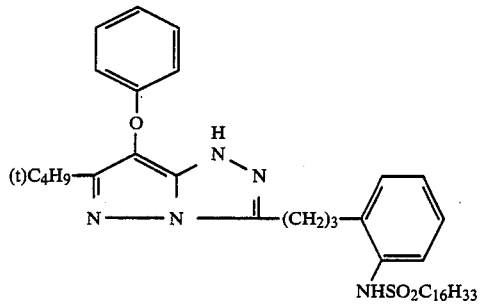
P-119
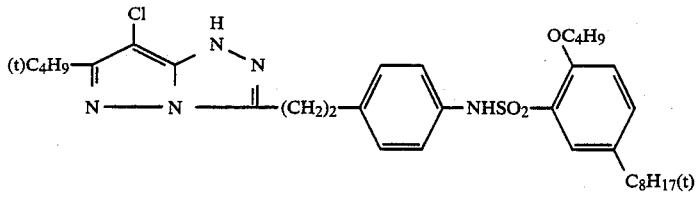
P-120
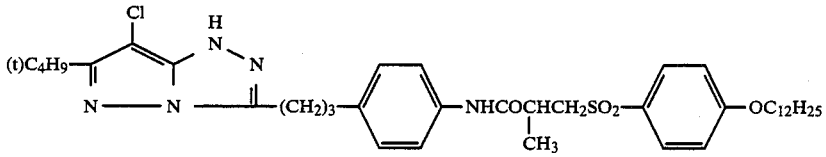
P-121
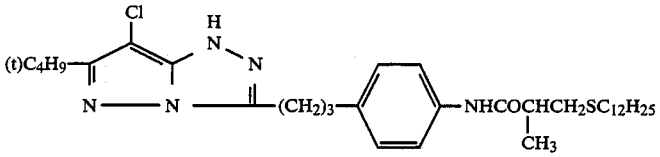
P-122
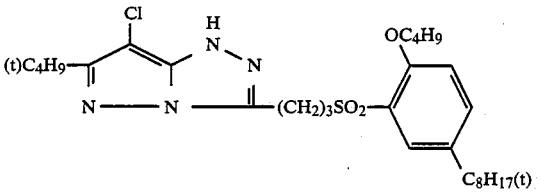
P-123
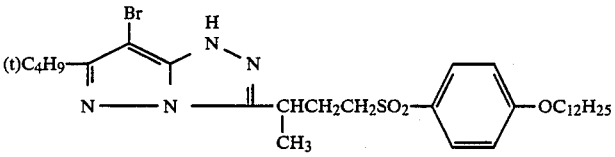
P-124
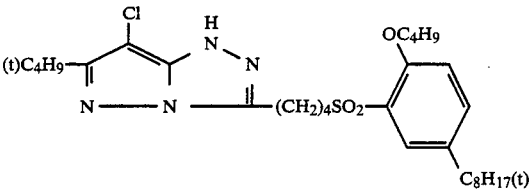

-continued
P-125
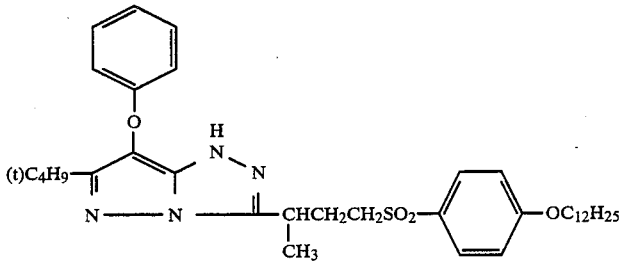
P-126
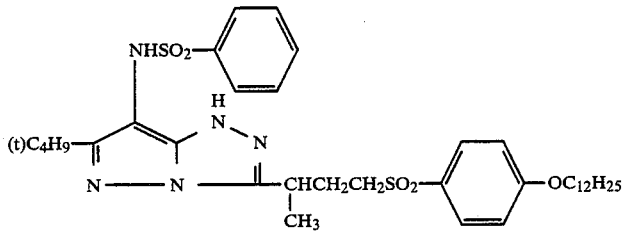
P-127
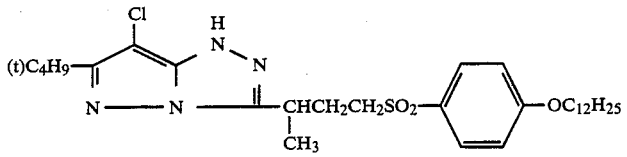
P-128
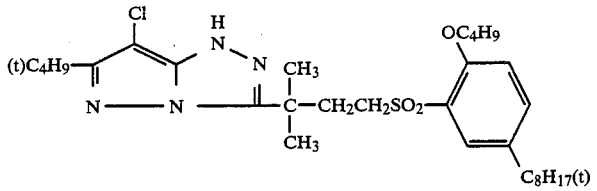
P-129
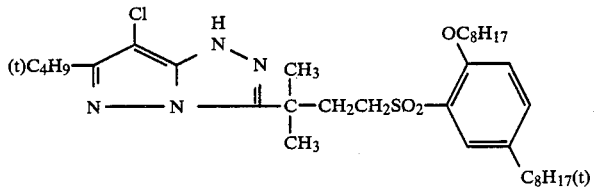
P-130
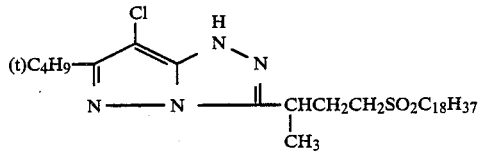
P-131
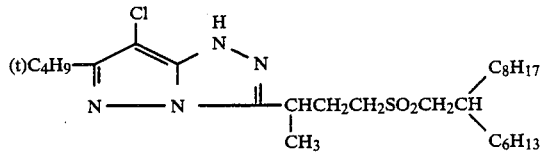
P-132
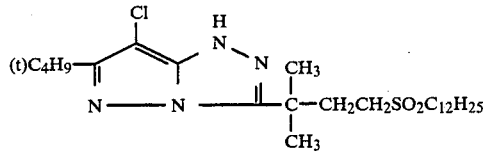

-continued
P-133
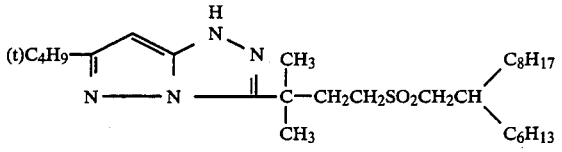
P-134
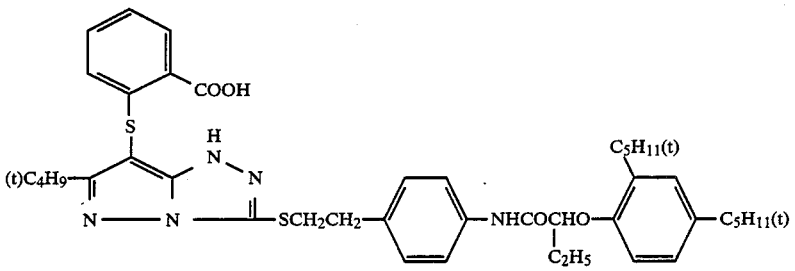
P-135
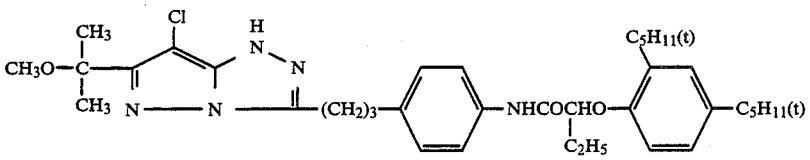
P-136
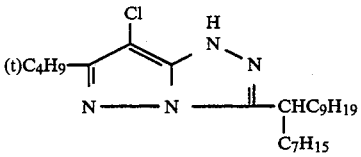
P-137
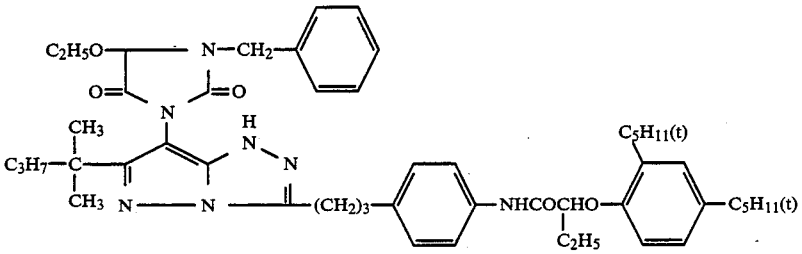
P-138
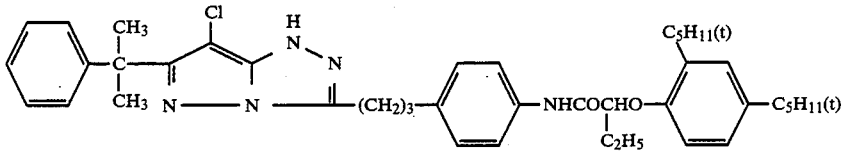
P-139
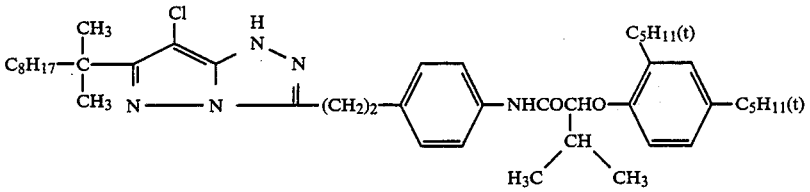
P-140
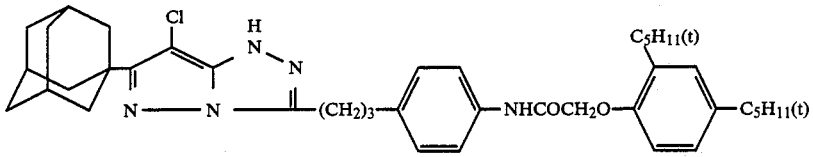

-continued
P-141
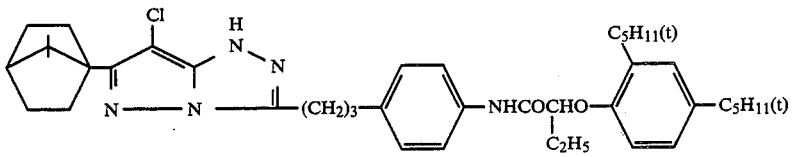
P-142
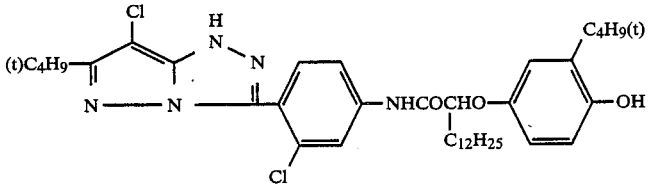
P-143
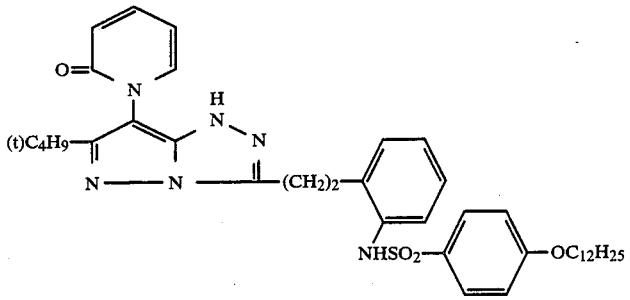
P-144
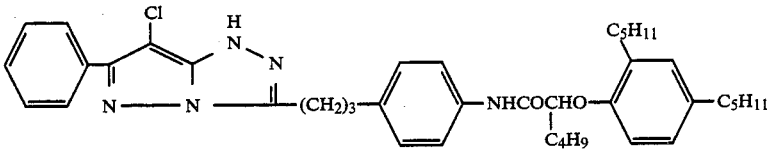
P-135
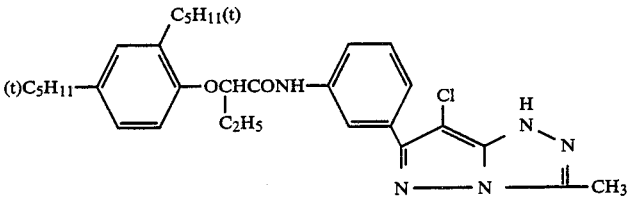
P-146
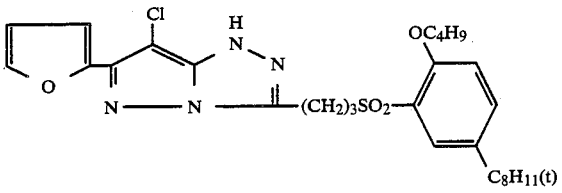
P-147
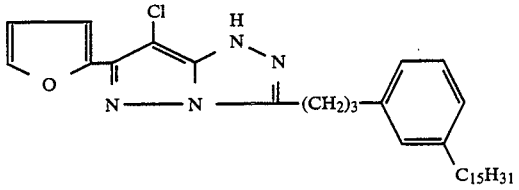

-continued
P-148
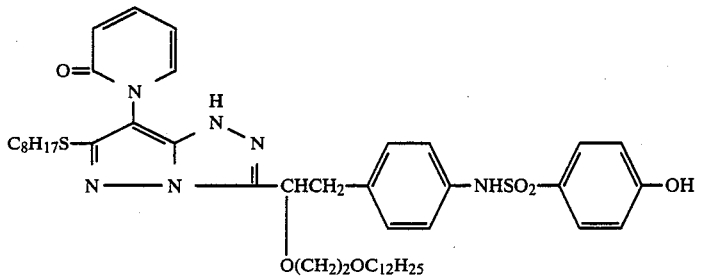
P-149
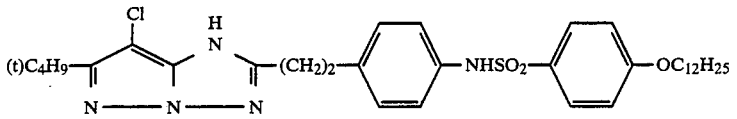
P-150
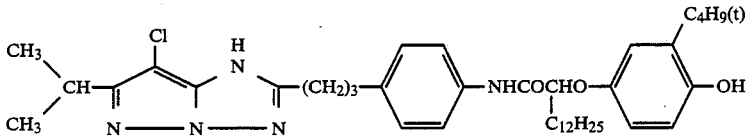
P-151
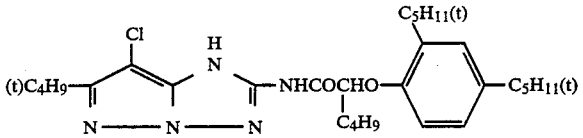
P-152
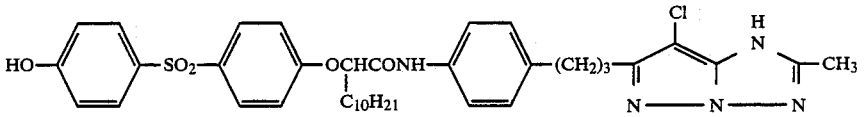
P-153
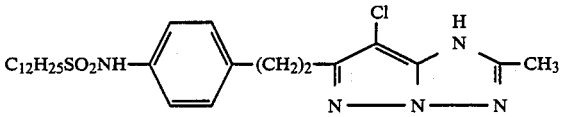
P-154
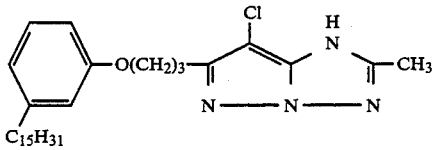
P-155
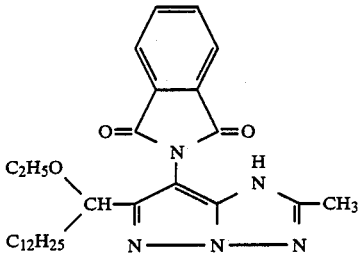
P-156
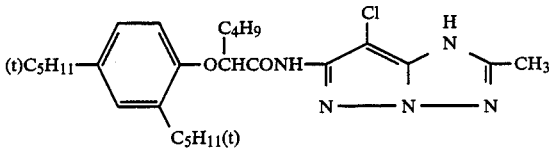

-continued
P-157
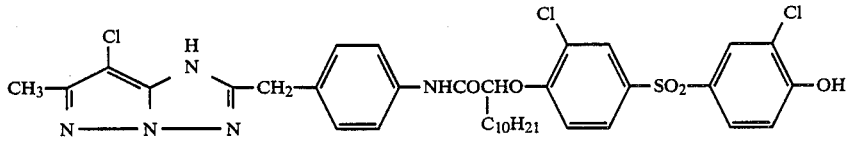
P-158
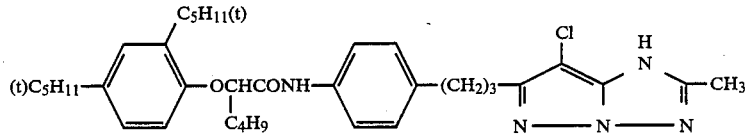
P-159
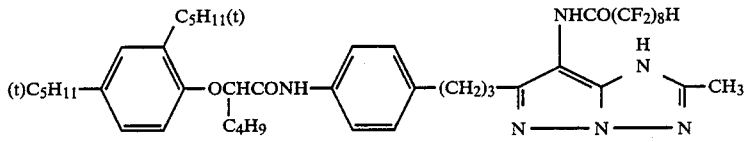
P-160
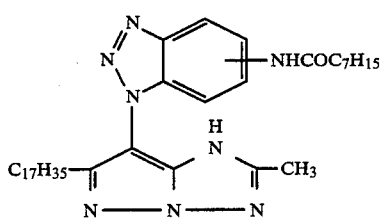
P-161
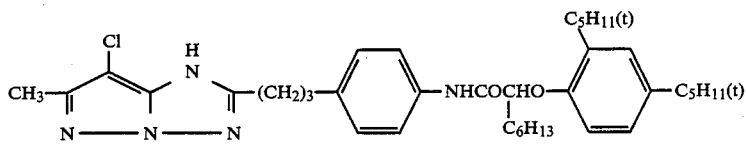
P-162
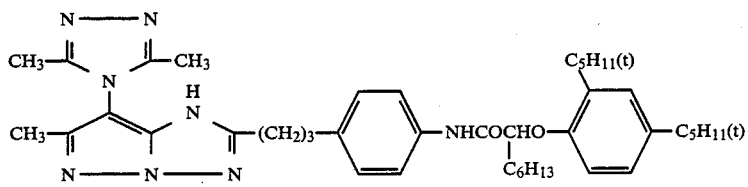
P-163
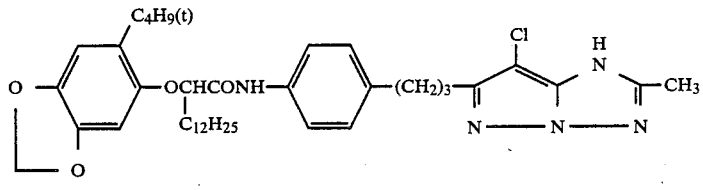
P-164
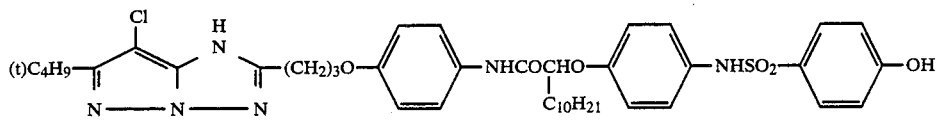
P-165
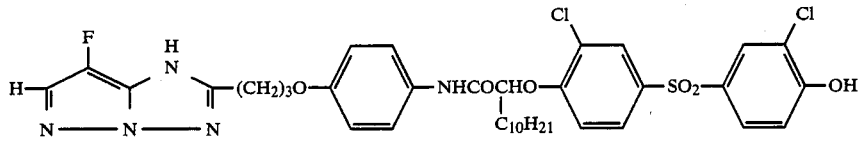
P-166
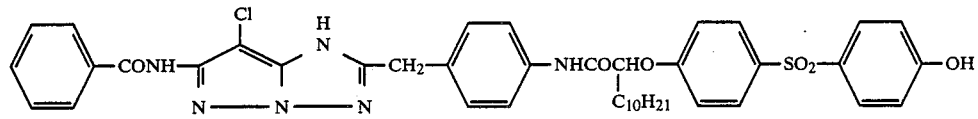

-continued
P-167
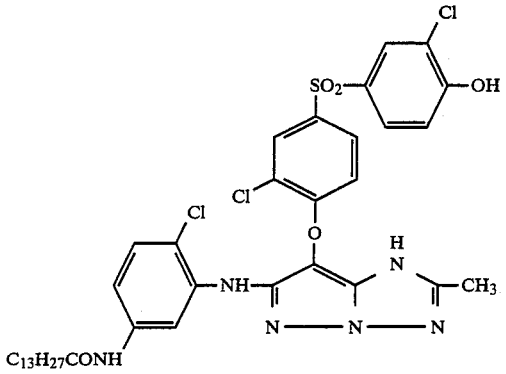
P-168
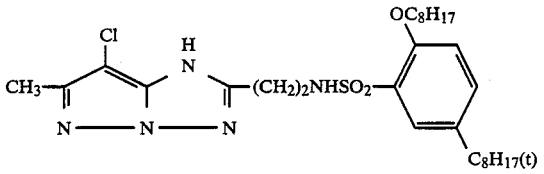
P-169
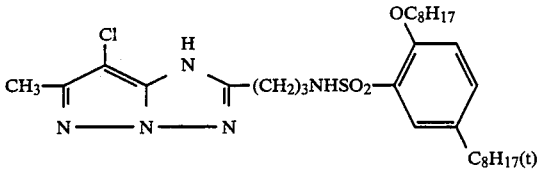
P-170
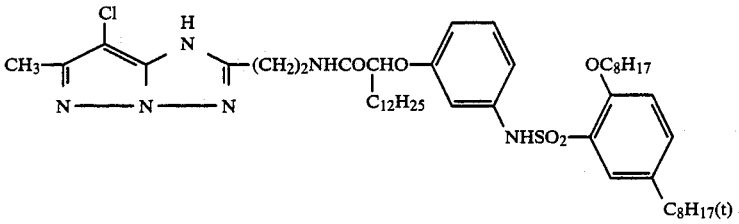
P-171
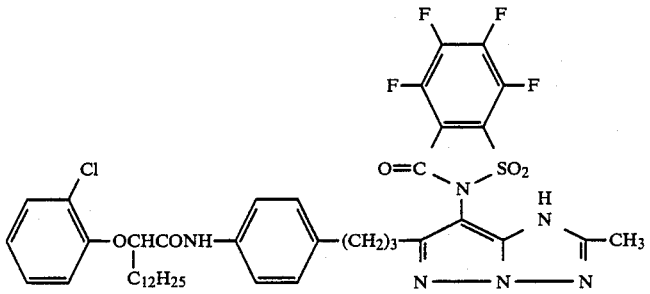
P-172
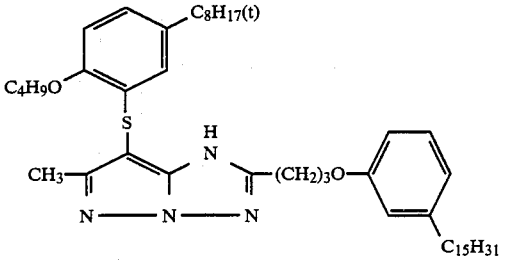

-continued
P-173
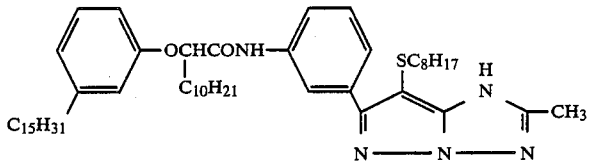
P-174
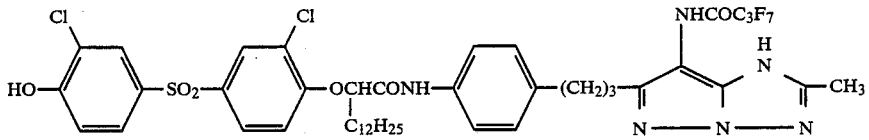
P-175
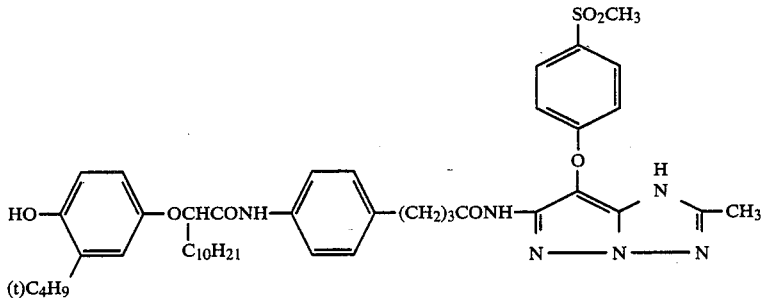
P-176
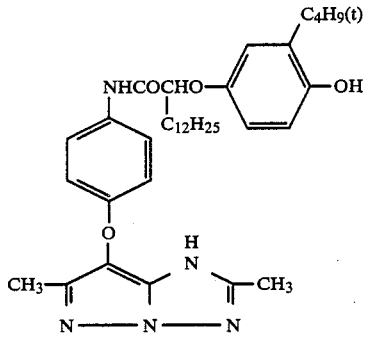
P-177
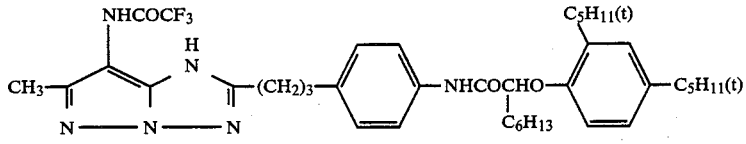
P-178
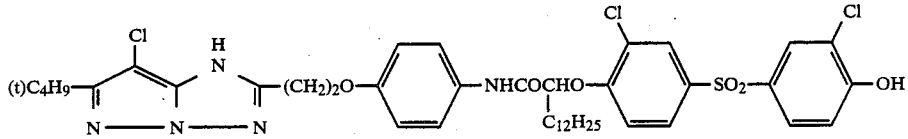
P-179
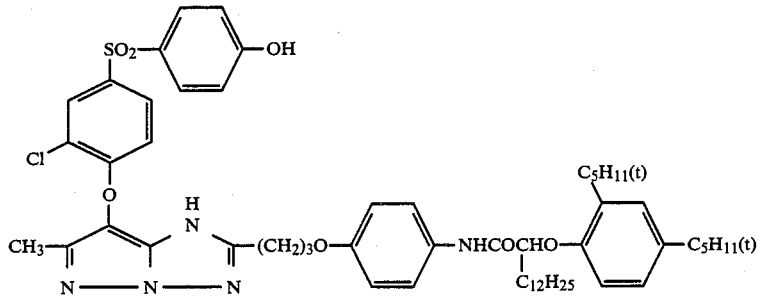

-continued
P-180
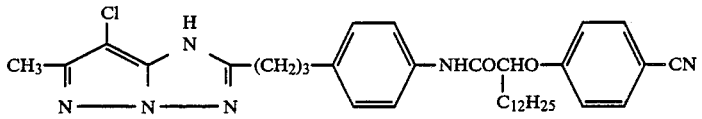
P-181
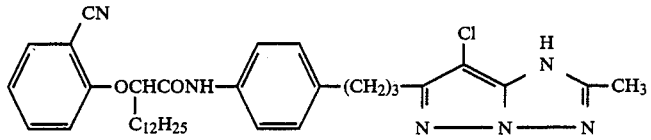
P-182
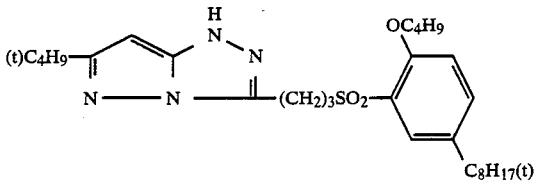
P-183
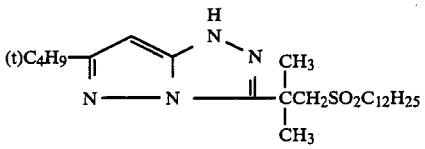
P-184
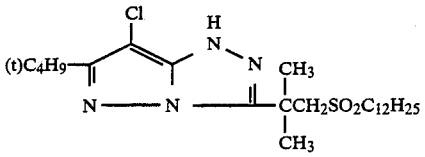
P-185
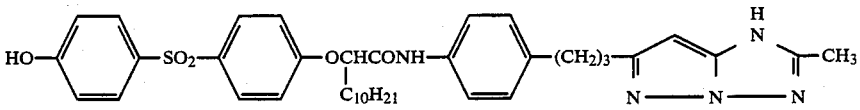
P-186
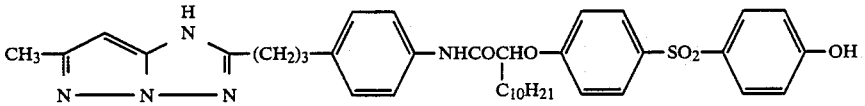
P-187
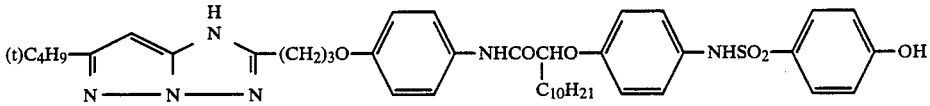
P-188
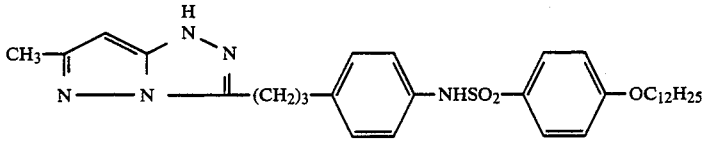
P-189
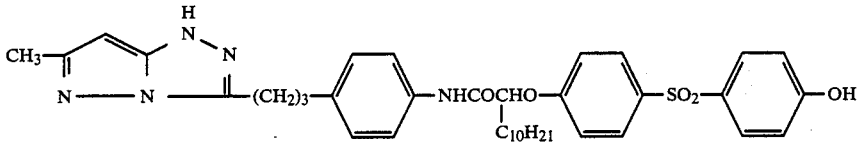
P-190
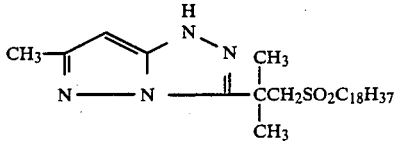

-continued

P-191

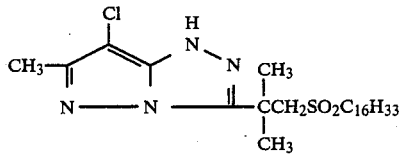

P-192

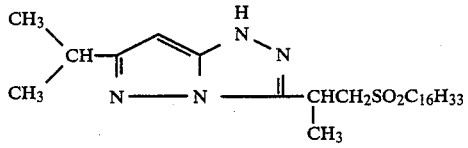

P-193

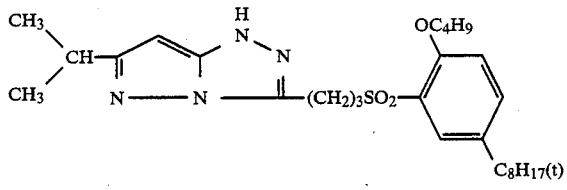

P-194

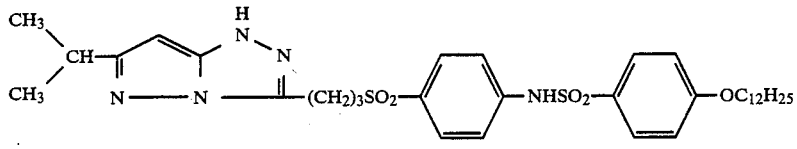

P-195

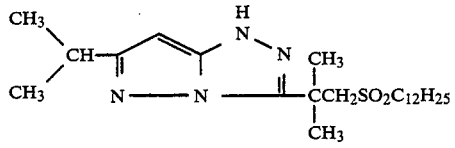

P-196

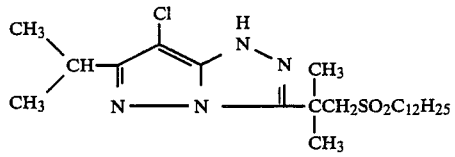

These couplers were synthesized by reference to Journal of the Chemical Society, Perkin I (1977), pages 2047 to 2052, U.S. Pat. No. 3,725,067 and Unexamined Published Japanese Patent Application Nos. 99437/1984, 42045/1983, 162548/1984, 171956/1984, 33552/1985 and 43659/1985.

The above-described magenta coupler may be incorporated in the photographic layers by the method described in U.S. Pat. No. 2,322,027 or the like. For example, one or more of the magenta couplers that are included within the scope of the present invention are dissolved in a high-boiling point organic solvent having a boiling point not lower than 175° C. (e.g., dibutyl phthalate, dioctyl phthalate, triphenyl phosphate, tricresyl phosphate, phenoxyethanol, diethyleneglycolmonophenylether, diethoxyethylphthalate, diethyllaurylamide or dibutyllaurylamide) or in a low-boiling point solvent (e.g., butyl acetate, methanol, ethanol, butanol, aceton, β-ethoxyethylacetate, methoxytriglycolacetate, dioxane or fluoride alcohol) or in a mixture thereof; the resulting solution is mixed with an aqueous gelatin solution containing a surfactant; the mixture is agitated in a high-speed rotary mixer or colloid mill so as to prepare a dispersion of the couplers; the resulting dispersion is directly added to an emulsion. Alternatively, the coupler dispersion is set, shredded, washed with water and added to an emulsion. If the magenta couplers of the present invention are alkali-soluble, they may be added by so-called Fischer's dispersion method.

The magenta couplers of the present invention may be used alone or in combination. Further they may be used in combination with any other type of magenta coupler.

The magenta coupler of the present invention may be incorporated in any photographic layers. It is preferable to incorporate the couplers of the present invention in at least one silver halide emulsion layer.

The coupler of the present invention is usually incorporated in an amount within the range of $1\times10^{-3}$ mole to 1 mole, preferably $1\times10^{-2}$ mole to $8\times10^{-1}$ mole, per mole of silver halide.

A preferable example of the means for forming an unsharp positive image is an unsharp positive image forming compound (hereinafter referred to simply as a positive compound) that is combined with a color negative-image forming silver halide emulsion layer containing a non-diffusible coupler.

A preferable example of the positive compound is a compound of low diffusibility that is either a chromatic compound having a predominant absorption in the wavelength region where the dye formed by the non-diffusible coupler as a result of reaction with the oxidation product of a color developing agent (said dye is hereinafter referred to as a color-forming dye) has a predominant absorption, or a precursor of that chromatic compound (i.e, a compound which discolors to said chromatic compound during development and subsequent processing and which, when reacted with the oxidation product of a developing agent, is achromatized or produces a non-diffusible dye that has a predominant absorption in the wavelength region where the color-forming dye has a predominant absorption) (both said chromatic compound and precursor thereof are hereinafter collectively referred to as a positive compound of low diffusibility).

Another preferable example of the positive compound is a non-diffusible compound that is either a chromatic compound having a predominant absorption in the wavelength region where the color-forming dye has a predominant absorption or a compound that discolors to said chromatic compound during development and subsequent processing and which is achromatized as a result of reaction with the oxidation product of a developing agent (the two compounds are hereinafter collectively referred to as a non-diffusible positive compound).

The positive compound of low diffusibility is hereunder described in detail. The term "low diffusibility" means that the compound diffuses more than the non-diffusible coupler with which it is combined during the process of image forming on a photographic material, particularly in the development step, but that at least 30 wt % of the compound added will remain in the photographic material after completion of the processing.

The degree of discoloration is preferably at least 10 nm in terms of a change in the wavelength for maximum absorption. A preferable example of the mechanism by which such discoloration occurs is a change in color that results from hydrolysis of the positive compound.

The term "achromatization" means that no chromatic compound is produced or that any chromatic compound that forms is lost from the photographic material by, for example, flowing out of said material during development and subsequent processing so that when the process of image forming has been completed, the chromatic compound will not remain in the photographic material in an amount that will do harm to the formation of an unsharp positive image.

The above-described achromatizable positive compound of low diffusibility reacts with the oxidation product of a color developing agent to become achromatized in areas where a color image is produced as a result of reaction between the developing agent and a non-diffusible coupler. In areas where no color image is formed by the non-diffusible coupler, this positive compound of low diffusibility remains unreacted or it undergoes a change in color. As a result, the color image formed by the non-diffusible coupler is complementary to the color image produced by the achromatizable positive compound of low diffusibility, that is, the former produces a negative image whereas the latter forms a positive image. Furthermore, this compound has low diffusibility and therefore is capable of forming an unsharp and positive image.

The other type of the positive compound of low diffusibility is of the non-diffusible dye forming type which reacts with the oxidation product of a developing agent to produce a non-diffusible dye that has a predominant absorption in the wavelength region where the color-forming dye has a predominant absorption. This non-diffusible dye forming type positive compound of low diffusibility remains unreacted or undergoes a change in color in areas where no color image is formed by the non-diffusible coupler. As a result, the color image formed by the non-diffusible coupler is complementary to the color image produced by the unreacted or discolored positive compound of low diffusibility, that is the former produces a negative image if the latter forms a positive image. Furthermore, this compound has low diffusibility and therefore is capable of forming an unsharp and positive image.

In addition to forming an unsharp positive image, the non-diffusible dye forming type positive compound of low diffusibility reacts with the oxidation product of a developing agent and produces, as its name implies, a non-diffusible dye that has a predominant absorption in the wavelength range where the color-forming dye has a predominant absorption. The produced non-diffusible dye forms a color image in cooperation with the non-diffusible dye that has been produced as a result of reaction between the non-diffusible coupler and the oxidation product of a color developing agent.

As mentioned above, the non-diffusible dye forming type positive compound of low diffusibility produces both an unsharp positive image and a negative image that is formed of the non-diffusible dye. Therefore, the two images overlap each other and it may appear macroscopically that no change in density has occurred. However, at edge portions (i.e, boundaries where the intensity of illumination changes) the difference in diffusibility between the positive compound and the non-diffusible dye it has produced causes a microscopic change in density (i.e, edge effect). Consequently, the positive compound of low diffusibility specified above is an effective means for producing an unsharp positive image.

An example of the achromatizable positive compound of low diffusibility may be represented by the following general formula (I):

$$\text{A—Link—B} \qquad \text{(I)}$$

where A is a residual organic group that is capable of reacting with the oxidation product of a developing agent to release the portion of Link—B in proportion to the amount of said oxidation product; Link is a group for linking A and B; and B is a residual organic group.

The compound of formula (I) is either chromatic or capable of discoloration and diffuses slightly through a photographic material during development and subsequent processing. If a chromatic compound is to be produced from A and Link—B as a result of reaction with the oxidation product of a developing agent, the compound of formula (I) is provided with substituents that provide a balance between hydrophilicity and oleophilicity such that the chromatic reaction product will thereafter flow out of the photographic material.

Examples of A in formula (I) are (i) the residual group of a coupler that couples with the oxidation product of a color developing agent to form a chromatic or colorless product, and (ii) a component that cross-oxidizes with the oxidation product of a developing agent. Specific examples of (i) are the residual groups of phenols, naphthols, 5-pyrazolones, pyrazolotriazoles, pyrazolobenzimidazoles, indazolones, acylacetanilides, $RCOCH_3$ (where R may be an alkyl, aryl or heterocyclic group),

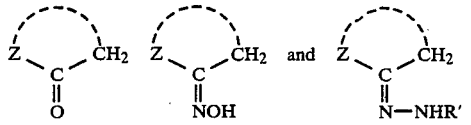

(where Z may be the atomic group necessary to complete a 5- to 8-membered saturated or unsaturated alicyclic or heterocyclic ring, and R′ is a residual aryl group). Examples of (ii) include the residual groups of phenols, naphthols, indanones, indoles and hydroquinones, each being capable of releasing Link—B in the form of $B—SO_2NH^{\ominus}$ as a result of alkali cleavage following oxidation, as well as the residual groups of phenols which, after being oxidized, are subjected to intranolecular cyclization to release Link—B in the form of $B—SO_2^{\ominus}$ (for details of this second type of residual groups, see U.S. Pat. Nos. 3,443,939, 3,443,940 and 3,443,941).

Illustrative examples of Link include

—N=N—, —O—, —S—, —NH—$SO_2$—, —$SO_2$NH—,

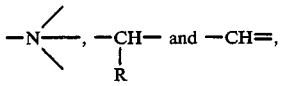

where

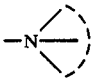

signifies a residual nitrogenous heterocyclic group which may be exemplified by succinimidoyl, phthalimidoyl, pyridoyl, imidazolyl, imidazolonyl, benzimidazolyl, hydantoyl, thiohydantoyl, triazolyl, benzotriazolyl, urazolyl, 2,4-dioxyoxazolyl, 2,4-dioxothiazolyl, thiadiazolyl, and tetrazolyl, and R may be an optionally substituted alkyl or aryl group.

Examples of B are aryl and heterocyclic groups if Link is a chromophore such as —N=N— or —CH=, and B is preferably a dye residue or a residual organic group having an auxochrome. If link is not a chromophore, B is preferably the residue of a dye such as azo, anthraquinone, azomethine, indophenol or indoaniline.

Having the structure shown above, the compound of formula (I) is chromatic or capable of discoloration at portion B or in the entirety of A—Link—B.

In order to provide the compound of formula (I) not only with the ability to diffuse slightly during development but also with the diffusibility that is necessary to permit any of the unwanted reaction product to flow out of the system, an alkali soluble group such as a carboxyl, sulfo, hydroxyl or sulfamoyl group and a group such as an alkyl group that affords reduced diffusibility may be appropriately introduced into the compound of formula (I) so that it will achieve a balance in diffusibility between and after reaction with the oxidation product of a developing agent.

The compounds of the present invention may be classified as follows according to their properties:

CLASS I: color-forming dye producing type

In the compounds of this class, the portion A in formula (I) is the residue of a coupler and the Link portion is bound to the active site of the coupler, provided that it may be bound at a site adjacent the active site if it is —$NHSO_2$— (in this case, the nitrogen atom is bound to the Coup portion). The compounds preferably have an alkali soluble group and an alkyl group which may have no more than 16 carbon atoms so that they will be able to diffuse through the photographic material. If the portion A is to couple with the oxidation product of a color developing agent to form a chromatic compound, it is preferable that the compound of CLASS 1 has an alkali soluble group in the portion A or that an alkali soluble group is incorporated in the color developing agent used in order to allow the resulting chromatic compound to flow out of the system during processing. In the case where portion B has formed a dye, the portion B preferably has an alkali soluble group such that it will flow out of the system after reaction with the oxidation product of the coupling agent.

In exposed areas, the portion A forms a negative color dye image but flows out of the system and, if the portion B is a dye, it also flows out of the system after leaving the portion A. Therefore, a positive image is produced by the compound of formula (I) remaining in unexposed areas or after it has undergone a change in color. In addition, this compound having low diffusibility migrates slightly through a layer during development and subsequent processing so as to form an unsharp positive image. The following are two preferable types of the compounds of CLASS I.

(Type A): colored coupler type of the following general formula (II)

$$\text{Coup—Link}_2\text{—Ar} \qquad \text{(II)}$$

The Coup— in formula (II) is the residual group of a coupler which preferably has an alkali soluble group and the dye that has formed as a result of color developing reaction will flow out of the photographic material.

The Ar in formula (II) is preferably an aryl group such as a benzene or naphthalene group which may optionally have a substituent, or a heterocyclic group such as an isoxazole group which may optionally have a substituent. A group capable of partial prevention of diffusion is preferably incorporated in the compound of formula (II) so as to enable it to migrate slightly through the photographic material and it is particularly preferable that such a group is present in the Ar portion. The $Link_2$ in formula (II) is —N=N— or —CH=.

Some of the compounds of formula (II) are disclosed as colored couplers in prior art references such as U.S. Pat. Nos. 2,449,969, 2,668,538, 2,706,684, 2,808,329 and 3,005,712, as well as Belgian Patent No. 570,271 and Japanese Patent Publication No. 32461/1969. However, the present invention differs entirely from the teachings of these prior art references not only with respect to the manner in which the compounds are used but also in terms of the object of their use. In addition, the advantages obtained in the present invention are quite dissimilar to those attained in the prior art techniques. In the prior art references listed above, the dye formed from the Coup (i.e., coupler) portion in formula (II) has a predominant absorption in the spectral range where the predominant absorption for the dye-image providing color occurs and in principle said dye should be immobile. On the other hand, the color of the compound of formula (II) is in a spectral range where an unwanted absorption occurs. It is essential for the purposes of the present invention that the dye resulting from the Coup portion be allowed to flow out of the system and the color of the compound of formula (II), whether it retains its own color or has undergone a change in color, is in a spectral range where the predominant absorption by the dye-image forming layer occurs. In other words, the spectral range of sensitivity of a silver halide layer combined with the compound of the present invention is complementary to the color of the compound if it is used in a conventional negative photographic material. Stated more specifically with reference to a green-sensitive negative layer, the colored couplers disclosed in the prior art references require the use of a yellow-colored compound in that layer whereas the present invention employs a magenta-colored compound or a compound whose color will change to magenta.

(Type B): active-site substituted type of the following general formula (III)

$$\text{Coup—Link}_3\text{—Dye} \qquad \text{(III)}$$

The Coup in this formula has the same meaning as defined for formula (II). The $Link_3$ has the same meaning as Link in formula (I) and may be exemplified by the groups that are given for said formula; preferably, $Link_3$ is a group that provides an alkali soluble group after coupling reaction, as exemplified by, for example, —O—, —$SO_2$—NH— or —$NHSO_2$—. The Dye in formula (III) signifies a dye portion or a dye precursor portion. The Dye desirably has an alkali soluble group but this is not essential if the specific type of $Link_3$ so permits.

A group capable of partial prevention of diffusion is preferably incorporated in the compound of formula (III) so that it is provided with the ability to diffuse slightly in the photographic material. Such a group, if it is used at all, is preferably attached to whichever the more diffusible of the color-forming dye and $Link_3$—Dye. Compounds of Type B are disclosed in several prior art references such as U.S. Pat. Nos. 3,227,550 and 3,476,563 but again the compounds shown in these references are used in an entirely different manner than in the present invention and, hence, are outside the scope of the latter. Stated more specifically, some of these compounds are used for achieving color correction as by colored couplers within the category of which the compounds of Type A are included, while others are used in such a manner that the Dye portion that leaves the compound after diffusion transfer is utilized to form an image.

A class of compounds that will not produce a color image after color forming reaction are described hereinafter.

CLASS II: colorless coupling reaction product forming type

The portion A in formula (I) by which the compounds of this class may be represented will enter into the same coupling reaction as is effected by the compounds of CLASS I but the reaction product is colorless and may remain intact in a layer after the coupling reaction.

(Type C): Weiss coupler type of the following general formula (IV)

$$\text{Wcoup—Link}_4\text{—Dye} \qquad \text{(IV)}$$

Examples of Wcoup include $R_2COCH_2$— (where $R_2$ is an alkyl, aryl or heterocyclic group having an alkyl with no more than 16 carbon atoms),

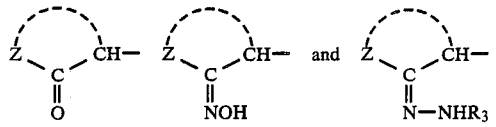

(where Z signifies the atomic group necessary to complete a 5- to 8-membered alicyclic ring, fused ring or heterocyclic ring, and $R_3$ is a residual aryl group).

The $Link_4$ in formula (IV) denotes —O—, —S— or —$SO_2$. The Dye is a residual dye group or a precursor portion thereof and preferably has an alkali soluble group, and $Link_4$—Dye will flow out of the layer in which a compound of (IV) has been incorporated.

A group capable of partial prevention of diffusion is preferably incorporated in the compound of formula (IV) so that it permits this compound to diffuse slightly in a layer in cooperation of an alkali soluble group that may be present in the Dye portion. It is particularly preferable that such a group is present in the W coup portion.

CLASS III: redox reaction type

Compounds of this class will not enter into a coupling reaction as is effected by the compounds of CLASS I or II. Instead, they will react with the oxidation product of a developing agent to form a quinone or quinoimide compound and it is not until this reaction product reacts with the alkali in a developer or enters into an intramolecular cyclization reaction that a dye is released from the compound of CLASS III.

(Type D): DRR compound type of the following general formula (V)

$$\text{FUN—Link}_5\text{—Dye} \qquad \text{(V)}$$

where FUN signifies a redox nucleus which is the residual group of 2-, 3- or 4-phenol, 4-$\alpha$-naphthol, 1-$\beta$-naphthol, 2-hydroquinone, 3-indole or 4-pyrazolone-5; $Link_5$ may be exemplified by —$NHSO_2$— (the nitrogen atom being bound to the FUN portion), —O—, —$SO_2$— or —S—; and Dye is a residual dye group or a precursor portion thereof and preferably has an alkali soluble group.

A group that is capable of partial prevention of diffusion in cooperation with an alkali soluble group that may be present in the Dye portion may be employed in the compound of formula (V) so that it will diffuse slightly in the layer in which it is incorporated. If such a group is used at all, it is preferably attached to the FUN portion.

As already mentioned, the non-diffusible dye forming type positive compound of low diffusibility is either a dye by itself or a precursor thereof and, in addition, it reacts with the oxidation product of a color developing agent. The compound may be of the type that forms a non-coupler dye portion as a result of reaction with the oxidation of a developing agent; alternatively, it may be of such a type that no dye portion other than the already present coupler portion will form but that the latter or a precursor portion thereof will remain intact as the dye portion of the non-diffusible dye after development and subsequent processing.

The non-diffusible dye forming type positive compounds of low diffusibility may be classified as follows according to their function.

Type I: A compound which, upon coupling with the oxidation product of a color developing agent, forms an additional dye portion that is substantially the same in color as the already present dye portion or the one that is formed by a precursor portion thereof during development and subsequent processing, and which becomes non-diffusible (this compound may be referred to as a dye forming type compound).

Compounds of this type may be subdivided as follows.

Type I-1: A compound which, upon reaction with the oxidation product of a color developing agent, is achromatized in either the already present dye portion or a precursor portion thereof and which forms a dye portion that is substantially the same in color as said already present dye portion or the one that is to be possessed by a precursor portion thereof after development and subsequent processing, and which becomes non-diffusible.

Type I-2: A compound which, upon reaction with the oxidation product of a color developing agent, is not achromatized in either the already present dye portion or a precursor portion thereof and which additionally forms a dye portion that is substantially the same in color as said already present dye portion or the one that is to be possessed by a precursor portion thereof after development, and which becomes non-diffusible. Therefore, as a result of coupling with the oxidation product of a developing agent, this type of compound will produce a non-diffusible dye that contains a newly formed dye portion in addition to the already present dye portion or the one that is derived from a precursor thereof (this compound may be referred to as a superposition type compound).

Type II: A compound which, upon reaction with the oxidation product of a color developing agent, is not achromatized in either the already present dye portion or a precursor portion thereof and which becomes non-diffusible without forming any additional dye portion.

Type III: A compound which becomes non-diffusible upon cross-oxidation with the oxidation product of a color developing agent.

The individual types of these compounds are described below in further detail.

Compounds of Type I-1 may be represented by the following general formula (I-1):

$$A_1—Link_1—B_1 \quad \text{(I-1)}$$

where $A_1$ is a residual organic group that is capable of reacting with the oxidation product of a developing agent to release the portion of $Link_1—B_1$ in proportion to the amount of said oxidation product and which is also capable of forming a coupling dye; $Link_1$ is a group for linking $A_1$ and $B_1$; and $B_1$ is a residual organic group.

Specific examples of $A_1$ are the residual groups of such organic compounds as phenols, naphthols, 5-pyrazolones, pyrazolotriazoles, pyrazolotetrazoles, pyrazolobenzimidazoles, indazolones, and acylacetanilides.

Examples of $Link_1$ include

—N=N—, —O—, —S—, —$SO_2$ and —N 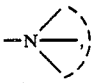 , where —N 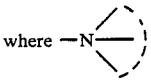

signifies a residual nitrogenous heterocyclic group which may be exemplified by succinimidoyl, phthalimidoyl, pyridoyl, imidazolyl, imidazolonyl, benzimidazolyl, hydantoyl, thiohydantoyl, triazolyl, benzotriazolyl, urazolyl, 2,4-dioxyoxazolyl, 2,4-dioxothiazolyl, thiadiazolyl, and tetrazolyl.

Preferable examples of $B_1$ are aryl and heterocyclic groups if $Link_1$ is a chromophore such as —N=N—. If $Link_1$ is not a chromophore, $B_1$ is preferably the residue of a dye such as azo, anthraquinone, azomethine, indophenol or indoaniline, or a precursor thereof.

Having the structure shown above, the compound of formula (I-1) provides a dye or a precursor thereof at $B_1$ or from the entirety of $A_1—Link_1—B_1$.

In order to provide the compound of formula (I-1) not only with the ability to diffuse slightly during development and subsequent processing but also with the diffusibility that is necessary to allow any of the dye that is derived from $B_1$ (if this is a dye or a precursor thereof) to flow out of the system and in order to render non-diffusible the dye that forms upon coupling reaction, an alkali soluble group such as a carboxyl, sulfo, hydroxyl or sulfamoyl group and a group such as an alkyl group that affords reduced diffusibility may be appropriately introduced into the compound of formula (I-1) so that it will achieve a balance in diffusibility between and after reaction with the oxidation product of a developing agent.

Compounds of Type I-2 may be represented by the following general formula (I-2):

$$D_1—A_2 \quad \text{(I-2)}$$

where $D_1$ is a dye portion or a precursor portion thereof; $A_2$ is a residual organic group that is capable of forming a dye by coupling with the oxidation product of a developing agent, provided that $D_1$ will not leave $A_2$ upon coupling.

Specific examples of $A_2$ may be the same as those given for $A_1$. Examples of $D_1$ include the residual groups of dyes and precursors thereof that are given for $B_1$. In formula (I-2), $A_2$ may have a group at the coupling site that is capable of leaving upon coupling. Such leaving groups may be dyes or precursors thereof but it should be emphasized that other kinds of leaving group may be employed.

In order to provide the compound of formula (I-2) with the ability to diffuse slightly during development and subsequent processing and to render non-diffusible the dye that forms as a result of coupling between this compound and the oxidation product of a developing agent, an alkali soluble group such as a carboxyl, sulfo, hydroxyl or sulfamoyl group and a group such as an alkyl group that affords reduced diffusibility may be appropriately introduced into the compound of formula (I-2) so that it will have a balance in diffusibility between and after the coupling reaction. For instance, an alkali soluble group that is capable of leaving upon coupling reaction or a group having such an alkali soluble group may be bound to the coupling site of $A_2$.

Compounds of Type II may be represented by the following general formula (II-1):

$$W—D_2 \quad \text{(II-1)}$$

where $D_2$ has the same meaning as $D_1$ in formula (I-2) and may be exemplified by the same dye portion or precursor thereof as given for $D_1$; and W is the residual group of a compound that couples with the oxidation product of a developing agent but which will not form any dye upon this coupling reaction.

Examples of W include those coupler residues such as 5-pyrazolone nucleus and 8-diketomethylene group which are substituted at the coupling site with groups (e.g. alkyl groups such as methyl and butyl) that will not cause any of the reactions (e.g. oxidation and elimination) that are necessary for conversion to dye after coupling, as well as the residual groups of such compounds as bisalkylcarbamoyl-aryloxymethane compounds and bisalkylcarbamoyl-arylthiomethane compounds.

In formula (II-1), $D_2$ may be present at the coupling site of W as part of the group that will not cause any reaction for dye conversion; alternatively, $D_2$ may be bound to a site other than the coupling site of W.

Compounds of Type III may be represented by the following general formula (III-1):

$$Fun—D_3 \quad \text{(III-1)}$$

where $D_3$ has the same meaning as $D_1$ in formula (I-2) and may be exemplified by the same dye portion or precursor thereof as given for $D_1$; Fun is an organic group that has the capability of reacting with the oxidation product of a color developing agent to render the compound of formula (III-1) non-diffusible and may be exemplified by a group having a hydroquinone nucleus or a catechol group.

Having described the positive compound of low diffusibility, we now explain the non-diffusible positive compound in detail. The terms "achromatization" and "discoloration" as used hereinafter have the same meanings as defined in connection with the positive compound of low diffusibility.

In areas where a color image forms as a result of reaction between the oxidation product of a color developing agent and a non-diffusible coupler, the non-diffusible positive compound also reacts with said oxidation product to either become colorless or produce a compound that will later dissolve out of the system. In areas where no color image is formed by the non-diffusible coupler, the non-diffusible positive compound remains unreacted or it undergoes discoloration (a change in color). As a result, the non-diffusible coupler and the non-diffusible positive compound will form color images that are complementary to each other; that is, if the former produces a negative image, the latter will form a positive image. In addition, since the oxidation product of a developing agent diffuses from the layer containing the non-diffusible coupler to the layer containing the non-diffusible positive compound, the latter compound will form an unsharp and positive image.

An example of the non-diffusible positive compound may be represented by the following general formula (A-1):

$$A_3—Link—B_3 \quad \text{(A-1)}$$

where $A_3$ is a residual organic group that is capable of reacting with the oxidation product of a developing agent to render the portion of Link—$B_3$ colorless or dissolvable in proportion to the amount of said oxidation product; Link is a group for linking $A_3$ and $B_3$; and $B_3$ is a residual organic group.

The compound of formula (A-1) is either chromatic or undergoes discoloration and is not diffusible through a photographic material during development and subsequent processing. If a compound whose color is undesirable for the purpose of image forming is to be produced from $A_3$ and Link—$B_3$ as a result of reaction with the oxidation product of a developing agent, the compound of formula (A-1) is provided with substituents that provide a balance between hydrophilicity and oleophilicity such that said reaction product will thereafter dissolve out of the color-forming system in the photographic material.

Examples of $A_3$ in formula (A-1) are (i) the residual group of a coupler that couples with the oxidation product of a color developing agent to form a chromatic or colorless product, and (ii) a component that cross-oxidizes with the oxidation product of a developing agent. Specific examples of (i) are the residual groups of phenols, naphthols, 5-pyrazolones, pyrazolotriazoles, pyrazolobenzimidazoles, indazolones, acylacetanilides, $RCOCH_3$ (where R may be an alkyl, aryl or heterocyclic group),

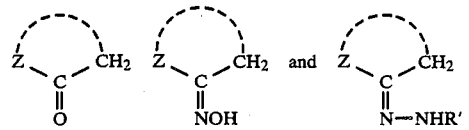

(where Z may be the atomic group necessary to complete a 5- to 8-membered saturated or unsaturated alicyclic or heterocyclic ring, and R′ is a residual aryl group). Examples of (ii) include the residual groups of phenols, naphthols, indanones and indoles, each being capable of releasing Link—$B_3$ in the form of $B_3$—$SO_2NH^{\ominus}$ as a result of alkali cleavage following oxidation, as well as the residual groups of hydroquinones that release Link—$B_3$ in the form of $B_3$—$O^{\ominus}$, $B_3$—$S^{\ominus}$ or $B_3$—$SO_2^{\ominus}$ as a result of alkali cleavage following oxidation, and the residual groups of phenols which, after being oxidized, are subjected to intramolecular cyclization to release Link—$B_3$ in the form of $B_3$—$SO_2^{\ominus}$ (for details of this third type of residual groups, see U.S. Pat. Nos. 3,443,939, 3,443,940 and 3,443,941).

Illustrative examples of Link include $$—N=N—,\ —O—,\ —S—,\ —SO_2—,\ —NH—SO_2—,$$

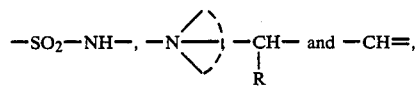

where

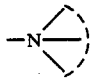

signifies a residual nitrogenous heterocyclic group which may be exemplified by succinimidoyl, phthalimidoyl, pyridoyl, imidazolyl, imidazolonyl, benzimidazolyl, hydantoyl, thiohydantoyl, triazolyl, benzotriazolyl, urazolyl, 2,4-dioxyorazolyl, 2,4-di-oxothiazolyl, thiazolyl and tetrazolyl, and R may be an optionally substituted alkyl or aryl group.

Examples of $B_3$ are aryl and heterocyclic groups if Link is a chromophore such as —N=N— or —CH=, and $B_3$ is preferably a dye residue or a residual organic group having an auxochrome. If Link is not a chromophore, $B_3$ is preferably the residue of a dye such as azo, anthraquinone, azomethine, indophenol or indoaniline, or a precursor thereof.

Having the structure shown above, the compound of formula (A-1) is chromatic or capable of discoloration at portion $B_3$ or in the entirety of A—Link—$B_3$.

In order to provide the compound of formula (A-1) not only with the ability to diffuse slightly during development but also with the diffusibility that is necessary to permit any of the unwanted reaction product to flow out of the system, an alkali soluble group such as a carboxyl, sulfo, hydroxyl or sulfamoyl group and a group such as an alkyl group that affords reduced diffusibility may be appropriately introduced into the compound of formula (A-1) so that it will achieve a balance in diffusibility between and after reaction with the oxidation product of a developing agent.

The compounds of the present invention may be classified as follows according to their properties:

CLASS I: color-forming dye producing type

In the compounds of this class, the portion $A_3$ in formula (A-1) is the residue of a coupler and the Link portion is bound to the active site of the coupler. If the portion $A_3$ is a phenolic or naphtholic residue and while Link is —$NHSO_2$— (the nitrogen atom being bound to the Coup portion), Link may be bound at a site adjacent the active site of the coupler. The compounds preferably have a ballast group, for example, an alkyl group having at least 16 carbon atoms so that they will be non-diffusible in the photographic material. If the color dye that is formed by $A_3$ as a result of coupling with the oxidation product of a color developing agent is unsuitable for the purpose of image forming, it is preferable that the compound of CLASS I has an alkali soluble group in the portion $A_3$ or that an alkali soluble group is incorporated in the color developing agent in order to allow the resulting color-forming dye to flow out of the system during processing. In the case the portion $B_3$ has formed a dye or a precursor thereof, the portion $R_3$ preferably has an alkali soluble group such that it will flow out of the system after reaction with the oxidation product of the coupling agent.

In exposed areas, the portion $A_3$ forms a negative color dye image but flows out of the system and, if the portion $B_3$ is a dye, it also flows out of the system after leaving the portion $A_3$. Therefore, a positive image is produced by the compound of formula (I) in unexposed areas or after it has undergone discoloration. In addition, the peripheral edge of this positive image has an unsharp positive image that is formed in the layer in which the compound of CLASS I is present during development or subsequent processing as a result of reaction with the oxidation product of a developing agent that has diffused from that layer. The following are two preferable types of the compounds of CLASS I.

(Type A):colored coupler type of the following general formula (A-2)

$$\text{Coup—Link}^2\text{—Ar} \qquad \text{(A-2)}$$

The Coup— in formula (A-2) is the residual group of a coupler which preferably has an alkali soluble group and the dye that has formed as a result of color developing reaction will dissolve out of the photographic material.

The Ar in formula (A-2) is preferably an aryl group such as a benzene or naphthalene group which may optionally have a substituent, or a heterocyclic group such as an isoxazole group which may optionally have a substituent. A diffusion-preventing group is preferably incorporated in the compound of formula (A-2) so as to enable it to become non-diffusible in the photographic material and it is particularly preferable that such a group is present in the Ar portion. The $Link^2$ in formula (A-2) is —N=N— or —CH=.

Some of the compounds of formula (A-2) are disclosed as colored couplers in prior art references such as U.S. Pat. Nos. 2,449,969, 2,688,538, 2,706,684, 2,808,329 and 3,005,712, as well as Japanese Patent Publication No. 32461/1969. However, the present invention differs entirely from the teachings of these prior art references not only with respect to the manner in which the compounds are used but also in terms of the object of their use. In addition, the advantages obtained in the present invention are quite dissimilar to those attained in the prior art techniques. In the prior art references listed above, the dye formed from the Coup (i.e., coupler) portion in formula (A-2) has a predominant absorption in the spectral range where the predominant absorption for the dye-image providing color occurs and in principle said dye should be immobile. On the other hand, the color of the compound of formula (A-2) is in a spectral range where an unwanted absorption occurs. It is essential for the purposes of the present invention that the dye resulting from the Coup portion be allowed to flow out of the system and the color of the compound of formula (A-2) is in a spectral range where the predominant absorption by the dye-image forming layer occurs. In other words, the spectral range of sensitivity of a silver halide layer combined with the compound of the present invention is complementary to the color of the compound if it is used in a conventional negative photographic material. Stated more specifically with reference to a green-sensitive negative layer, the colored couplers disclosed in the prior art references require the use of a yellow-colored compound in that layer whereas the present invention employs a magenta-colored compound or a compound whose color will change to magenta.

(Type B): active-site substituted type of the following general formula (A-3)

$$\text{Coup—Link}^3\text{—Dye} \qquad \text{(A-3)}$$

The Coup in this formula has the same meaning as defined for formula (A-2). The $Link^3$ has the same meaning as Link in formula (A-1) and may be exemplified by the groups that are given for said formula; preferably, $Link^3$ is a group that provides an alkali soluble group after coupling reaction, as exemplified by, for example, —O—, —$SO_2$—NH— or —$NHSO_2$—. The Dye in formula (A-3) signifies a dye portion or a dye precursor portion. The Dye desirably has an alkali soluble group but this is not essential if the specific type of $Link^3$ so permits.

Compounds of Type B are disclosed in several prior art references such as U.S. Pat. Nos. 3,227,550 and 3,476,563 but again the compounds shown in these references are used in an entirely different manner than in the present invention and, hence, are outside the scope of the latter. Stated more specifically, some of these compounds are used for achieving color correction as by colored couplers within the category of which the compounds of Type A are included, while others are used in such a manner that the Dye portion that leaves the compound after diffusion transfer is utilized to form an image.

A class of compounds that will not produce a color image after color forming reaction are described hereinafter.

CLASS II: colorless coupling reaction product forming type

The portion $A_3$ in formula (A-1) by which the compounds of this class may be represented will enter into the same coupling reaction as is effected by the compounds of CLASS I but the reaction product is colorless and may remain intact in a layer after the coupling reaction.

(Type C): Weiss coupler type of the following general formula (A-4)

$$\text{Wcoup—Link}^4\text{—Dye} \qquad \text{(A-4)}$$

Examples of Wcoup include $R_2COCH_2$— (where $R_2$ is an alkyl, aryl or heterocyclic group),

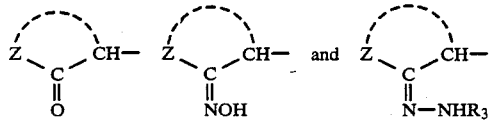

(where Z signifies the atomic group necessary to complete a 5- to 8-membered alicyclic ring, fused ring or heterocyclic ring, and $R_3$ is a residual aryl group). In order to render the compound of formula (A-4) non-diffusible, the Wcoup portion preferably has a diffusion-preventing group such as, for example, a group having at least 17 carbon atoms.

The $Link^4$ in formula (A-4) denotes —O—, —S— or —$SO_2$—. The Dye is a dye or a precursor residue thereof and preferably has an alkali soluble group, and $Link^4$—Dye will flow out of the layer in which a compound of (A-4) has been incorporated.

CLASS III: redox reaction type

Compounds of this class will not enter into a coupling reaction as is effected by the compounds of CLASS I or II. Instead, they will react with the oxidation product of a developing agent to form a quinone or quinoimide compound and it is not until this reaction product reacts with the alkali in a developer or enters into an intramolecular cyclization reaction that a dye is released from the compound of CLASS III.

(Type D): DRR compound type of the following general formula (A-5)

$$\text{FUN—Link}^5\text{—Dye} \qquad \text{(A-5)}$$

where FUN signifies a redox nucleus which is the residual group of 2-, 3- or 4-phenol, 4-$\alpha$-naphthol, 1-$\beta$-naphthol, 2-hydroquinone, 3-indole or 4-pyrazolone-5; $Link^5$ may be exemplified by —$NHSO_2$— (the nitrogen atom being bound to the FUN portion), —O—, —$SO_2$— or —S—; and Dye is a dye or a precursor residue thereof and preferably has an alkali soluble group. The compound of formula (A-5) preferably has a diffusion-preventing agent in the FUN portion so that it will not migrate through the layer in which it is incorporated.

The following are specific, but by no means limiting, examples of the positive compounds of the present invention.

U-1

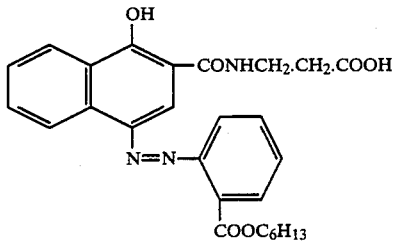

U-2

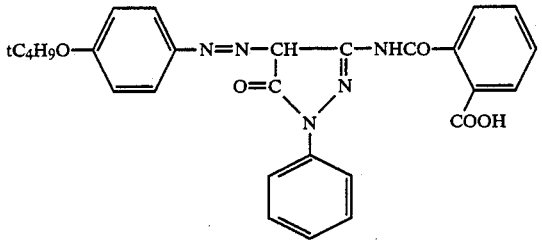

-continued
U-3
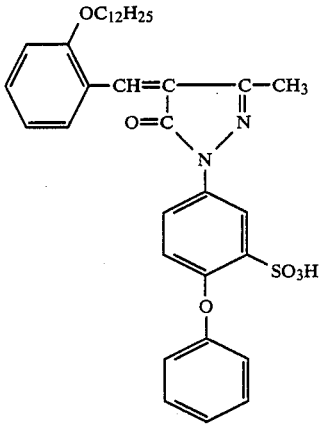
U-4
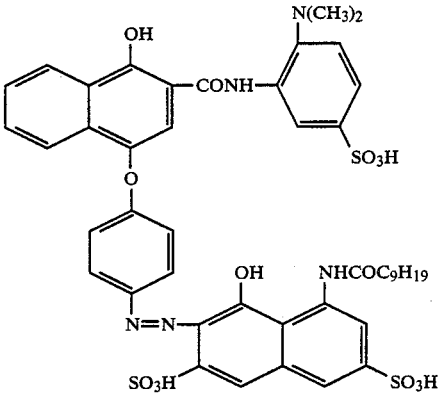
U-5
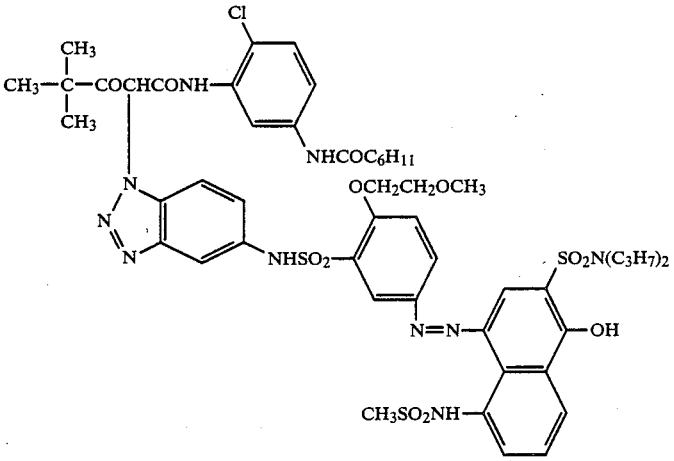
U-6
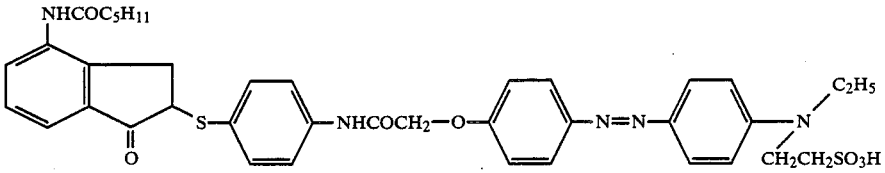

-continued
U-7
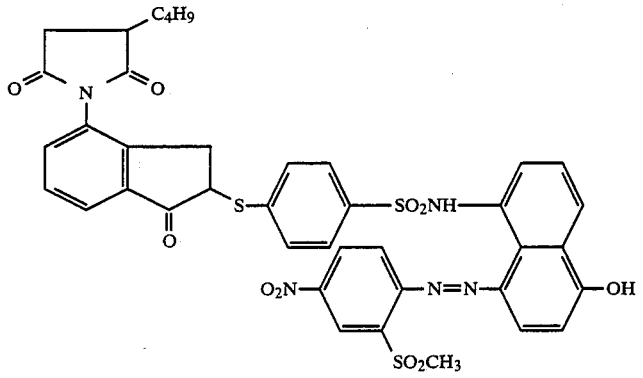
U-8
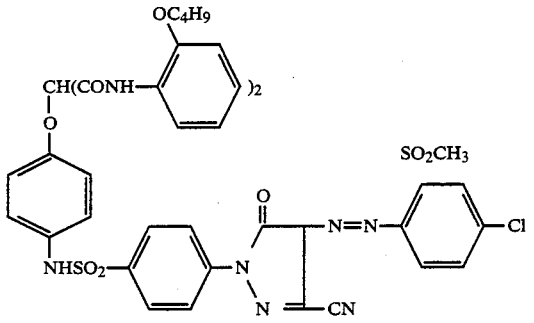
U-9
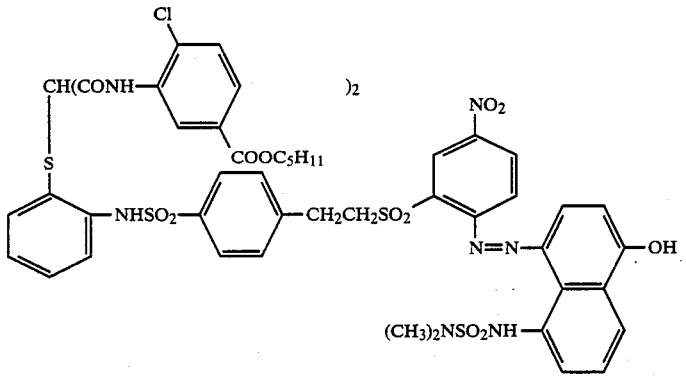
U-10
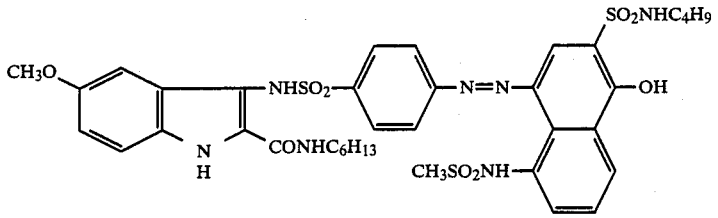

-continued
U-11
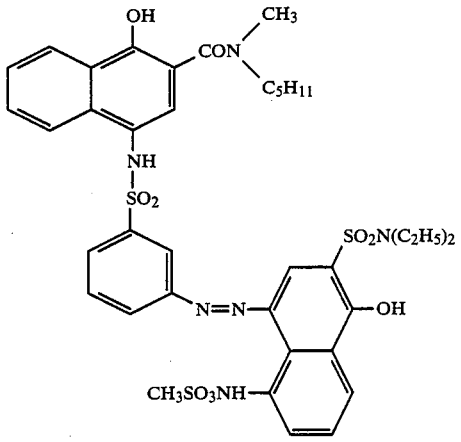
U-12
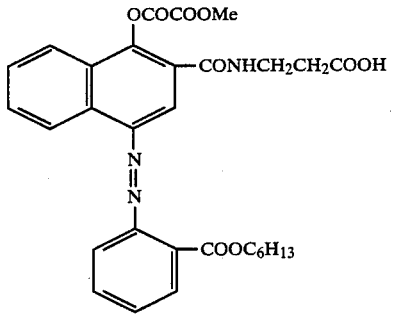
U-13
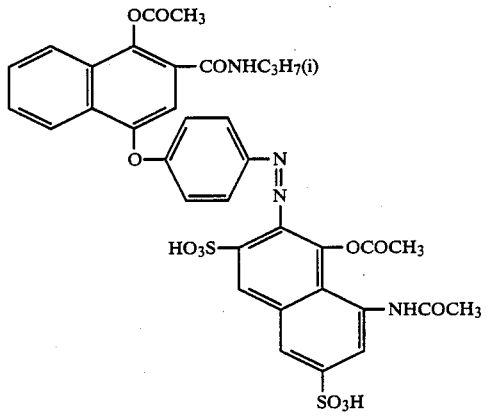
U-14
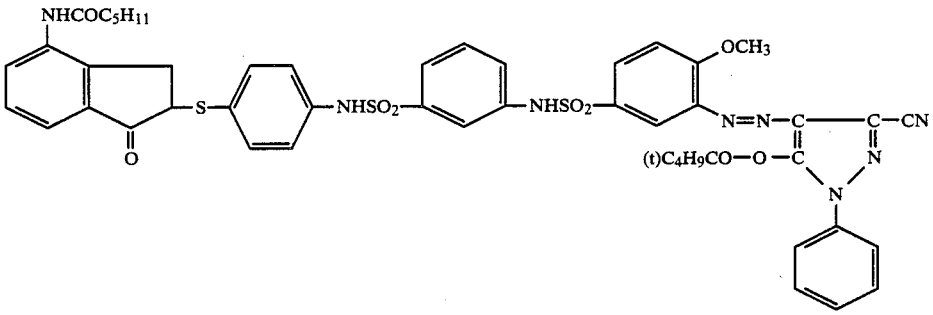

-continued
U-15
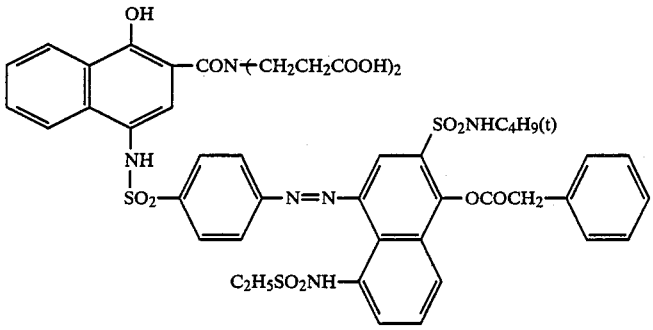
U-16
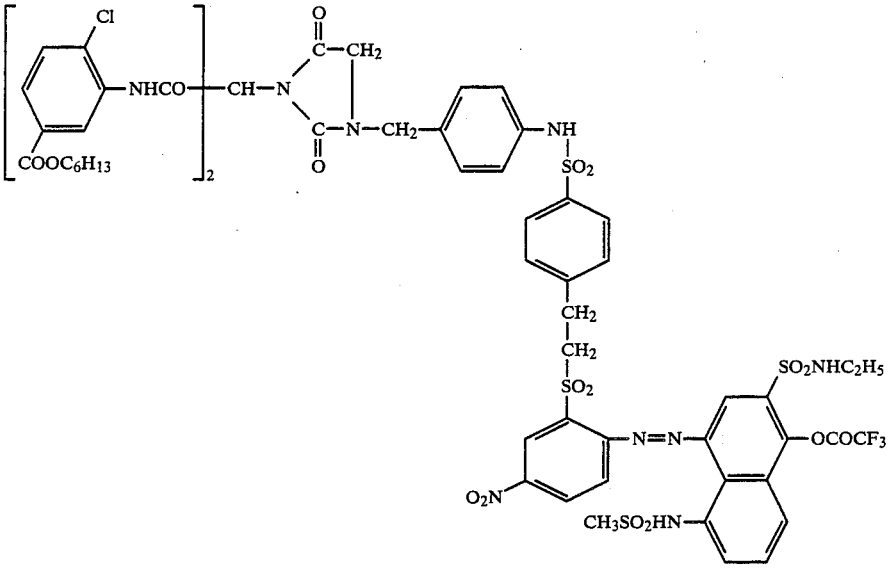
U-17
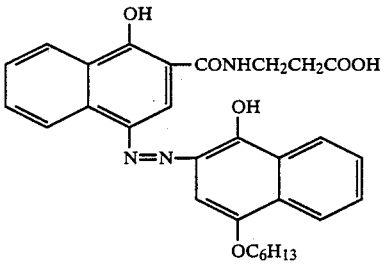
U-18
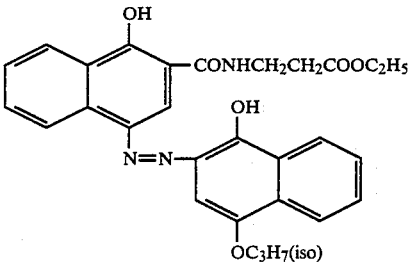

-continued
U-19
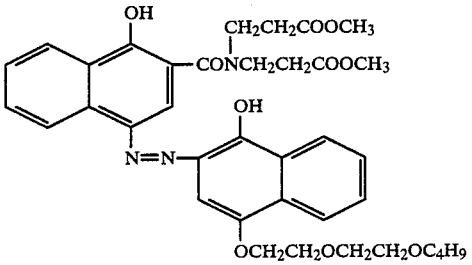
U-20
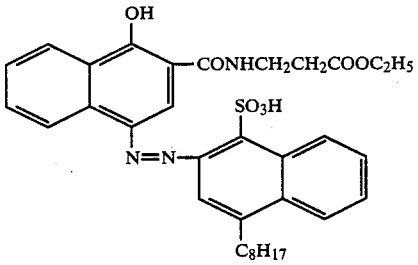
U-21
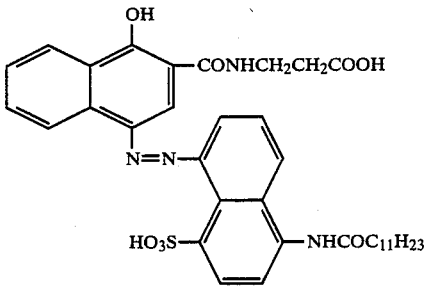
U-22
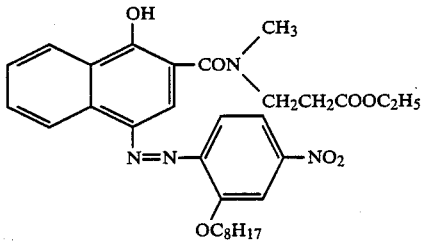
U-23
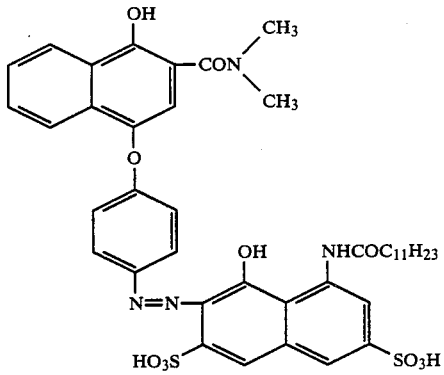

-continued
U-24
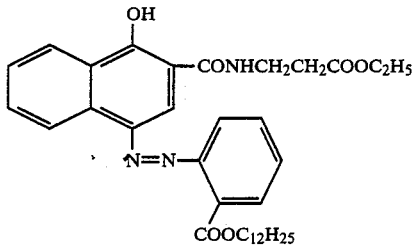
U-25
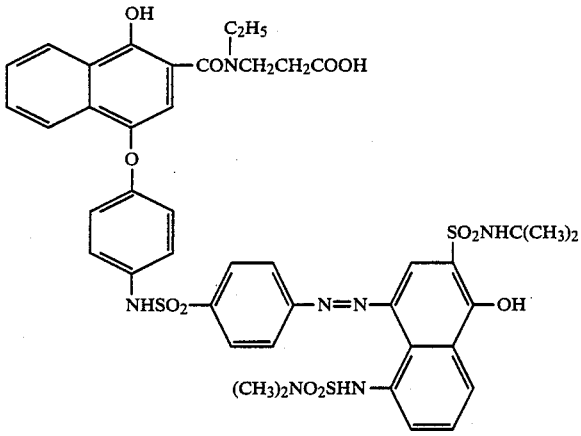
U-26
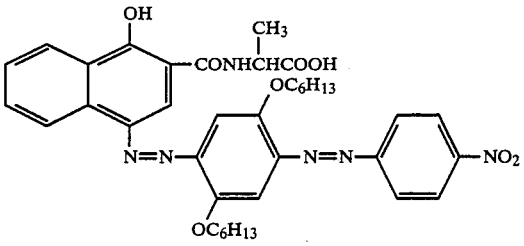
U-27
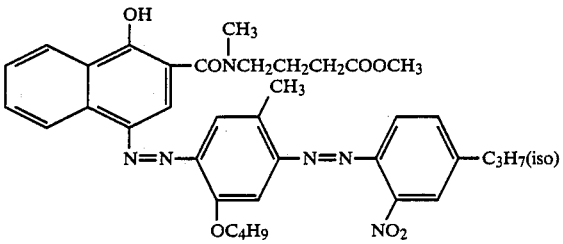
U-28
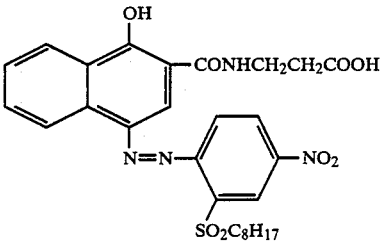

-continued
U-29
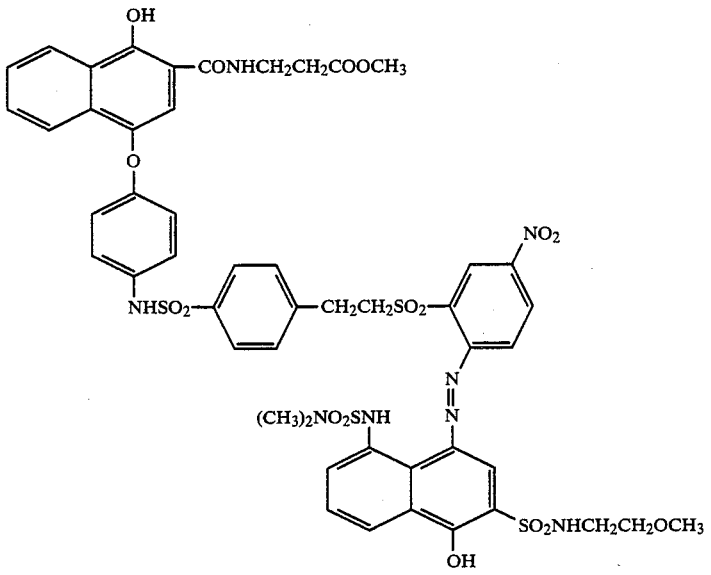
U-30
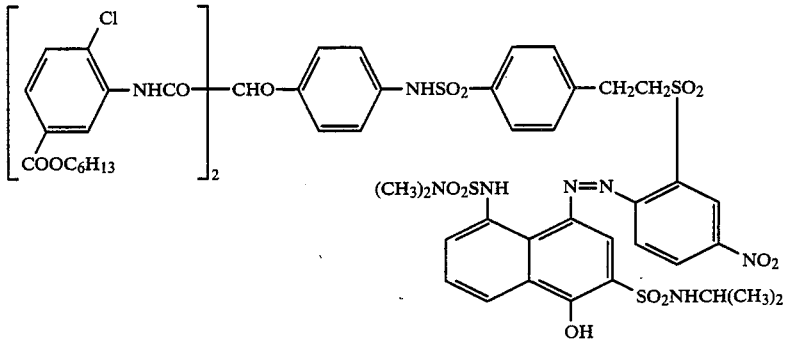
U-31
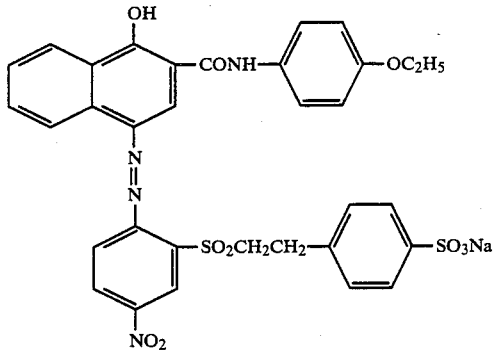

-continued
U-32
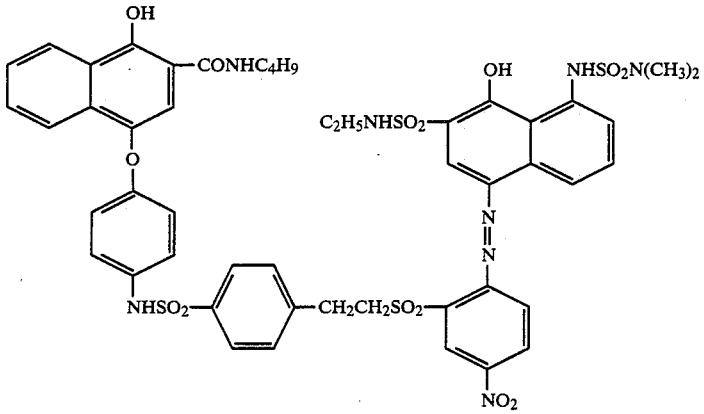
U-33
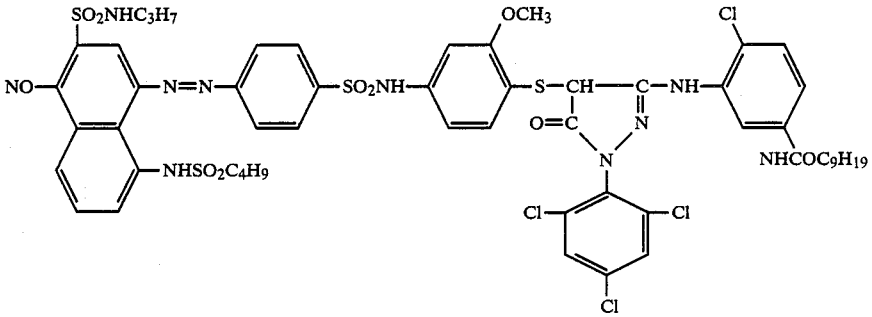
U-34
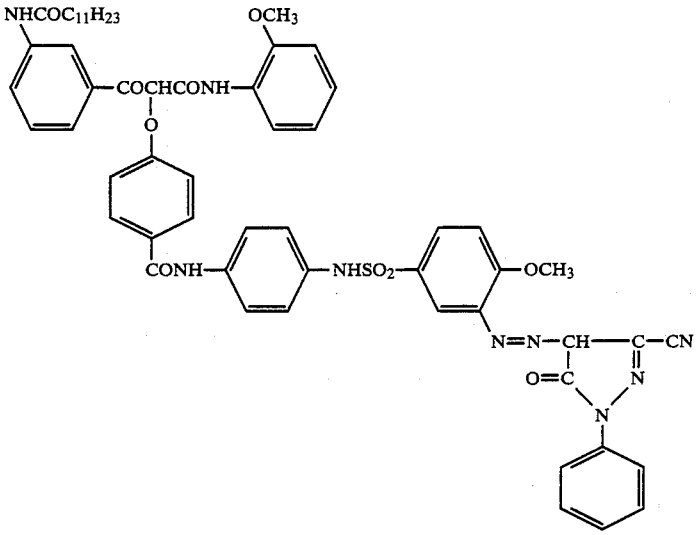
U-35
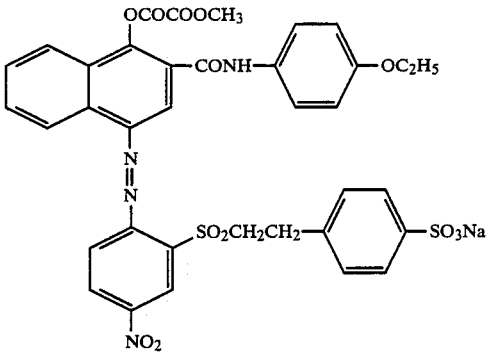

-continued
U-36
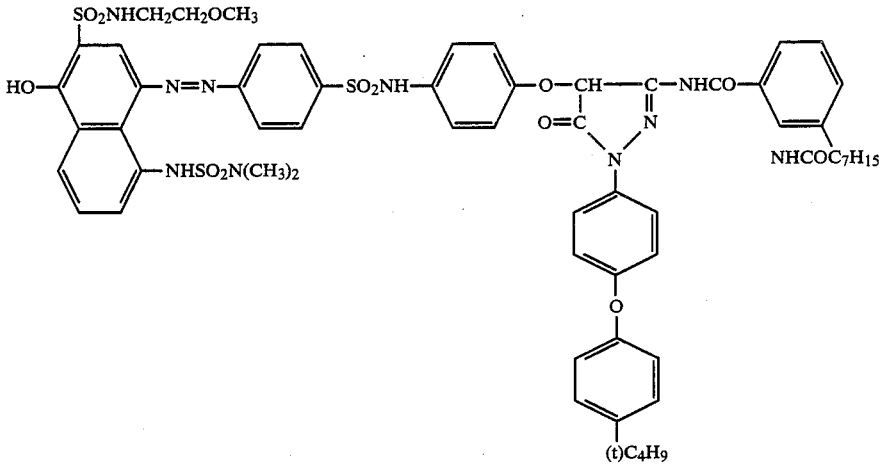
U-37
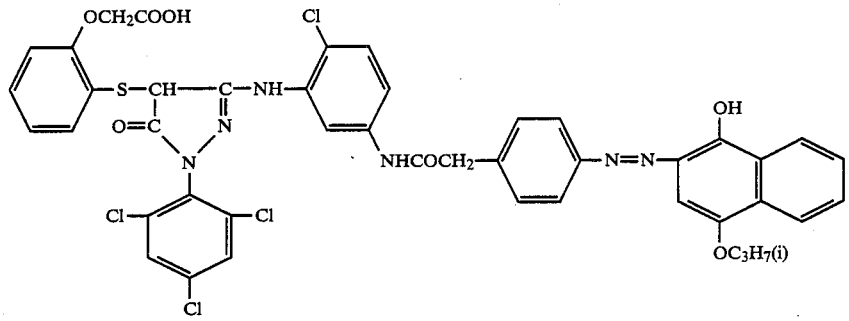
U-38
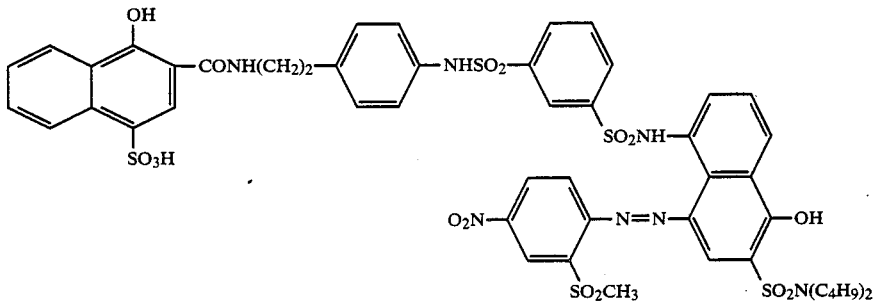
U-39
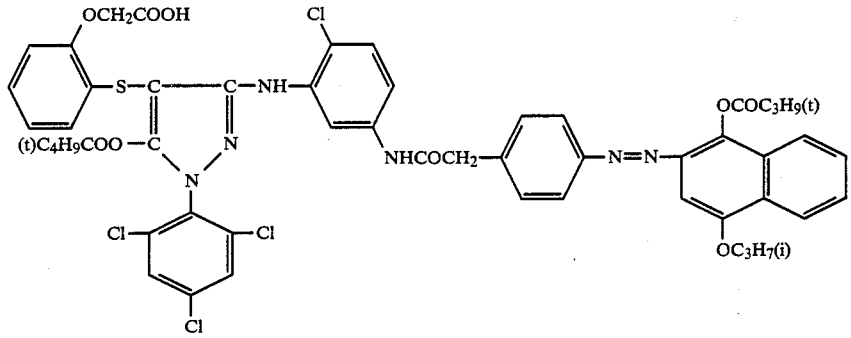

-continued
U-40
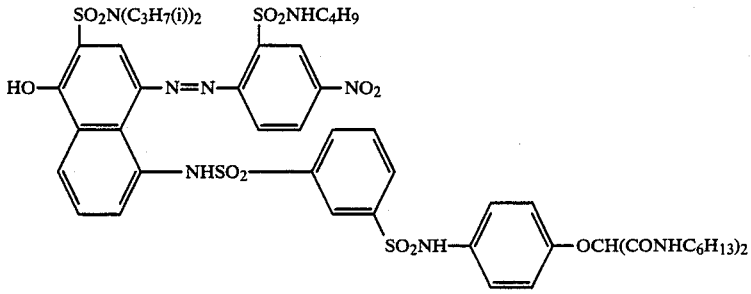
U-41
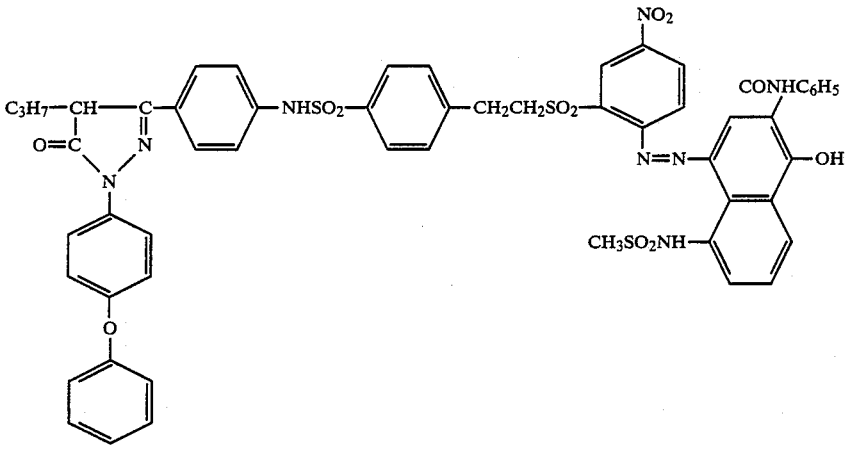
U-42
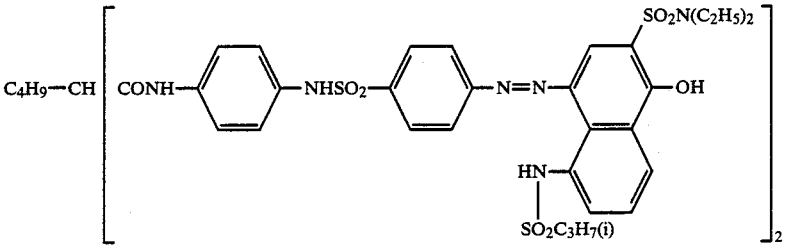
U-43
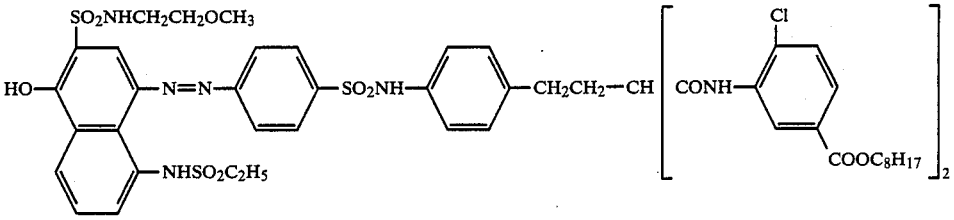
U-44
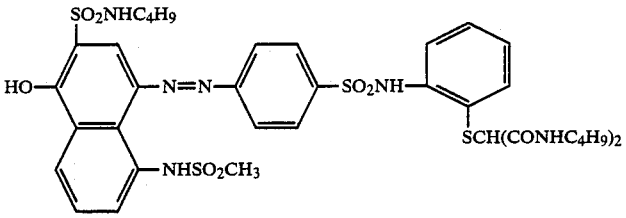
U-45
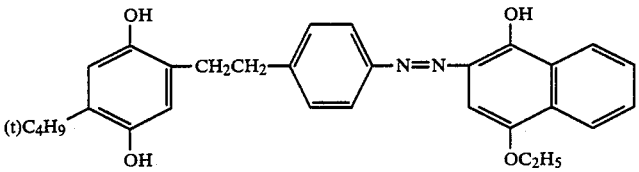

-continued
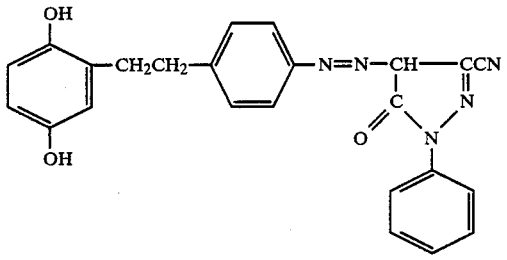
U-46
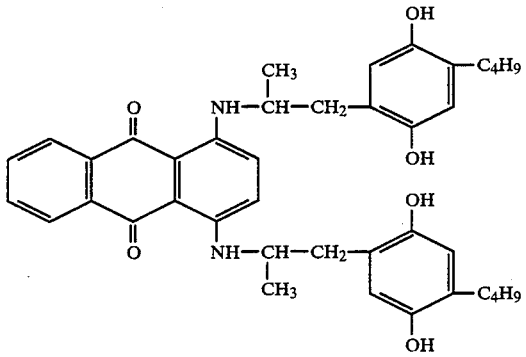
U-47
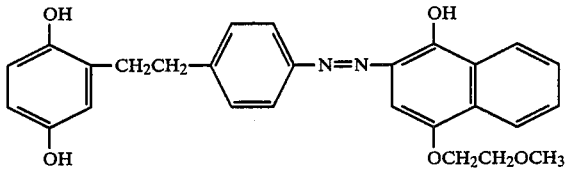
U-48
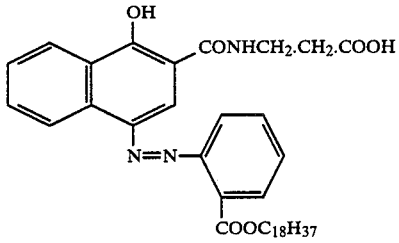
U-49
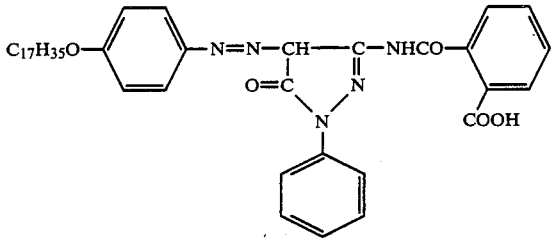
U-50

-continued
U-51
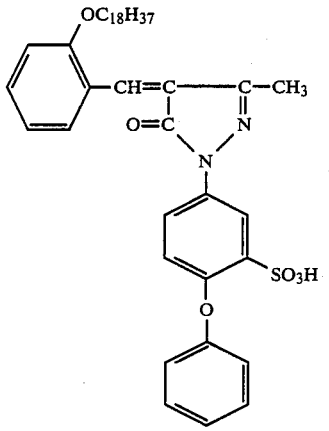
U-52
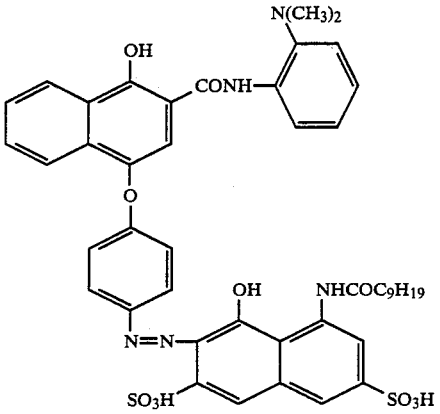
U-53
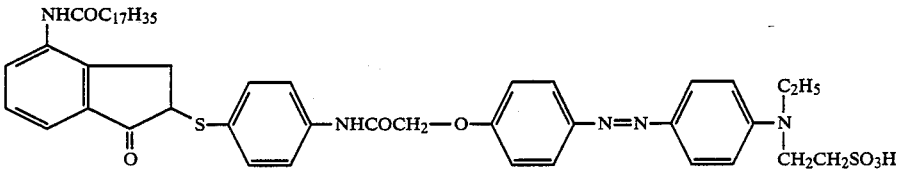
U-54
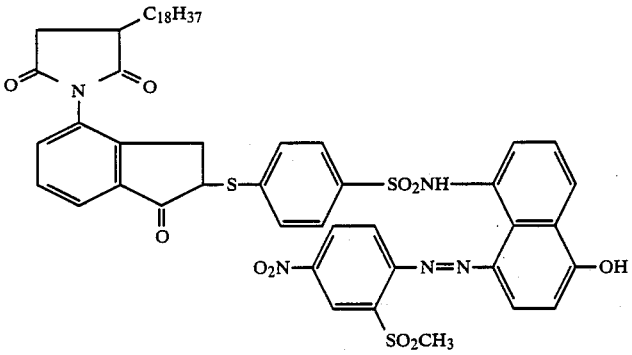
U-55
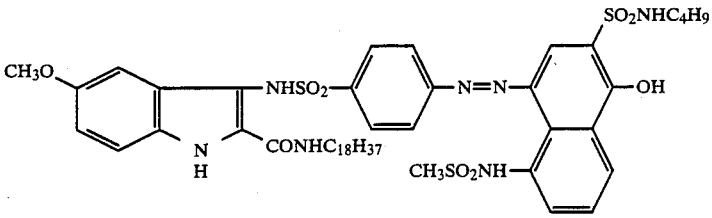

-continued

U-56

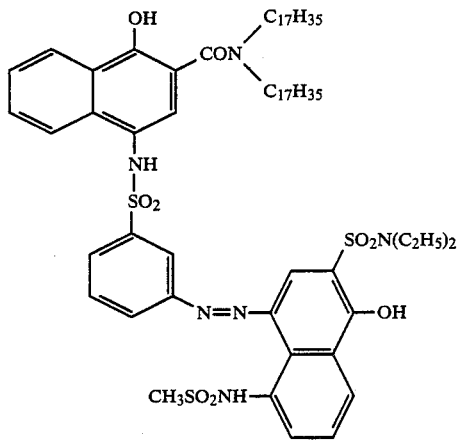

The positive compounds described in the foregoing pages can be synthesized by any of the conventional methods which are roughly divided into the following two types according to the route of synthesis. In one type of method, a dye portion is preliminarily synthesized and in the final step this dye portion is treated with an appropriate acid chloride forming agent such as phosphorus oxychloride or thionyl chloride to form a sulfochloride or acid chloride which then is bound to the other portion having an amino group. The other method of synthesis is characterized by obtaining a dye portion by diazo coupling in the final stage of synthesis. If a positive compound is a dye precursor, a dye is first formed, then an auxochrome is acylated or otherwise treated so as to obtain the desired positive compound.

The positive compound of the present invention is incorporated in a silver halide emulsion layer containing an appropriate non-diffusible coupler and/or in another photographic layer which is preferably situated adjacent said silver halide emulsion layer although this is not an essential requirement. If the positive compound itself has a predominant absorption in the principal sensitivity range of the silver halide emulsion layer containing a non-diffusible coupler, said "another photographic layer" is preferably situated opposite the side where incident exposing light falls and this is in order to prevent the decrease in sensitivity. Said "another photographic layer" may be a light-sensitive silver halide emulsion that is sensitive to light of the same color as that of light to which the silver halide emulsion layer containing a non-diffusible coupler is sensitive. Alternatively, said "another photographic layer" may be a non-light-sensitive layer.

The non-diffusible positive compound is preferably incorporated in a non-light-sensitive layer. If the positive compound is incorporated in a non-light-sensitive layer, part of the oxidation product of a developing agent that has formed as a result of development of the light-sensitive silver halide emulsion layer containing a non-diffusible coupler will diffuse into said non-light-sensitive layer where it reacts with the positive compound to form an unsharp positive image.

The positive compound is used in an amount which preferably ranges from 0.001 to 1.00 mole per mole of the non-diffusible coupler which is to be used in combination with said positive compound. A particularly preferable range is from 0.05 to 0.60 moles. The positive compound may be incorporated in an appropriate layer by the same method as employed for incorporating the non-diffusible coupler and which will be described later in this specification.

Any silver halides that are conventionally used in silver halide emulsions such as silver bromide, silver iodobromide, silver iodochloride, silver chlorobromide, silver chloroiodobromide and silver chloride can be incorporated in the silver halide emulsion for use in the present invention. Of these silver halides, silver bromide, silver iodobromide and silver chloroiodobromide are preferred.

The silver halide grains used in silver halide emulsions may be prepared by any suitable method selected from among the acid process, neutral process and ammoniacal process. The grains may be allowed to grow uninterruptedly or preliminarily formed seed grains may be permitted to grow. The formation and growth of seed grains may be achieved by the same or different methods.

A silver halide emulsion may be prepared by either the double-jet method or the single-jet method. It may also be prepared by adding silver halide ions and silver ions, either successively or simultaneously, with the pH and/or pAg in the reactor being controlled in consideration of the critical growth rate of the silver halide crystals. This method enables the formation of silver halide grains that have a regular crystallographic shape and a uniform particle size. A converted emulsion may be formed by changing the halide composition of grown grains.

A known silver halide solvent such as ammonia thioether or thiourea may be let to be present in the course of growing the silver halide grains.

The silver halide grains to be used in the silver halide emulsions of the present invention may have metal ions incorporated inside the grains and/or in the grain surfaces in the course of forming and/or growing the grains by using at least one salt selected from among cadmium salts, zinc salts, lead salts, thallium salts, iridium salts or complex salts thereof, rhodium salts or complex salts thereof, and iron salts or complex salts thereof. Said grains may also be placed in an appropriate reduction atmosphere to have reduction-sensitized specks imparted inside the grains and/or into the grain surfaces.

The silver halide emulsions of the present invention may be freed of unnecessary soluble salts after completion of the growth of the silver halide grains or may be left as they are containing such salts. In removing said salts; the method described in Research Disclosure No. 17643 II, may be used.

The silver halide grains to be used in the silver halide emulsions of the present invention may have a homogeneous structure throughout the crystal, or the structure of the core may be different from that of the shell.

These silver halide grains may be of the surface type where latent images are predominantly formed on the grain surface or of the internal type where latent images are formed within the grain.

The silver halide grains used in the silver halide emulsion in accordance with the present invention may have regular crystal shapes such as cubic, octahedral and tetradecahedral forms. The grains may have anomalous crystal shapes such as spherical and tabular forms. These grains may have any desired values for the ratio of {100} to {111} faces. The grains may have combinations of various crystal forms, or grains having different crystal forms may be used in mixture.

The average size of the silver halide grains used in the present invention is preferably within the range of 0.05~30 μm, within the range of 0.1~20 μm being more preferable.

The silver halide emulsion used in the present invention may have any pattern of grain size distribution, broad or narrow. Emulsions having a broad distribution (referred to as polydispersed emulsions) may be used either independently or in combination. Also suitable for use are emulsions having a narrow distribution (i.e., monodispersed emulsions which may be defined as those emulsions whose standard deviation of size distribution divided by the average grain size is no more than 0.20; the grain size is expressed as the diameter of a spherical grain and as the diameter of an equivalent circle for the projected area of a non-spherical grain). Polydispersed emulsions may be used in combination with monodispersed emulsions.

The silver halide emulsion of the present invention may be a mixture of two or more silver halide emulsions prepared separately.

The silver halide emulsion of the present invention is chemically sensitized by an ordinary method, such as sulfur sensitization, selenium sensitization, reduction sensitization, or noble metal sensitization.

The silver halide emulsion of the present invention may be optically sensitized to a desired range of wavelength, using dyes known as sensitizing dye in the photographic industry.

Compounds that are known as antifoggants or stabilizers in the photographic industry may be incorporated in the silver halide emulsion during or upon completion of chemical ripening and/or before coating of the silver halide emulsion following chemical ripening, for the purpose of preventing fogging during preparation of the light-sensitive material, during its storage or photographic processing or for the purpose of stabilizing its photographic performance characteristics.

The binder (or protective colloid) advantageously used in the silver halide emulsion of the present invention is gelatin, but other hydrophilic colloids such as gelatin derivatives, graft polymers of gelatin with other polymers, proteins, sugar derivatives, cellulose derivatives, and synthesized hydrophilic high-molecular weight substances such as homo- or copolymers may be used.

The photographic emulsion layers of the photographic material using the silver halide emulsion of the present invention, and other hydrophilic colloidal layers may be hardened with the aid of one or more hardeners that will crosslink the molecule of the binder (or protective colloid) to produce a stronger film. The hardener may be added in an amount sufficient to enable the photographic material to harden to such an extent that there is no need to incorporate any hardener in the processing solution, but if desired, an additional amount of hardener may be present in the processing solution.

A plasticizer may be added to the silver halide emulsion layer(s) and/or other hydrophilic colloidal layer(s) in the light-sensitive material of the present invention in order to enhance their flexibility. Compounds which are preferably used as such plasticizers are described in Research Disclosure (RD) No. 17643, XII, A.

A water-insoluble or slightly water-soluble synthetic polymer dispersion (i.e., latex) may also be incorporated in the photographic emulsion layer(s) and other hydrophilic colloidal layer(s) in the light-sensitive material of the present invention in order to improve the dimensional stability of these layers.

The emulsion layers in the photographic material of the present invention contain a dye forming coupler that will, in color development, enter into coupling with the oxidized product of an aromatic primary amine developing agent (e.g., p-phenylenediamine derivative or aminophenol derivative) to form a dye. A suitable dye forming coupler usually is selected for each emulsion layer so that it will form a dye that absorbs light in the spectral range of sensitivity for each emulsion layers; a yellow dye forming coupler is used in a blue-sensitive emulsion layer; a magenta dye forming coupler is used in a green-sensitive emulsion layer; and a cyan dye forming coupler is used in a red-sensitive emulsion layer. Other combinations of coupler and emulsions may be employed if such are needed for particular silver halide color photographic materials.

The aforementioned dye forming couplers desirably contain in their molecules a ballast group of 8 or more carbon atoms that will render the couplers non-diffusible. These dye forming couplers may be of the four-equivalent type that requires the reduction of four silver ions for the formation of one molecule of a dye, or of the two-equivalent ions. The dye forming couplers include a compound that will, upon coupling with the oxidized product of a developing agent, release a photographically useful fragment such as a development restrainer, development accelerator, bleach accelerator, developing agent, silver halide solvent, tone conditioner, hardener, fogging agent, antifoggant, chemical sensitizer, spectral sensitizer or desensitizer.

Among these compounds are DIR compounds which release a development retarder as a function of development to improve the sharpness or granularity of image. The DIR coupler may be replaced by a DIR compound that will couple with the oxidized product of a developing agent not only to form a colorless compound but also to release a development retarder.

Two types of DIR coupler and DIR compound are usable: one is of the type wherein a retarder is directly bonded to the coupling site, and the other is referred to as a timing DIR coupler or a timing DIR compound wherein the retarder is bonded to the coupling site by a divalent group in such a manner that said retarder will be released as by intramolecular nucleophilic or electron transfer reaction within the group that leaves upon coupling reaction. A retarder that becomes diffusible upon leaving and one that is not highly diffusible may be used either singly or in combination depending on the need. They may also be used in combination with a competing coupler, or a colorless coupler that couples with the oxidized product of an aromatic primary amine developing agent but which will not form any dye.

Known acyl acetanilide based couplers may preferably be used as yellow dye forming couplers in the present invention. Benzoyl acetanilide and pivaloyl acetanilide based compounds are advantageous.

Specific examples of the yellow-dye forming coupler that can be used in the present invention are described in, for example, U.S. Pat. Nos. 2,875,057, 3,265,506, 3,408,194, 3,551,155, 3,582,322, 3,725,072 and 3,891,445, West German Patent No. 1,547,868, West German Patent Applications (OLS) Nos. 2,219,917, 2,261,361 and 2,414,006, British Patent No. 1,425,020, Japanese Patent Publication No. 10783/1976, Unexamined Published Japanese Patent Applications Nos. 26133/1972, 73147/1973, 6341/1975, 87650/1975, 123342/1975, 130442/1975, 21827/1976, 102636/1976, 82424/1977, 115219/1977 and 95346/1983.

A particularly preferable yellow-dye forming coupler for further improvement in sharpness is selected from among the benzoyl-type couplers represented by the following general formula (Y):

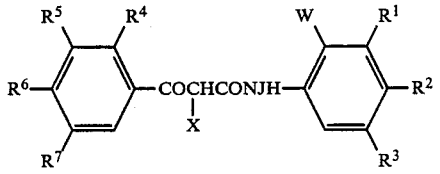

(Y)

In formula (Y), $R^1$, $R^2$ and $R^3$ may be the same or different and each represents a hydrogen atom, a halogen atom (e.g., fluorine, chlorine or bromine), an alkyl group (e.g., methyl, ethyl, allyl or dodecyl), an aryl group (e.g., phenyl or naphthyl), an alkoxy group (e.g., methoxy, ethoxy or dodecyloxy), an acylamino group [e.g., acetamido or α-(p-dodecyloxyphenoxy)-butanamido], a carbamoyl [e.g., carbamoyl, N,N-dimethylcarbamoyl, N-δ-(2,4-di-tertamylphenoxy) or butylcarbamoyl], an alkoxycarbonyl group [e.g., ethoxycarbonyl, dodecyloxycarbonyl or α-(dodecyloxycarbonyl-)ethoxycarbonyl group], a sulfonamido group (e.g., methanesulfonamido, p-dodecyloxybenzenesulfonamido or N-benzyldodecanesulfonamido), or a sulfamoyl group [e.g., sulfamoyl, N-methylsulfamoyl, N-δ-(2,4,-di-tert-aminophenoxy)butylsulfamoyl or N,N-diethylsulfamoyl].

In formula (Y), $R^4$, $R^5$, $R^6$ and $R^7$ may be the same or different and each represents a hydrogen atom, an alkyl group (e.g., methyl, ethyl or tert-butyl), an alkoxy group (e.g., methoxy, ethoxy, propoxy or octoxy), an aryloxy group (e.g., phenoxymethylphenoxy), an acylamino group (e.g., acetamido, α-(2,4-di-tert-amylphenoxy)butanamido) or sulfonamido group (e.g., methanesulfonamido, p-dodecylbenzenesulfonamido or N-benzyldodecanesulfonamido).

In formula (Y), W signifies a halogen atom (e.g., fluorine, chlorine or bromine), an alkyl group (e.g., methyl, ethyl or tert-butyl), an alkoxy group (e.g., methoxy, ethoxy, propoxy or octoxy), an aryloxy group (e.g., phenoxy or methylphenoxy) or a dialkylamino group (e.g., dimethylamino or N-butyl-N-octylamino).

In formula (Y), X signifies a hydrogen atom or a group that can be eliminated and a preferable example of the latter is represented by the general formula (Y'):

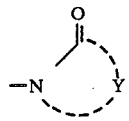

(Y')

where Y signifies the group of nonmetallic atoms that is necessary to form a 5- or 6-membered ring (illustrative cyclic compounds formed by Y are derivatives of 2,5-dioxoimidazoline, 2,5-pyrrolidonedione, 1,3-isoindoledione, 2,3,5-trioxo-imidazolidine, 2,5-dioxo-triazolidine, 2,4-oxazolidinedione, 2,4-thiazolidinedione, 2(1H)-pyridone, 2(1H)-pyrimidone, 2(1H)-pyrazone, 5(1H)-imidazolone, 5(1H)-triazolone, 2(1H)-pyrimidone, 2-pyrazolone(5), 2-isothiazolone(5), 2(1H)-quinaoxazolone, 4(3H)-pyrimidone, 2-benzoxazolone, 4-isoxazolone(5), 3-fluorone(2), 4-imidazolone(2), 3-pyrazolone, 2-tetrazolone(5), 3-tetrazolone(5), etc.)

Specific examples of the yellow couplers represented by formula (Y) are listed below.

[Y-1]

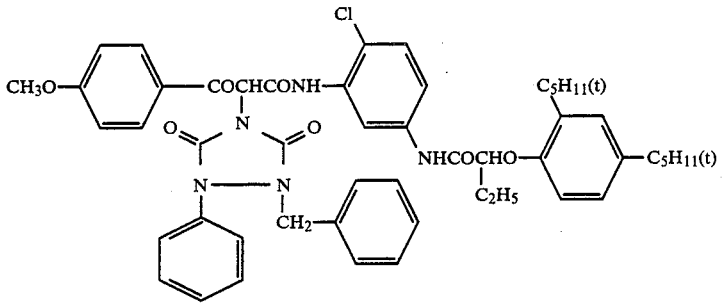

-continued
[Y-2]
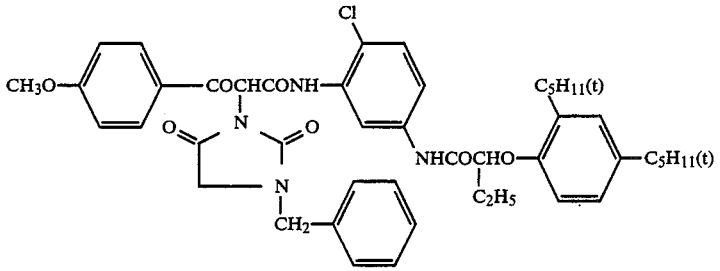
[Y-3]
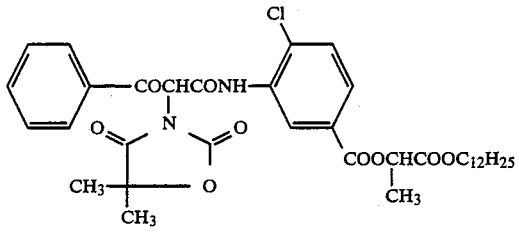
[Y-4]
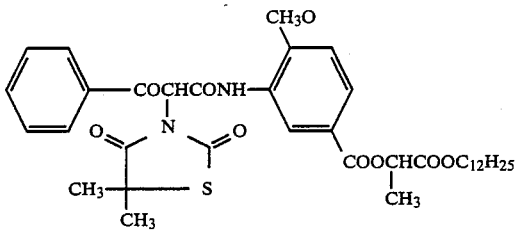
[Y-5]
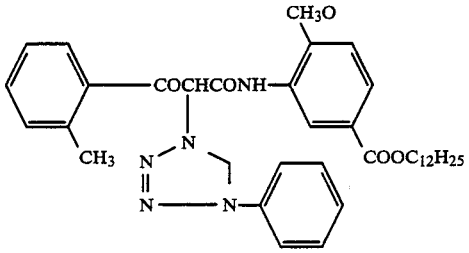
[Y-6]
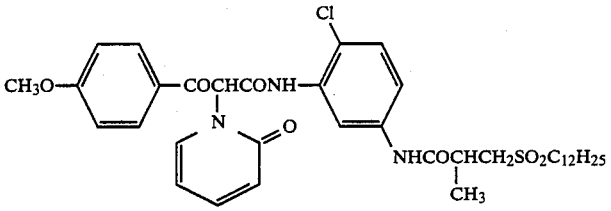
[Y-7]
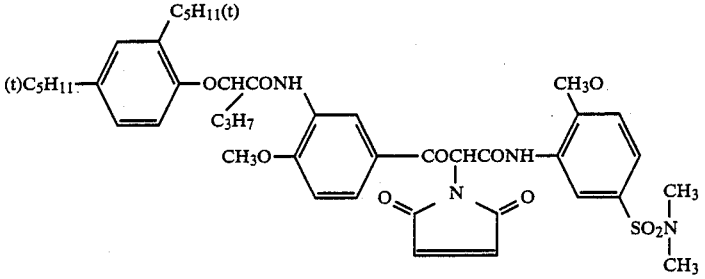

-continued
[Y-8]
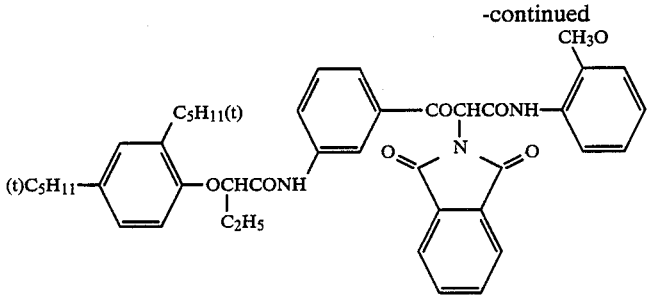
[Y-9]
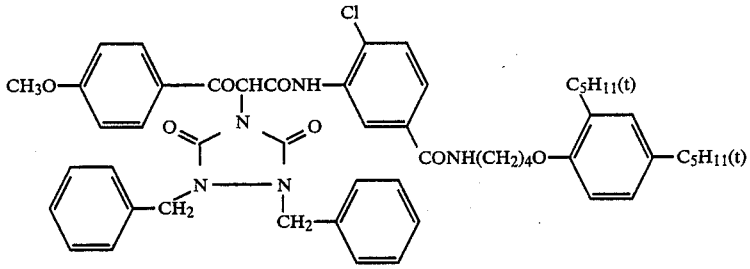
[Y-10]
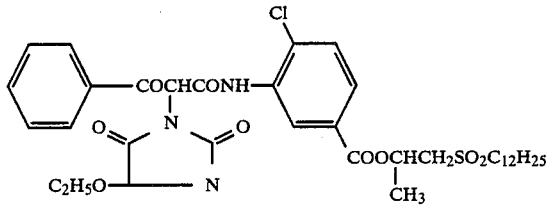
[Y-11]
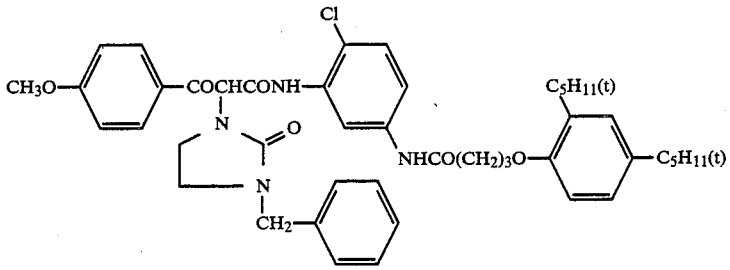
[Y-12]
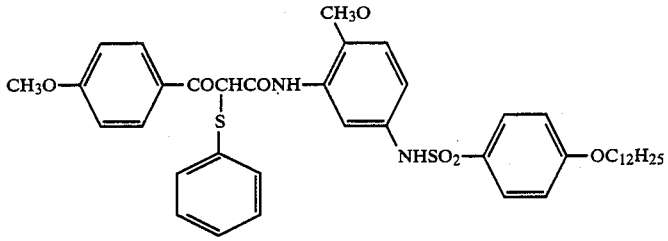
[Y-13]
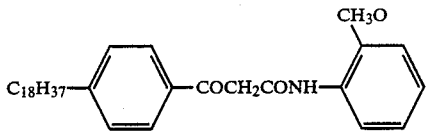
[Y-14]
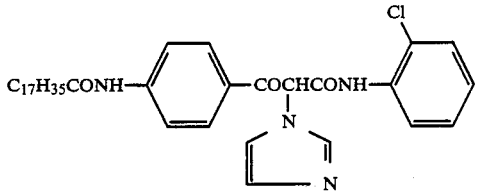

-continued

[Y-15]

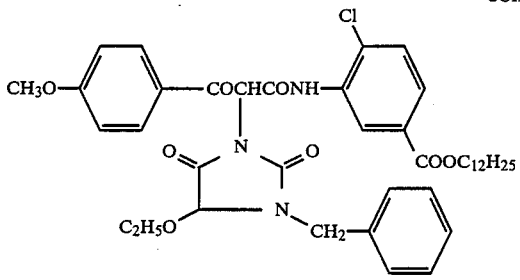

[Y-16]

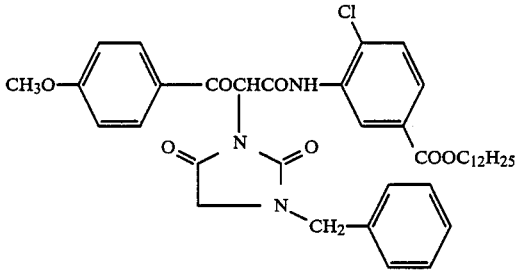

The magenta dye-forming couplers that can be used in combination with the couplers of the present invention include known couplers such as 5-pyrazolone couplers, pyrazolobenzimidazole couplers, open-chain acylacetonitrile couplers and indazolone couplers Specific examples of the magenta couplers that can be used in the present invention include those described in, for example, U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, West German Patent No. 1,810,464, West German Patent Applications (OLS) Nos. 2,408,665, 2,417,945, 2,418,959 and 2,424,467, Japanese Patent Publication No. 6031/1965, Unexamined Published Japanese Patent Applications Nos. 74027/1974, 74028/1974, 129538/1974, 60233/1975, 159336/1975, 20826/1976, 26541/1976, 42121/1977, 58922/1977 and 55122/1978 and Japanese Patent Application No. 110943/1980.

Phenol- or naphthol-based couplers are generally used for cyan-dye forming couplers Specific examples of the preferred cyan couplers that can be used in the present invention include those described in, for example, U.S. Pat. Nos. 2,423,730, 2,474,293, 2,801,171, 2,895,826, 3,476,563, 3,737,326, 3,758,308 and 3,893,044, Unexamined Published Japanese Patent Applications Nos. 37425/1972, 10135/1975, 25228/1975, 112038/1975, 117422/1975, 130441/1975 and 98731/1983.

A particularly preferable cyan dye-forming coupler for further improvement in desilvering, in reforming dye and in dark fading is selected from the cyan couplers represented by the following general formula (C):

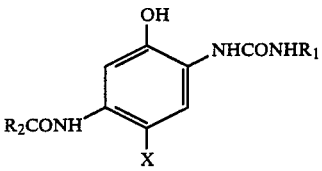

(C)

In Formula (C), X represents a hydrogen atom or a group that may be eliminated upon coupling reaction with the oxidized product of an aromatic primary amine color developing agent; $R_1$ represents a naphthyl group, a heterocyclic group (provided that a carbon atom of the heterocyclic group is bonded to the nitrogen atom of the ureido group)or a phenyl group which has at least one substituent selected from among trifluoromethyl, nitro, cyano,

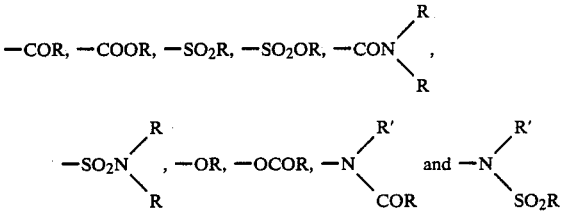

(where R represents an aliphatic group or an aromatic group, and R′ represents a hydrogen atom, an aliphatic group or an aromatic group); and $R_2$ represents an aliphatic or an aromatic group necessary to impart non-diffusibility to both the cyan coupler represented by Formula (C) and the cyan dye to be formed from said cyan coupler.

Preferable ureido type cyan couplers represented by Formula (C) include, for example, those represented by the following Formula (C-1) or (C-2):

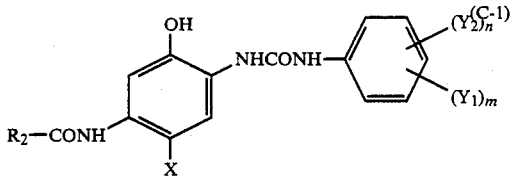

(C-1)

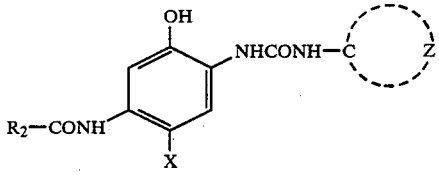

(C-2)

In Formulas (C-1) and (C-2), $Y_1$ represents a trifluoromethyl group, a nitro group, a cyano group,

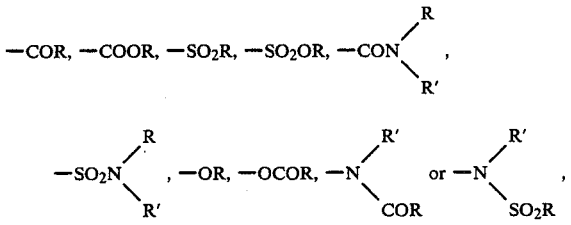

where R represents an aliphatic group (preferably an alkyl group having 1 to 10 carbon atoms, e.g., methyl, butyl, cyclohexyl or benzyl) or an aromatic group (preferably an aryl group, e.g., phenyl or tolyl) and R' represents a hydrogen atom or a group represented by R;

$Y_2$ represents a monovalent group, preferably an aliphatic group (preferably an alkyl group having 1 to 10 carbon atoms, e.g., methyl, t-butyl, ethoxyethyl or cyanomethyl), an aromatic group (preferably an aryl group, e.g., phenyl, naphthyl or tolyl), a halogen atom (e.g., fluorine, chlorine or bromine), an amino group (e.g., ethylamino or diethylamino), a hydroxy group or a substituent represented by $Y_1$;

m is an integer of 1 to 3 and n is an integer of 0 to 3, provided that $m+n \leqq 5$;

Z represents a group of the non-metallic atoms necessary for forming a heterocyclic group or a naphthyl group. The heterocyclic group is preferably a 5- or 6-membered heterocyclic ring containing 1 to 4 nitrogen, oxygen or sulfur atoms. Examples of such heterocyclic group include furyl, thienyl, pyrydyl, quinolyl, oxazolyl, tetrazolyl, benzothiazolyl and tetrahydrofuranyl groups. These heterocyclic rings may have substituents. Illustrative substituents include an alkyl group having 1 to 10 carbon atoms (e.g., ethyl, i-propyl, i-butyl, t-butyl or t-octyl), an aryl group (e.g., phenyl or naphthyl), a halogen atom (e.g., fluorine, chlorine or bromine), a cyano group, a nitro group, a sulfonamide group (e.g., methanesulfonamide, butane-sulfonamide or p-toluenesulfonamide), a sulfamoyl group (e.g., methylsulfamoyl or phenylsulfamoyl), a sulfonyl group (e.g., methanesulfonyl, fluorosulfonyl or p-toluenesulfonyl), a carbamoyl group (e.g., dimethylcarbamoyl or phenylcarbamoyl), an oxycarbonyl group (e.g., ethoxycarbonyl or phenoxycarbonyl), an acyl group (e.g., acetyl or benzoyl), a heterocyclic group (e.g., pyridyl or pyrazolyl), an alkoxy group, an aryloxy group and an acyloxy group;

$R_2$ represents an aliphatic or an aromatic group necessary to impart non-diffusibility to both the cyan coupler represented by Formula (C) and the cyan dye to be formed from said cyan coupler, preferably an alkyl, aryl or heterocyclic group having 4 to 30 carbon atoms. Typical examples of such preferable groups include a straight-chained or branched alkyl group (e.g., t-butyl, n-octyl, t-octyl or n-dodecyl), an alkenyl group, a cycloalkyl group, a 5- or 6-membered heterocyclic group and a group represented by the following Formula (C-3):

(C-3)

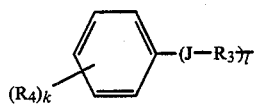

wherein J is an oxygen or sulfur atom; k is an integer of 0 to 4; l is 0 or 1; when k is 2 or more, $R_4$ may be the same or different; $R_3$ is a straight-chained or branched alkyl group having 1 to 20 carbon atoms; and $R_4$ is a nonovalent group such as a hydrogen atom, a halogen atom (preferably chlorine or bromine), an alkyl group (preferably a straight-chained or branched alkyl group having 1 to 20 carbon atoms, e.g., methyl, t-butyl, t-pentyl, t-octyl, dodecyl, pentadecyl, benzyl or phenetyl), an aryl group (e.g., phenyl), a heterocyclic group (preferably a nitrogen-containing heterocyclic group), an alkoxy group (preferably a straight-chained or branched alkyloxy group having 1 to 20 carbon atoms, e.g., methoxy, ethoxy, t-butyloxy, octyloxy, decyloxy or dodecyloxy), an aryloxy group (e.g., phenoxy), a hydroxy group, an acyloxy group (preferably alkylcarbonyloxy or arylcarbonyloxy, e.g., acetoxy or benzoyloxy), a carboxy group, an alkoxycarbonyl group (preferably a straight-chained or branched alkyloxycarbonyl group having 1 to 20 carbon atoms, an aryloxycarbonyl group (preferably phenoxycarbonyl), an alkylthio group (preferably having 1 to 20 carbon atoms), an acyl group (preferably a straight-chained or branched alkylcarbonyl group having 1 to 20 carbon atoms), an acylamino group (preferably a straight-chained or branched alkylcarboamide group having 1 to 20 carbon atoms or a benzenecarboamide group), a sulfonamide group (preferably a straight-chained or branched alkylsulfonamide group having 1 to 20 carbon atoms or a benzenesulfonamide group), a carbamoyl group (preferably a straight-chained or branched alkylaminocarbonyl group having 1 to 20 carbon atoms or a phenylaminocarbonyl group) and a sulfamoyl group (preferably a straight-chained or branched alkylaminosulfonyl group having 1 to 20 carbon atoms or a phenylaminosulfonyl group); X represents a hydrogen atom or a group that can be eliminated upon coupling reaction with the oxidized product of an aromatic primary amine color developing agent. Illustrative examples of such group include a halogen atom (e.g., chlorine, bromine or fluorine) and aryloxy, carbamoyloxy, carbamoylmethoxy, acyloxy, sulfonamide and succinamide groups which are bonded through an oxygen or nitrogen atom to the coupling site. More specific examples are shown in U.S. Pat. No. 3,741,563, Japanese Patent Application (OPI) No. 37425/1972 (the symbol OPI as used herein means an unexamined published Japanese patent application), Japanese Patent Publication No. 36894/1973, and Japanese Patent Applications (OPI) Nos. 10135/1975, 117422/1975, 130441/1975, 108841/1976, 120334/1975, 18315/1977 and 105226/1978.

Particularly, preferable ureido type cyan couplers represented by Formula (C) are those represented by the following Formula (C-4):

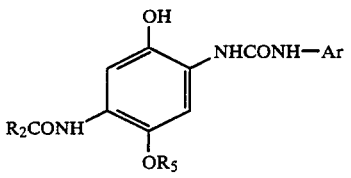

(C-4)

wherein $R_2$ is the same in meaning as $R_2$ in Formula (C); Ar represents a phenyl or naphthyl group having at least one of the following substituents: a halogen atom (e.g., fluorine, chlorine or bromine), a cyano group, a nitro group, an alkylsulfonyl group, an arylsulfonyl group, an acyl group, an alkoxycarbonyl group, a sulfamoyl group, a carbamoyl group and a trifluoromethyl group; and $R_5$ represents a substituted or unsubstituted alkyl, alkenyl, aralkyl, aralkenyl, cycloalkyl, aryl or heterocyclic group.

The alkyl, alkenyl, aralkyl, aralkenyl, cycloalkyl, aryl and heterocyclic groups represented by $R_5$ in Formula (C-4) each may have substituents. Typical substituents include a halogen atom (e.g., fluorine, chlorine or bromine), a cyano group, a hydroxy group, an alkoxy group (e.g., methoxy, ethoxy, propyloxy, butoxy or octyloxy), an aryloxy group (e.g., phenoxy), an acyloxy group (e.g., acetyloxy, propyonyloxy, butyloyloxy or benzoyloxy), an acylamino group (e.g., formamino, acetylamino, propyonylamino or benzoylamino), a sulfonamide group (e.g., methylsulfonamide, octylsulfonamide or benzenesulfonamide), a sulfamoyl group (e.g., non-substituted sulfamoyl, methylsulfamoyl, ethylsulfamoyl, propylsulfamoyl or phenylsulfamoyl), a sulfonyl group (e.g., methylsulfonyl, ethylsulfonyl, octylsulfonyl or benzenesulfonyl), a carboxy group, a sulfo group, a nitro group, an arylthio group (e.g., phenylthio), an alkylthio group (e.g., methylthio or ethylthio), a carbamoyl group (e.g., ethylcarbamoyl or phenylcarbamoyl), an alkoxycarbonyl group (e.g., methoxycarbonyl or ethoxycarbonyl), a sulfinyl group (e.g., methylsulfinyl or phenylsulfinyl), a phosphamide (e.g., diethyl phosphatemonoamide) and a heterocyclic group (e.g., pyrazolyl or triazolyl). These substituents each may further have one or more of these substituents, and when the substituents are two or more, they may be the same or different.

Examples of the cyan couplers represented by Formula (C) are shown in, for example, Japanese Patent Applications (OPI) Nos. 65134/1981, 204543/1982, 204544/1982, 204545/1982 33249/1983, 33253/1983, 98731/1983, 118643/1983, 179838/1983, 187928/1983, 65844/1984, 71051/1984, 86048/1984, 105644/1984, 111643/1984, 111644/1984, 131939/1984, 165058/1984, 177558/1984, 180559/1984, 198455/1984, 35731/1985, 37557/1985, 49335/1985, 49336/1985, 50533/1985, 91355/1985, 107649/1985, 107650/1985 and 2757/1986.

Several of the preferred examples of the cyan dye forming coupler suitable for use in the present invention are listed below, but it should be understood that the scope of the present invention is by no means limited by these examples.

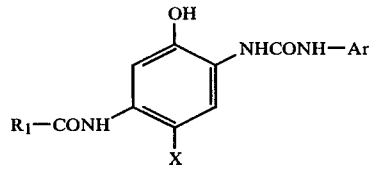
| No. | $R_1$ | Ar | X |
|---|---|---|---|
| 1 | 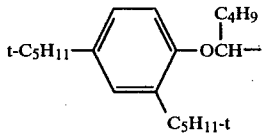 | 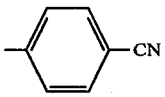 | 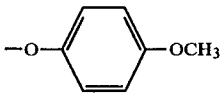 |
| 2 | 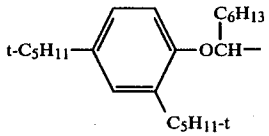 | 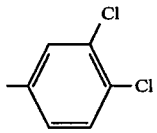 | 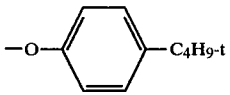 |
| 3 | 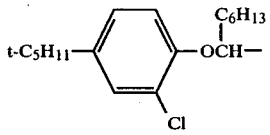 | 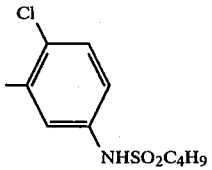 | —H |
| 4 | 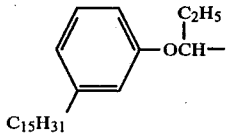 | 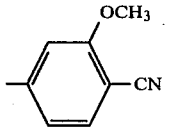 | 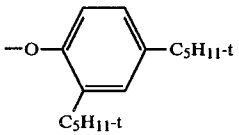 |
| 5 | 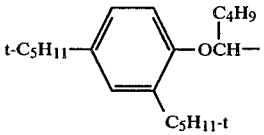 | 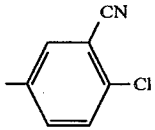 | 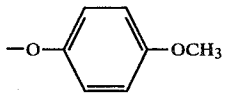 |

-continued
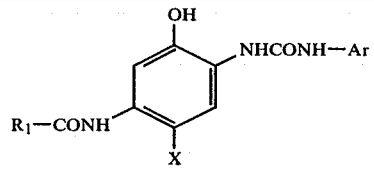
| No. | $R_1$ | Ar | X |
|---|---|---|---|
| 6 | 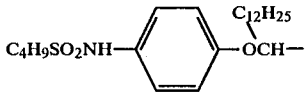 | 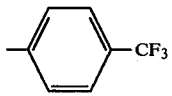 | $-OCH_2CONHC_4H_9$-t |
| 7 | 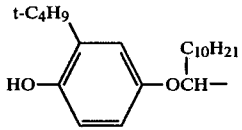 | 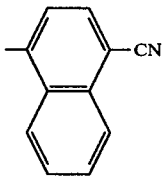 | 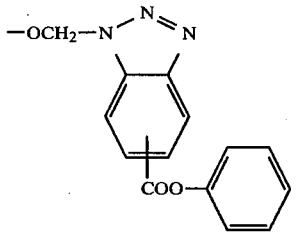 |
| 8 | 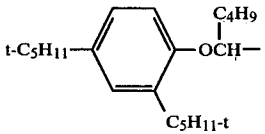 | 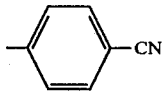 | 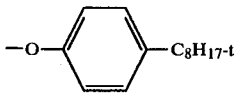 |
| 9 | 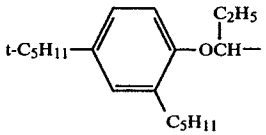 | 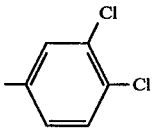 | $-O-CH_2CH_2SCH_2COOH$ |
| 10 | $CH_3-$ | 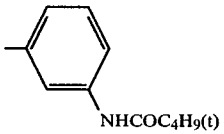 | $-OCH_2CONH(CH_2)_4$ 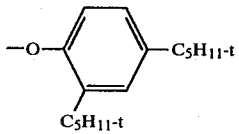 |

-continued
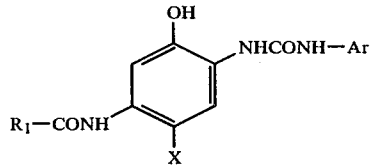
| No. | $R_1$ | Ar | X |
|---|---|---|---|
| 11 | 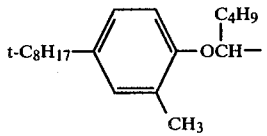 | 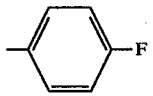 | —Cl |
| 12 | 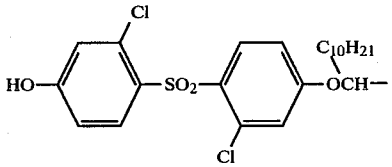 | 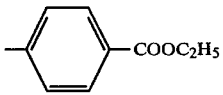 | 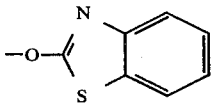 |
| 13 | 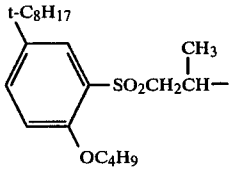 | 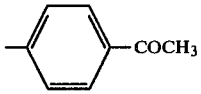 | 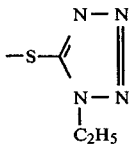 |
| 14 | 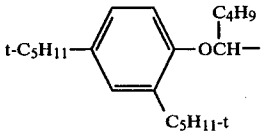 | 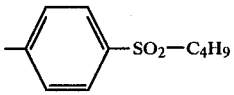 | —H |
| 15 | 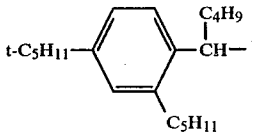 | 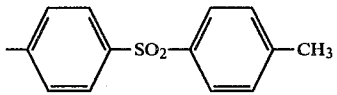 | —Cl |

-continued
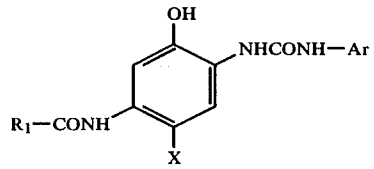
| No. | $R_1$ | Ar | X |
|---|---|---|---|
| 16 | 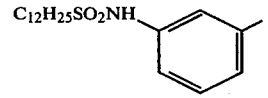 | 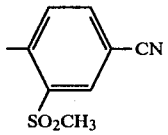 | $-OCH_3$ |
| 17 | 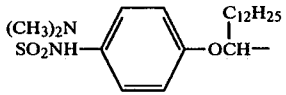 | 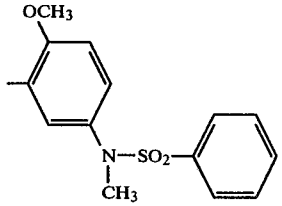 | 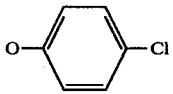 |
| 18 | 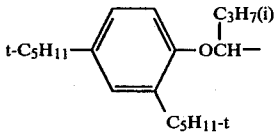 | 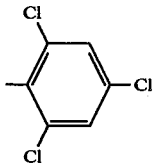 | $-SCN$ |
| 19 | $(CH_3)_3C-$ | 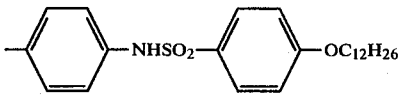 | 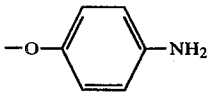 |
| 20 | 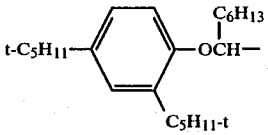 | 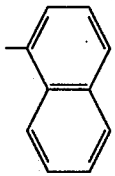 | $-NHSO_2CH_3$ |

-continued
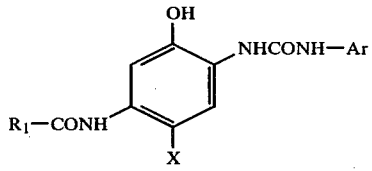
| No. | $R_1$ | Ar | X |
|---|---|---|---|
| 21 | 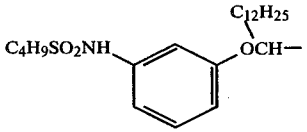 | 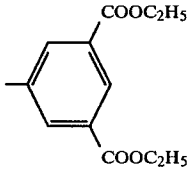 | 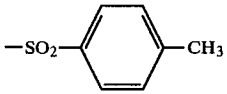 |
| 22 | 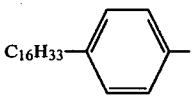 | 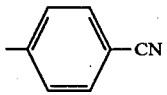 | 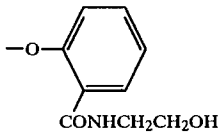 |
| 23 | $C_{15}H_{31}$— | 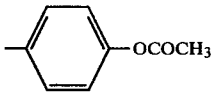 | —Cl |
| 24 | 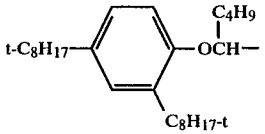 | 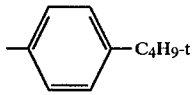 | 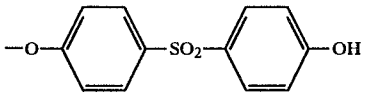 |
| 25 | 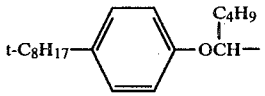 | 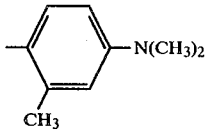 | 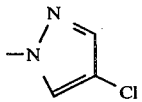 |

-continued
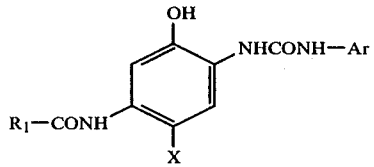
| No. | $R_1$ | Ar | X |
|---|---|---|---|
| 26 | 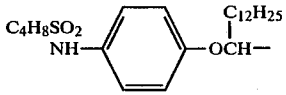 | 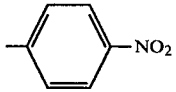 | 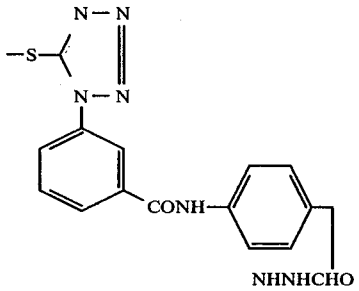 |
| 27 | 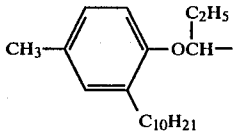 | 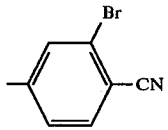 | —H |
| 28 | 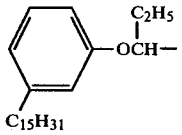 | 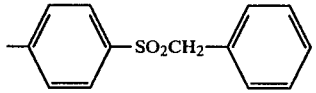 | —$OCH_2CH_2CH_2COOH$ |
| 29 | 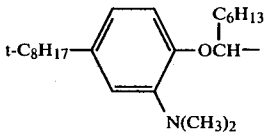 | 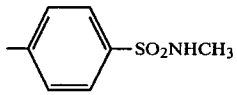 | —F |

-continued
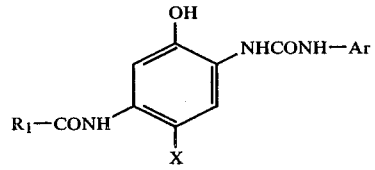
| No. | $R_1$ | Ar | X |
|---|---|---|---|
| 30 | 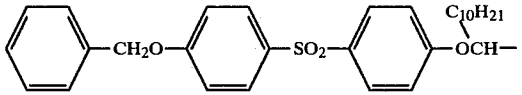 | 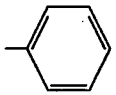 | 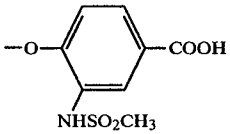 |
| 31 | 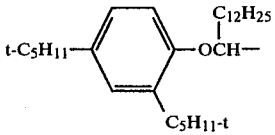 | 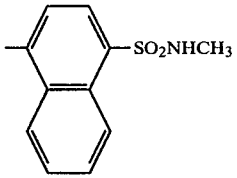 | 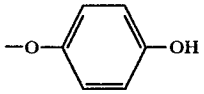 |
| 32 | 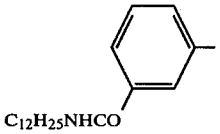 | 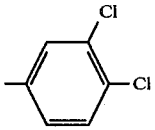 | 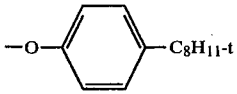 |
| 33 | 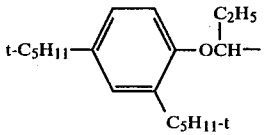 | 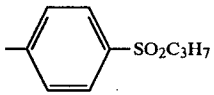 | 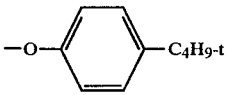 |
| 34 | 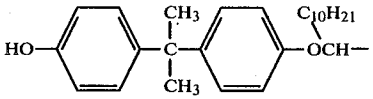 | 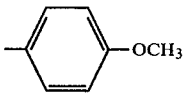 | 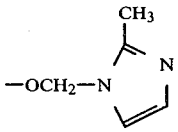 |

-continued
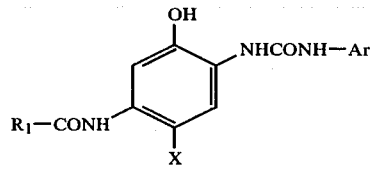
| No. | $R_1$ | Ar | X |
|---|---|---|---|
| 35 | 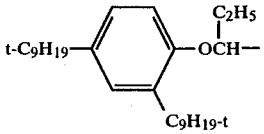 | 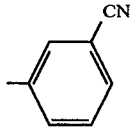 | $-OCH_2CH_2SO_2CH_2CH_2COOH$ |
| 36 | 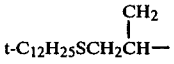 | 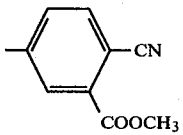 | 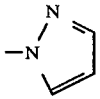 |
| 37 | 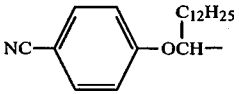 | 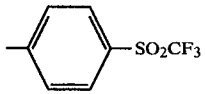 | 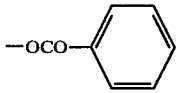 |
| 38 | 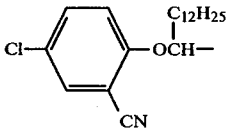 | 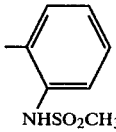 | $-O-(CH_2)_2-SCHCH_3$ COOH |
| 39 | 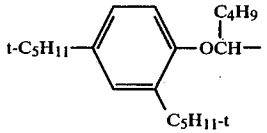 | 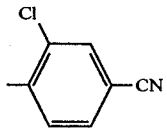 | 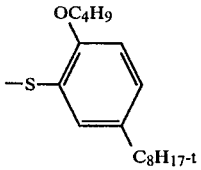 |

-continued
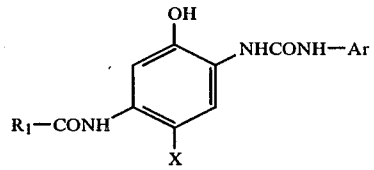
| No. | $R_1$ | Ar | X |
|---|---|---|---|
| 40 | 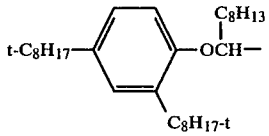 | 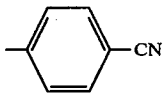 | —Cl |
| 41 | 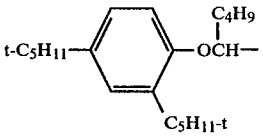 | 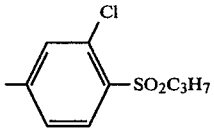 | —H |
| 42 | 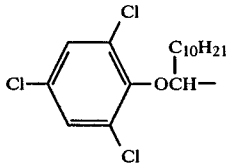 | 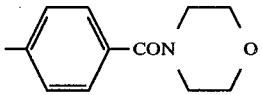 | 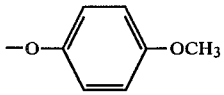 |
| 43 | 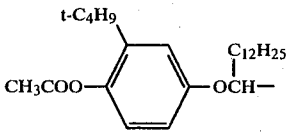 | 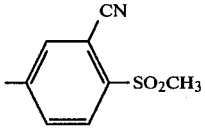 | 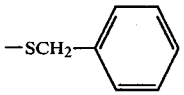 |
| 44 | 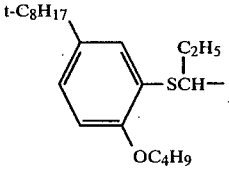 | 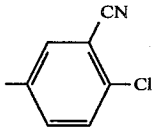 | —OCHCH=CH2 |

-continued
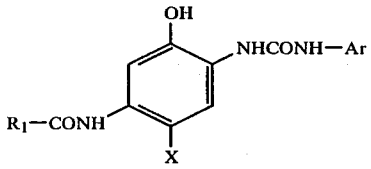
| No. | $R_1$ | Ar | X |
|---|---|---|---|
| 45 | 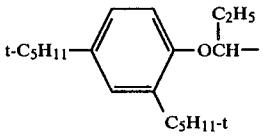 | 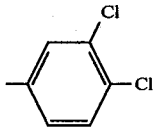 | —Cl |
| 46 | 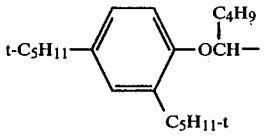 | 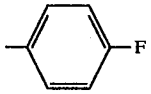 | 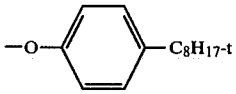 |
| 47 | 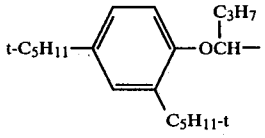 | 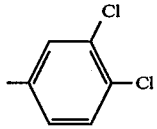 | 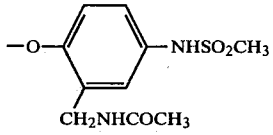 |
| 48 | 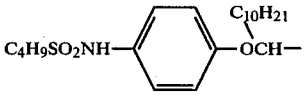 | 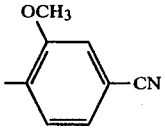 | 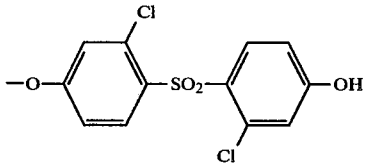 |
| 49 | 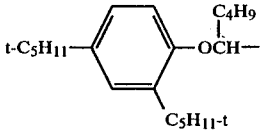 | 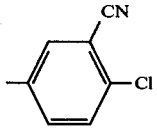 | 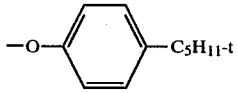 |

-continued
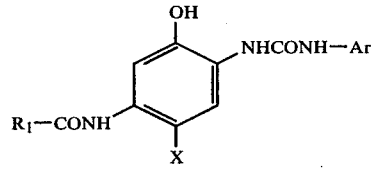
| No. | $R_1$ | Ar | X |
|---|---|---|---|
| 50 | 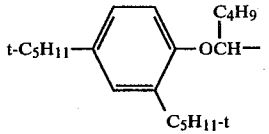 | 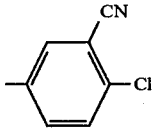 | —Cl |
| C-51 | 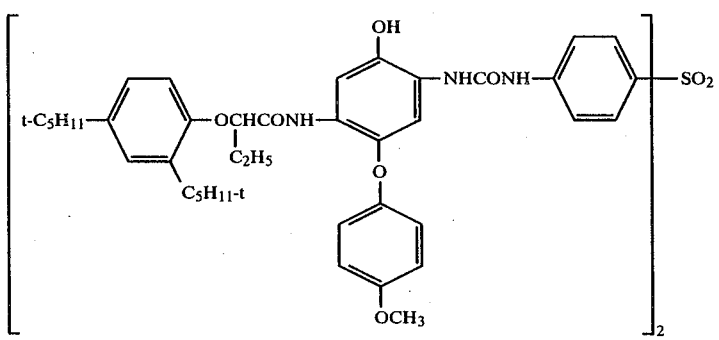 | | |

Photographic additives such as dye-forming couplers, DIR couplers, DIR compounds image stabilizers, color fog preventing agents, uv absorbing agents and brighteners do not need to be absorbed onto the surfaces of silver halide grains. Among these additives, those which are hydrophobic may be dispersed by various methods such as the solid dispersion method, the latex dispersion method, and the oil-in-water type emulsion dispersion method. An appropriate dispersion method may be selected in accordance with such factors as the chemical structure of the specific hydrophobic compound such as a coupler. The oil-in-water type emulsion method may be implemented by any conventional method of dispersing hydrophobic additives such as couplers, which usually comprises dissolving such hydrophobic additives in a high-boiling organic solvent having a boiling point not lower than about 150° C., optionally together with a low-boiling solvent and/or a water-soluble organic solvent, then emulsion-dispersing the dissolved hydrophobic additives with the aid of a surfactant in a hydrophilic binder such as an aqueous gelatin solution by means of such dispersing devices as a stirrer, homogenizer, colloid mill, flow-jet mixer or ultrasonic disperser, and thereafter adding the resulting dispersion into the hydrophilic colloidal fluid of interest. In that case, the step of removing the low-boiling organic solvent after or simultaneously with dispersion may be added.

The high-boiling organic solvent is one having a boiling point not lower than 150° C. that does not react with the oxidized product of a developing agent, such as a phenol derivative, an alkyl phthalate ester, a phosphate ester, a citrate ester, a benzoate ester, an alkylamide, a fatty acid ester or a trimesic acid ester.

Low-boiling solvents or water-soluble organic solvents may be used together with, or instead of high-boiling solvents. Illustrative low-boiling organic solvents that are substantially water-insoluble include ethyl acetate, propyl acetate, butyl acetate, butanol, chloroform, carbon tetrachloride, nitromethane, nitroethane and benzene.

If photographic additives such as dye forming couplers, DIR couplers, DIR compounds, image stabilizers, color fog preventing agents, UV absorbers and brighteners have acid groups such as carboxylic acid group or a sulfonic acid group, these additives may be incorporated in hydrophilic colloids in the form of aqueous alkaline solutions.

Dispersion aids may be used in dissolving hydrophobic compounds in low-boiling solvents, used either alone or in mixture with high-boiling solvents, then dispersing the dissolved hydrophobic compounds into water either mechanically or by means of ultrasonic waves, and suitable dispersion aids include anionic surfactants, nonionic surfactants, cationic surfactants and amphoteric surfactants.

The oxidation product of a developing agent or an electron transfer agent may migrate between emulsion layers in the light-sensitive layer (i.e., between layers which are sensitive to the same color and/or between layers which are sensitive to different colors) so as to cause color contamination, deteriorated image sharpness or pronounced graininess. In order to avoid these problems, color fog preventing agents may be employed. Such color fog preventing agents may be incorporated in emulsion layers per se. Alternatively, they may be incorporated in an intermediate layer disposed between adjacent emulsion layers.

The silver halide photographic material of the present invention may use an image stabilizer. Preferable image stabilizer is a compound that is described in RD 17643, VII, J.

The hydrophilic colloidal layers such as protective layers and intermediate layers in the light-sensitive material of the present invention may contain antifoggants serving to prevent the occurrence of fogging due to discharge resulting from the light-sensitive material being charged by friction or other causes, or UV absorbers for preventing the deterioration of image due to UV radiation.

The light-sensitive material of the present invention may also contain a formaldehyde scavenger in order to prevent the deterioration of magenta-dye forming couplers or the like under the action of formaldehyde during storage.

Dyes, UV absorbers and other additives being incorporated in hydrophilic layers in the light-sensitive material may be mordanted with mordants such as cationic polymers.

Silver halide emulsion layers and/or other hydrophilic colloidal layers in the light-sensitive material may incorporate bleach accelerators or compounds such as development accelerator or restrainer that are capable of altering the developability of the material. Compounds that are preferably used as development accelerators are described in RD No. 17643, XXI, B–D, and compounds that are suitable for use as development restrainers are shown in RD No. 17643, XXI, E. Black-and-white developing agents and/or precursors thereof may be used for attaining accelerated development and other purposes.

In order to achieve increased sensitivity and contrast or to ensure accelerated development, the emulsion layers in the light-sensitive material of the present invention may contain polyalkylene oxides, derivatives thereof such as ether, ester and amine forms, thioether compounds, thiomorpholines, quaternary ammonium compounds, urethane derivatives, urea derivatives, or imidazole derivatives.

Brighteners may be used in the light-sensitive material in order to highlight the whiteness of the background and to mask any staining of the background. Compounds that are preferably used as brighteners are described in RD. No. 17643, V.

The light-sensitive material of the present invention may be provided with auxiliary layers such as filter layers, anti-halation layers, and anti-irradiation layers. These layers and/or emulsion layers may have incorporated therein dyes that will be dissolved out of the light-sensitive material or bleached during development.

Silver halide emulsion layers and/or other hydrophilic colloidal layers in the light-sensitive material of the present invention may contain matting agents for the purpose of reducing its gloss, increasing its adaptability to writing with a pencil, or preventing its adhesion to an adjacent light-sensitive material.

Any suitable matting agents can be used in the present invention. Exemplary matting agents include silicon dioxide, titanium dioxide, magnesium dioxide, aluminum dioxide, barium sulfate, calcium carbonate, acrylic acid and methacrylic acid polymers and esters thereof, polyvinyl resins, polycarbonate and styrene polymers and copolymers thereof.

The matting agents preferably have grain sizes of 0.05 to 10 $\mu$m, and are preferably added in amounts ranging from 1 to 300 mg/m$^2$.

The light-sensitive material of the present invention may contain a lubricant that is capable of reducing its sliding friction The light-sensitive material may also contain an antistat for the purpose of preventing static buildup. The antistat may be incorporated in an antistatic layer on the side of the support where no emulsion layer is formed. Alternatively, the antistat may be incorporated in an emulsion layer and/or a protective layer. Compounds that are preferably used as antistats are described in RD No. 17643, XIII.

Photographic emulsion layers and/or other hydrophilic colloidal layers in the light-sensitive material of the present invention may contain a variety of surfactants for attaining such purposes as improved coating property, prevention of antistatic buildup, improved slipping property, emulsification/dispersion, antiblocking and improved photographic characteristics in terms of accelerated development, hard tone and sensitization.

Photographic emulsion layers and other layers for making the light-sensitive material of the present invention may be coated onto flexible reflecting supports such as paper or synthetic paper laminated with an α-olefin polymer (e.g., polyethylene, polypropylene or ethylene/butene copolymer), films made of semi-synthetic or synthetic polymers such as cellulose acetate, cellulose nitrate, polystyrene, polyvinyl chloride, polyethylene terephthalate, polycarbonate and polyamide, flexible supports having reflective layers formed on these films, or rigid supports made of such material as glass, metals or ceramics.

After the support is optionally surface-treated by a suitable technique such as corona discharge, UV irradiation or flame treatment, hydrophilic colloidal layers for making a light-sensitive material may be coated onto the support either directly or with one or more subbing layers formed thereon. The subbing layers are provided for improving the adhesive strength, anti-static property, dimensional stability, wear resistance, hardness, anti-halation property, frictional characteristics and/or other characteristics of the surface of the support.

A thickener may be used in order to facilitate the coating operation performed for producing the photographic material of the present invention. There are additives such as hardeners which are reactive enough to cause premature gelling if they are preliminarily incorporated in the coating fluid. Such reactive additives are preferably mixed with the other components by means of a suitable device such as a static mixer just before the start of coating operation.

Particularly useful coating techniques are extrusion coating and curtain coating, both of which will enable simultaneous application of two or more layers. Bucket coating may be employed if a specific object permits. The coating speed may be selected at any desirable value.

The surfactants to be used in the present invention are not particularly limited, but exemplary surfactants include natural surfactants, nonionic surfactants, cationic surfactants, anionic surfactants containing acidic groups and amphoteric surfactants. Fluorine based surfactants may also be employed for similar purposes.

Color photographic processing is performed after exposure to obtain dye images using the light-sensitive material of the present invention. Color photographic processing consists of a color development step, bleach step, fixing step, washing step and an optional stabilization step. A bleach-fix step can be performed using a combined bleach-fix bath instead of two separate processing steps using a bleaching solution and a fixer, respectively. A monobath processing step can also be employed wherein color development, bleach and fixing can be performed in a monobath using a combined developing and bleach-fix bath.

A prehardening step, neutralizing step, stop-fix step or posthardening step may be performed in combination with the above-listed processing steps. An activator processing step may be performed instead of the color development step where a color developing agent or its precursor is incorporated in the photographic material and development is performed in an activator bath. Alternatively, activator processing may be applied to the monobath processing in the above-described color processing. Typical examples of these processing techniques are listed hereunder. (These techniques each include either a washing step or washing and stabilization steps.)

Color development step—bleach step—fixing step

Color development step—bleach-fix step

Prehardening step—color development step—stop fix step—washing step—bleach step—fixing step—washing step—posthardening step Color development step—washing step—complementary color development step—stopping step—bleach step—fixing step Activator processing step—bleach-fix step Activator processing step—bleach step—fixing step Monobath processing step The processing temperature is usually selected in the range from 10° to 65° C., but may exceed 65° C. A preferable processing temperature is in the range from 25° to 45° C.

The color developer generally comprises an aqueous alkali solution containing a color developing agent. The color developing agent is an aromatic primary amine color developing agent, such as aminophenol-based and p-phenylenediamine derivatives. These color developing agents may be used in the form of organic or inorganic acid salts such as hydrochloride, sulfate, p-toluenesulfonate, sulfite, oxalate and benzenesulfonate.

These compounds are generally used in amounts in the range from about 0.1 to 30 g, more preferably in amounts in the range from about 1 to 15 g, per 1,000 ml of color developer. If they are used in amounts smaller than 0.1 g per 1,000 ml of color developer, sufficient color densities are not obtained.

Particularly useful aromatic primary axine-based color developing agents are N,N'-dialkyl-p-phenylenediamine compounds, with the alkyl group and phenyl group being either substituted or unsubstituted.

The above-listed color developing agents may be employed either singly or in combination of two or more compounds. The above-listed color developing agents may further be incorporated in color photographic materials. In such case, the silver halide color photographic material may be processed with an alkali solution (activator solution) instead of a color developer, immediately followed by bleach-fix.

The color developer used in the present invention may contain alkali substances that are usually added in a developer. The color developer of the present invention may further contain various additives such as benzyl alcohol, alkali metal halides such as potassium bromide and potassium chloride, conditioners such as citrazinic acid, and preservatives such as hydroxylamine and sulfite. The color developer of the present invention may also contain antifoaming agents and surfactants, and organic solvents such as methanol, dimethylformamide, and dimethylsulfoxide as required.

The color developer used in the present invention usually has a pH of 7 or higher, preferably a pH of about 9 to 13.

The color developer used in the present invention may further contain antioxidation agents.

Various chelating agents may be incorporated in the color developer used in the present invention as sequestering agents.

The bleach step may be performed simultaneously with the fixing step or separately, as described above. Exemplary bleaching agents include metal complex salts of organic acids such as polycarboxylic acid, aminopolycarboxylic acid, oxalic acid and citric acid that are coordinated to metal ions such as iron, cobalt and copper ions.

These bleaching agents are added in amounts in the range from 5 to 450 g/1,000 ml, more preferably in the range from 20 to 250 g/1,000 ml.

In addition to the above-listed bleaching agents, the bleaching solution may contain sulfites as preservatives, as required. The bleaching solution may contain an EDTA iron (III) complex salt bleaching agent, as well as a large amount of halides such as ammonium bromide.

The bleaching solution used in the present invention may contain various bleach accelerators.

The bleaching solution has a pH of 2.0 or higher. It is generally used with a pH of 4.0 to 9.5, desirably a pH of 4.5 to 8.0, most preferably a pH of 5.0 to 7.0.

Fixers of generally employed compositions may be employed. Fixing agents are added in amounts of 5 g/1,000 ml or greater, and within the range that they can be dissolved in the fixer. They are usually added in amounts ranging from 70 to 250 g/1,000 ml. Part of the fixing agents may be incorporated in the bleaching bath, or part of the bleaching agents may be incorporated in the fixing bath.

The bleaching solution and/or fixing solution may contain various buffering agents. Buffering agents may be used either singly or in combination of two or more kinds. These bleaching solution and/or fixing solution can also contain various brightening agents, antifoaming agents and surfactants. They can further contain preservatives, organic chelating agents, stabilizing agents, hardeners and organic solvents, as required.

The fixer is used with a pH of 3.0 or higher. It is usually employed with a pH of 4.5 to 10, desirably with a pH of 5 to 9.5, most preferably with a pH of 6 to 9.

Exemplary bleaching agents that may be used in the bleaching fix bath include the metal complex salts of organic acids described in the aforementioned bleach step. Preferred compounds and the amounts they are added to the processing solution are the same as in the above-described bleach step.

In addition to the above-listed bleaching agents, the bleach-fix bath may contain silver halide fixing agents, and sulfites as preservatives as required.

The fixing agents described in the aforementioned fixing step can be incorporated in the bleach-fix bath as silver halide fixing agents. The amount of the fixing agent used and the buffering agents and other additives that can be incorporated in the bleach-fix bath are the same as those used in the above-described fixing step.

The bleach-fix bath has a pH of 4.0 or higher. It is usually used with a pH of 5.0 to 9.5, desirably with a pH of 6.0 to 8.5, most preferably with a pH of 6.5 to 8.5.

WORKING EXAMPLE

The following examples are provided for the purpose of further illustrating the present invention.

Unless otherwise noted, the amounts of components in the silver halide photographic materials prepared in the following examples are based on a unit area of 1 $m^2$ and the amounts of silver halide and colloidal silver are indicated in terms of silver.

EXAMPLE 1

Sample No. 1 of a color photographic element was prepared by coating a triacetyl cellulose film base with the layers specified below, with the first layer being positioned the closest to the base.

Sample 1 (comparison):

First layer: anti-halation layer (HC-1) a gelatin layer containing black colloidal silver Second layer: intermediate layer (I.L.) a gelatin layer containing a dispersion of 2,5-di-t-octylhydroquinone Third layer: less red-sensitive silver halide emulsion layer (RL-1) containing the following components: monodispersed emulsion (Em I) that had an average grain size ($\bar{r}$) of 0.30 μm and which was composed of AgBrI containing 6 mol % AgI (silver deposit, 1.8 g/$m^2$); sensitizing dye I ($6\times10^{-5}$ moles per mole of Ag); sensitizing dye II ($1.0\times10^{-5}$ moles per mole of Ag); cyan coupler, C-1 (0.06 moles per mole of Ag); colored cyan coupler, CC-1 (0.003 moles per mole of Ag). DIR compound, D-1 (0.0015 moles per mole of Ag); DIR compound, D-2 (0.002 moles per mole of Ag).

Fourth layer: highly red-sensitive silver halide emulsion layer (BH-1) containing the following components: monodispersed emulsion (Em II) that had an average grain size ($\bar{r}$) of 0.5 μm and which was composed of AgBrI containing 7.0 mol % AgI (silver deposit, 1.3 g/$m^2$); sensitizing dye I ($3\times10^{-5}$ moles per mole of Ag); sensitizing dye II ($1.0\times10^{-5}$ mole per mole of Ag), cyan coupler, C-1 (0.02 moles per mole of Ag); colored cyan coupler, CC-1 (0.0015 moles per mole of Ag): DIR compound, D-2 (0.001 mole per mole of Ag).

Fifth layer: intermediate layer (I.L.) a gelatin layer which was the same as the second layer Sixth layer: less green-sensitive silver halide emulsion layer (GL-1) containing the following components: Em I (silver deposit, 1.5 g/$m^2$): sensitizing dye III ($2.5\times10^{-5}$ moles per mole of Ag); sensitizing dye IV ($1.2\times10^{-5}$ moles per mole of Ag); magenta coupler, M-1 (0.050 moles per mole of Ag); colored magenta coupler, CM-1 (0.009 moles per mole of Ag); DIR compound, D-1 (0.0010 mole per mole of Ag); DIR compound, D-3 (0.0030 mole per mole of Ag);

Seventh layer: highly green-sensitive silver halide emulsion layer (GH-1) containing the following components: Em II (silver deposit, 1.4 g/$m^2$); sensitizing dye III ($1.5\times10^{-5}$ moles per mole of Ag); sensitizing dye IV ($1.0\times10^{-5}$ mole per mole of Ag); magenta coupler, M-1 (0.020 mole per mole of Ag); colored magenta coupler, CM-1 (0.002 moles per mole of Ag); DIR compound, D-3 (0.0010 mole per mole of Ag).

Eighth layer: yellow filter layer (YC-1) a gelatin layer containing yellow colloidal silver and a dispersion of 2,5-di-t-octylhydroquinone Ninth layer: less blue-sensitive silver halide emulsion layer (BL-1) containing the following components: monodispersed emulsion (Em III) that had an average grain size of 0.48 μm and which was composed of AgBrI containing 6 mol % AgI (silver deposit, 0.9 g/m$^2$); sensitizing dye V ($1.3\times10^{-5}$ moles per mole of Ag); yellow coupler, Y-1 (0.34 moles per mole of Ag).

Tenth layer: highly blue-sensitive silver halide emulsion layer (BH-1) containing the following components: monodispersed emulsion (Em IV) that had an average grain size of 0.8 μm and which was composed of AgBrI containing 15 mol % AgI (silver halide deposit, 0.5 g/m$^2$); sensitizing dye V ($1.0\times10^{-5}$ mole per mole of Ag); yellow coupler, Y-1 (0.13 mole per mole of Ag); DIR compound, D-2 (0.0015 moles per mole of Ag).

Eleventh layer: first protective layer (Pro-1) a gelatin layer containing AgBrI (1 mol % AgI; average grain size, 0.07 μm; silver deposit, 0.5 g/m$^2$) and two ultraviolet absorbers, UV-1 and UV-2.

Twelfth layer: second protective layer (Pro-2) a gelatin layer containing polymethyl methacrylate particles (dia. 1.5 μm) and a formaldehyde scavenger (HS-1).

In addition to the components mentioned above, the individual layers contained a gelatin hardener (H-1) and a surfactant as required.

The compounds incorporated in the layers of sample No. 1 had the following chemical structures or names.

Sensitizing dye I: anhydro-5,5'-dichloro-9-ethyl-3,3'-di-(3-sulfopropyl)thiacarbocyanine hydroxide;

Sensitizing dye II: anhydro-9-ethyl-3,3'-di-(3-sulfopropyl)-4,5,4',5'-dibenzothiacarbocyanine hydroxide;

Sensitizing dye III: anhydro-5,5'-diphenyl-9-ethyl-3,3'-di(3-sulfopropyl)oxacarbocyanine hydroxide;

Sensitizing dye IV: anhydro-9-ethyl-3,3'-di-(3-sulfopropyl)-5,6,5',6'-dibenzoxacarbocyanine hydroxide;

Sensitizing dye V: anhydro-3,3'-di-(3-sulfopropyl)-4,5-benzo-5'-methoxythiacyanine hydroxide;

C-1

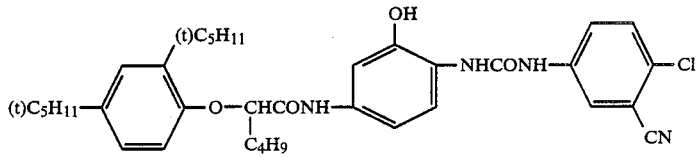

CC-1

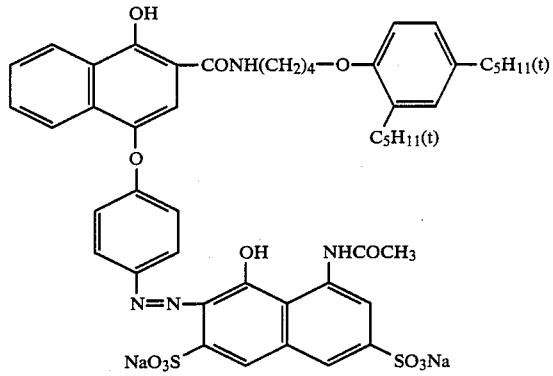

D-1

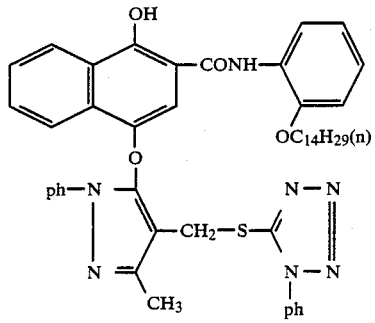

D-2

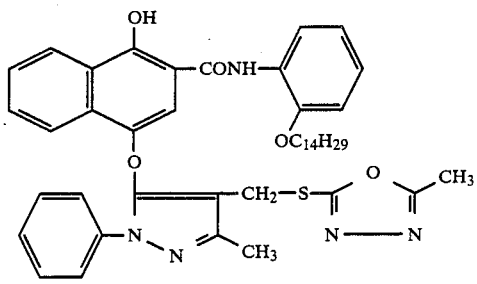

-continued
D-3
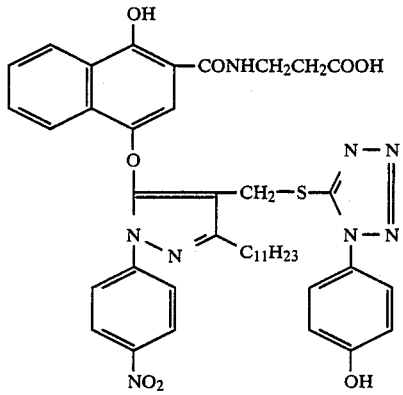
M-1
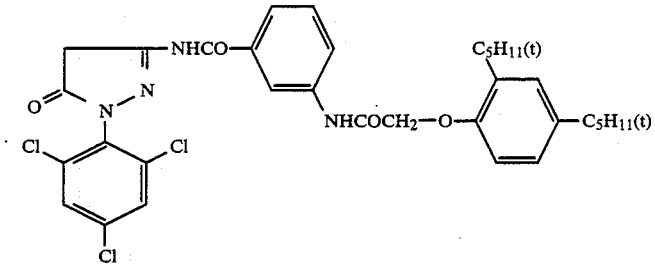
CM-1
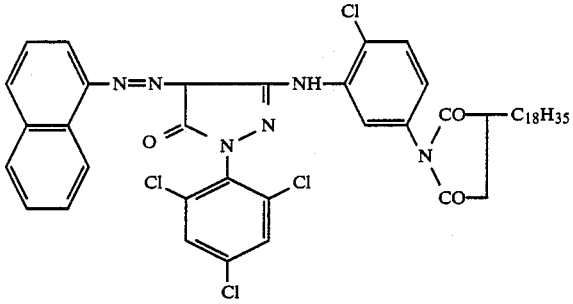
Y-1
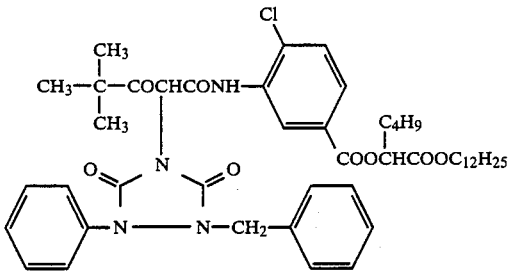
UV-1
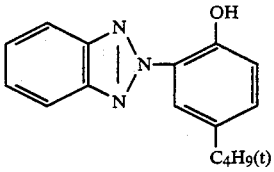
UV-2
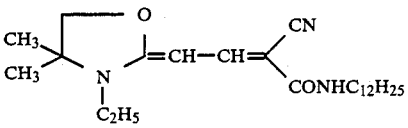

-continued

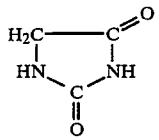

HS-1

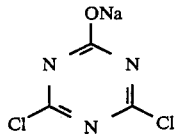

H-1

Sample Nos. 2 to 22 were prepared in the same manner as employed for preparing sample No. 1 except that the magenta coupler M-1 in the sixth layer was replaced by magenta couplers within the scope of the present invention (for their compound numbers, see Table 1) as for sample Nos. 2–8 and 10–20 (each of the magenta couplers was used in sample Nos. 2 to 22 in an amount that would provide a maximum color density of magenta image which was substantially the same as that attained by sample No. 1) and that selected positive compounds (for their specific compound numbers, see Table 1) were incorporated in the fifth layer in an amount of 0.15 moles per mole of the magenta coupler in the sixth layer.

TABLE 1

| Sample No. | Magenta coupler | Positive compound | Percent gamma drop | MTF of magenta image | Sensitivity of magenta image | Remarks |
|---|---|---|---|---|---|---|
| 1 | M - 1 | none | 21 | 100 | 100 | Comparative Samples |
| 2 | P - 5 | none | 18 | 100 | 125 | " |
| 3 | P - 18 | none | 18 | 100 | 130 | " |
| 4 | P - 44 | none | 17 | 100 | 130 | " |
| 5 | P - 190 | none | 19 | 100 | 125 | " |
| 6 | P - 152 | none | 20 | 100 | 125 | " |
| 7 | P - 169 | none | 21 | 100 | 120 | " |
| 8 | P - 174 | none | 20 | 100 | 125 | " |
| 9 | M - 1 | U -18 | 21 | 120 | 90 | " |
| 10 | P - 5 | U -18 | 5 | 125 | 115 | Sample of the invention |
| 11 | P - 18 | U -18 | 7 | 125 | 120 | " |
| 12 | P - 44 | U -18 | 6 | 130 | 120 | " |
| 13 | P - 190 | U -18 | 7 | 125 | 115 | " |
| 14 | P - 152 | U -18 | 10 | 120 | 115 | " |
| 15 | P - 169 | U -18 | 9 | 125 | 110 | " |
| 16 | P - 174 | U -18 | 11 | 120 | 115 | " |
| 17 | P - 18 | U -4 | 7 | 125 | 120 | " |
| 18 | P - 18 | U -13 | 7 | 125 | 120 | " |
| 19 | P - 18 | U -26 | 10 | 100 | 130 | " |
| 20 | P - 18 | U -6 | 11 | 100 | 130 | " |
| 21 | M - 1 | U -18 | 21 | 120 | 90 | Comparative Samples |
| 22 | M - 1 | U -26 | 21 | 100 | 100 | " |

Each of the samples thus prepared was left to stand for one week in an atmosphere having a temperature of 40° C. and a relative humidity of 80%. These treated samples, together with a set of untreated samples, were given wedge exposure under white light and subjected to photographic processing under the conditions specified below. The results are shown in Table 1. The term "percent gamma drop" used in Table 1 means the decrease in the gamma of the magenta image formed in each of the treated samples as compared with the value for the corresponding untreated sample. The term "sensitivity" used in Table 1 refers to the relative sensitivity of the magenta image formed in each of the untreated samples, with the value for sample No. 1 being taken as 100. As in the usual case, sensitivity is the reciprocal of the exposure necessary to provide a minimum density plus 0.1.

The samples were also given exposure under white light for MTF measurement and subjected to the same photographic processing as performed above. The MTF value for 20 lines/mm in the magenta image that was produced in each sample was determined and shown in Table 1 in terms of a relative value, with the value for sample No. 1 being taken as 100.

| Processing scheme (38° C.) | |
|---|---|
| Color development | 3 min and 15 sec |
| Bleaching | 6 min and 30 sec |
| Washing | 3 min and 15 sec |
| Fixing | 6 min and 30 sec |
| Washing | 3 min and 15 sec |
| Stabilizing | 1 min and 30 sec |
| Drying | |

The processing fluids used in the individual steps of processing had the following compositions.

| Color developing solution | |
|---|---|
| 4-Amino-3-methyl-N-ethyl-N-(βhydroxyethyl)-aniline sulfate | 4.75 g |
| Anhydrous sodium sulfite | 4.25 g |
| Hydroxylamine hemisulfate | 2.0 g |
| Anhydrous potassium carbonate | 37.5 g |
| Sodium bromide | 1.3 g |
| Nitrilotriacetic acid trisodium salt (monohydrate) | 2.5 g |

-continued

| | |
|---|---|
| Potassium hydroxide | 1.0 g |
| Water to make | 1,000 ml |
| Bleaching solution | |
| Ethylenediaminetetraacetic acid iron ammonium salt | 100.0 g |
| Ethylenediaminetetraacetic acid diammonium salt | 10.0 g |
| Ammonium bromide | 150.0 g |
| Glacial acetic acid | 10.0 ml |
| Water to make | 1,000 ml |
| (pH adjusted to 6.0 with aqueous ammonia) | |
| Fixing solution | |
| Ammonium thiosulfate | 175.0 g |
| Anhydrous sodium sulfite | 8.5 g |
| Sodium metasulfite | 2.3 g |
| Water to make | 1,000 ml |
| (pH adjusted to 6.0 with acetic acid) | |
| Stabilizing solution | |
| Formaldehyde (37% aq. sol.) | 1.5 ml |
| Konidax (product of Konishiroku Photo Industry Co., Ltd.) | 7.5 ml |
| Water to make | 1,000 ml |

The data in Table 1 shows the following: when magenta couplers that were within the scope of the present invention were used alone, high sensitivities resulted but the gamma of magenta image experienced a significant drop after exposure to a hot and humid atmosphere (sample Nos. 2–7); when they were used in combination with positive compounds that were within the scope of the present invention and which were incorporated in the fifth layer, the percent gamma drop was appreciably decreased although the sensitivity was somewhat lowered (sample Nos. 10–20). When U-17, U-18 and U-20 were used as positive compounds, significant improvement in the MTF of magenta image was also achieved (sample Nos. 10–18). When the comparative magenta coupler (M-1) was used, the percent gamma drop remained at high levels irrespective of whether positive compounds that were within the scope of the present invention were incorporated in the fifth layer or not (sample Nos. 1, 9, 21 and 22); in other words, the positive compounds of the present invention did not exhibit their intended effects in the presence of the magenta coupler, M-1. It is therefore clear that by using the magenta couplers of the present invention in combination with the positive compounds of the present invention, superior light-sensitive materials can be produced that do not have any unwanted absorption in the magenta color forming layer and which have high sensitivity and improved sharpness while exhibiting superior stability during storage in a hot and humid atmosphere.

In addition, Sample No. 23 was prepared in the same manner as above except that the yellow coupler Y-1 used in Sample No. 11 was replaced by a benzoyl type yellow coupler Y-16. The sample so prepared was processed for development and evaluated in the same manner as above, with the result that the sharpness of the image obtained was further strikingly improved.

Also, Sample No. 24 was prepared in the same manner as above except that the cyan coupler C-1 used in Sample No. 11 was replaced by a non-ureido type cyan coupler of the following structure:

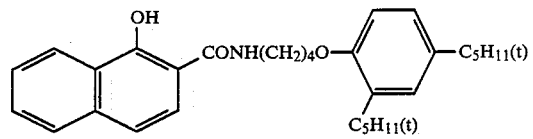

The sample so prepared was processed for development and evaluated in the same manner as above, to find that the residual amount of silver was large, the desilverization being inferior.

EXAMPLE 2

Sample Nos. 23 to 31 were prepared in the same manner as employed for preparing sample No. 1 except that the magenta coupler M-1 in the sixth layer was replaced by selected magenta couplers which were within the scope of the present invention (for their compound numbers, see Table 2) and were used in amounts that would provide a maximum color density of magenta image that was substantially the same as that attained by sample No. 1, and that selected positive compounds (for their compound numbers, see Table 2) were also incorporated in the sixth layer in an amount of 0.15 moles per mole of the magenta coupler in the same layer.

These samples were treated and photographically processed as in Example 1 together with sample Nos. 1 and 10–18. The results are shown in Table 2.

TABLE 2

| Sample No. | Magenta coupler | Positive compound | Percent gamma drop | MTF of magenta image | Sensitivity of magenta image | Remarks |
|---|---|---|---|---|---|---|
| 1 | M - 1 | U -18 | 19 | 100 | 100 | Comparison |
| 10 | P - 5 | U -18 | 5 | 125 | 115 | Sample of the invention |
| 11 | P - 18 | U -18 | 6 | 125 | 120 | " |
| 12 | P - 44 | U -18 | 5 | 130 | 120 | " |
| 13 | P - 190 | U -18 | 6 | 125 | 115 | " |
| 14 | P - 152 | U -18 | 8 | 120 | 115 | " |
| 15 | P - 169 | U -18 | 9 | 125 | 110 | " |
| 16 | P - 174 | U -18 | 9 | 120 | 115 | " |
| 17 | P - 18 | U -4 | 8 | 125 | 120 | " |
| 18 | P - 18 | U -13 | 8 | 125 | 120 | " |
| 23 | P - 5 | U -18 | 5 | 125 | 100 | " |
| 24 | P - 18 | U -18 | 6 | 125 | 105 | " |
| 25 | P - 44 | U -18 | 5 | 130 | 105 | " |
| 26 | P - 190 | U -18 | 6 | 125 | 100 | " |
| 27 | P - 152 | U -18 | 8 | 120 | 100 | " |
| 28 | P - 169 | U -18 | 9 | 125 | 100 | " |
| 29 | P - 174 | U -18 | 9 | 120 | 100 | " |
| 30 | P - 18 | U -4 | 8 | 125 | 105 | " |
| 31 | P - 18 | U -13 | 8 | 125 | 105 | " |

By comparing the data for sample Nos. 10–18 (the positive compounds were in the fifth layer) with that for sample Nos. 23–31 (the positive compounds were in the sixth layer), one will be able to see that in terms of sensitivity, the positive compounds of the present invention are preferably incorporated in a photographic layer (5th layer) that is a non-emulsion layer and which is closer to the base than the emulsion layer (6th layer) containing the magenta couplers of the present invention. It should, however, be noted that as is clear from comparison with sample No. 1, the advantages of the present invention could satisfactorily be displayed by sample Nos. 23–31.

What is claimed is:

1. A negative-working silver halide color photographic material having at least one silver halide emulsion layer on a support, said material including a non-diffusible pyrazolotriazole-based magenta coupler and means for forming an unsharp positive image;

wherein said pyrazolotriazole-based magenta coupler is represented by the following formula (A) or (B):

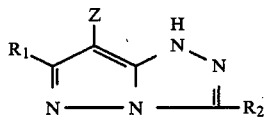

(A)

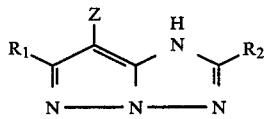

(B)

wherein $R_1$ and $R_2$ each independently represents an alkyl group, an aryl group, or a heterocyclic group, each of which may be bonded to a carbon atom of the nucleus through an oxygen atom, a nitrogen atom, or a sulfur atom; and Z represents a hydrogen atom or a group which leaves upon formation of a dye through coupling with the oxidized product of an aromatic primary amine color developing agent, said means for forming an unsharp positive image being a compound of low diffusibility, said compound being either a chromatic compound having a predominant absorption in the wave-length region where the dye formed by said non-diffusible coupler as a result of reaction with the oxidation product of a color developing agent has a predominant absorption, or a precursor of said chromatic compound, said chromatic compound or said precursor, when reacted with the oxidation product of a color developing agent, being achromatized or producing a non-diffusible dye that has a predominant absorption in the wavelength region where a color dye formed by reaction between said non-diffusible coupler and said oxidation product has a predominant absorption, said compound of low diffusibility being contained in a layer in or adjacent to a layer that contains said magenta coupler.

2. A negative-working silver halide color photographic material according to claim 1, wherein said pyrazolotriazole-based magenta coupler is one represented by said formula (A).

3. A negative-working silver halide color photographic material according to claim 2, wherein Z in said formula (A) is a chlorine atom.

4. A negative-working silver halide color photographic material according to claim 1, which includes a yellow coupler represented by the following formula (Y):

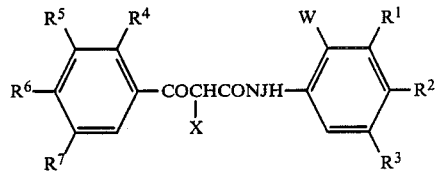

(Y)

wherein $R^1$, $R^2$ and $R^3$ may be the same or different and each represents a hydrogen atom, a halogen atom, an alkyl group, an aryl group, an alkoxy group, an acylamino group, a carbamoyl group, an alkoxycarbonyl group, a sulfonamido group, or a sulfamoyl group; $R^4$, $R^5$, $R^6$ and $R^7$ may be the same or different and each represents a hydrogen atom, an alkyl group, an alkoxy group, an aryloxy group, an acylamino group or a sulfonamido group; W signifies a halogen atom, an alkyl group, an alkoxy group, an aryloxy group, or a dialkylamino group; and X signifies a hydrogen atom or a group that can be eliminated.

5. A negative-working silver halide color photographic material according to claim 1, which includes a cyan coupler represented by the following formula (C):

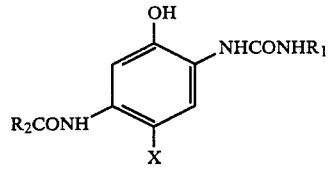

(C)

wherein X represents a hydrogen atom or a group that may be eliminated upon coupling reaction with the oxidized product of an aromatic primary amine color developing agent; $R_1$ represents a naphthyl group, a heterocyclic group (provided that a carbon atom of the heterocyclic group is bonded to the nitrogen atom of the ureido group)or a phenyl group which has at least one substituent selected from among trifluoromethyl, nitro, cyano,

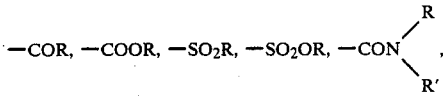

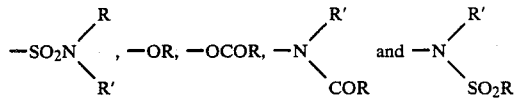

(where R represents an aliphatic group or an aromatic group, and R′ represents a hydrogen atom, an aliphatic group or an aromatic group); and $R_2$ represents an aliphatic or an aromatic group necessary to impart non-diffusibility to both the cyan coupler represented by formula (C) and the cyan dye to be formed from said cyan coupler.

6. A negative-working silver halide color photographic material having at least one silver halide emulsion layer on a support, said material including a non-diffusible pyrazolotriazole-based magenta coupler and means for forming an unsharp positive image;

wherein said pyrazolotriazole-based magenta coupler is represented by the following formula (A) or (B):

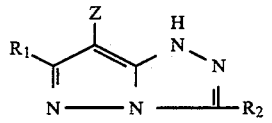

(A)

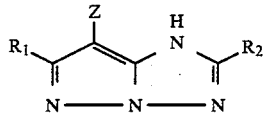

(B)

wherein $R_1$ and $R_2$ each represents an alkyl group, an aryl group, or a heterocyclic group, each of which may be bonded to a carbon atom of the nucleus through an oxygen atom, a nitrogen atom, or a sulfur atom, and Z represents a hydrogen atom or a group which leaves upon formation of a dye through coupling with the oxidized product of an aromatic primary amine color developing agent, said means for forming an unsharp positive image is a compound of low diffusibility, said compound being a chromatic compound having a predominant absorption in the wave-length region where the dye formed by the said non-diffusible coupler as a result of reaction with the oxidation product of a color developing agent has a predominant absorption, or a precursor of said chromatic compound, each of said chromatic compound and said precursor, being achromatized wherein reacted with the oxidation product of a color developing agent, said compound of low diffusibility being contained in a layer in or adjacent to a layer that contains said magenta coupler.

7. A negative-working silver halide color photographic material according to claim 6, wherein said compound of low diffusibility is a color-forming dye producing type compound.

8. A negative-working silver halide color photographic material according to claim 7, wherein said color-forming dye producing type compound is a colored coupler type compound.

* * * * *